US012048861B2

(12) United States Patent
Lagree et al.

(10) Patent No.: US 12,048,861 B2
(45) **Date of Patent: *Jul. 30, 2024**

(54) EXERCISE MACHINE

(71) Applicant: Lagree Technologies, Inc., Chatsworth, CA (US)

(72) Inventors: Sebastien Anthony Louis Lagree, Chatsworth, CA (US); Todd G. Remund, Yuba City, CA (US); Samuel D. Cox, Yuba City, CA (US); Andy H. Gibbs, Oro Valley, AZ (US)

(73) Assignee: Lagree Technologies, Inc., Chatsworth, CA (US)

( * ) Notice: Subject to any disclaimer, the term of this patent is extended or adjusted under 35 U.S.C. 154(b) by 127 days.

This patent is subject to a terminal disclaimer.

(21) Appl. No.: 17/964,486

(22) Filed: Oct. 12, 2022

(65) Prior Publication Data

US 2023/0044282 A1 Feb. 9, 2023

Related U.S. Application Data

(63) Continuation of application No. 16/890,229, filed on Jun. 2, 2020, now Pat. No. 11,478,677.

(60) Provisional application No. 62/856,173, filed on Jun. 3, 2019.

(51) Int. Cl.

| | |
|---|---|
| ***A63B 22/00*** | (2006.01) |
| ***A63B 21/00*** | (2006.01) |
| ***A63B 21/02*** | (2006.01) |
| ***A63B 22/20*** | (2006.01) |

(52) U.S. Cl.

CPC ..... *A63B 22/0023* (2013.01); *A63B 22/0087* (2013.01); *A63B 22/203* (2013.01); *A63B 21/023* (2013.01); *A63B 21/4035* (2015.10)

(58) Field of Classification Search

CPC ..... A63B 22/0023; A63B 22/0087; A63B 22/203; A63B 21/023; A63B 21/4035

See application file for complete search history.

(56) References Cited

U.S. PATENT DOCUMENTS

| | | | |
|---|---|---|---|
| 1,621,477 | A | 3/1927 | Pilates |
| 3,770,267 | A | 11/1973 | McCarthy |
| 4,759,540 | A | 7/1988 | Yu |
| 4,798,378 | A | 1/1989 | Jones |
| 5,066,005 | A | 11/1991 | Luecke |
| 5,263,913 | A | 11/1993 | Boren |
| D362,700 | S | 9/1995 | Breibart |
| D382,319 | S | 8/1997 | Gerschefske |
| 5,681,249 | A | 10/1997 | Endelman |

(Continued)

FOREIGN PATENT DOCUMENTS

WO 2004096376 A1 11/2004

*Primary Examiner* — Megan Anderson

(74) *Attorney, Agent, or Firm* — Neustel Law Offices

(57) ABSTRACT

An exercise machine with a slidable carriage and accessories providing for a plurality of exerciser positioning surfaces and gripping handles. The exercise machine generally includes one or more lifting handles for raising or lowering either end of the exercise machine with respect to a ground surface. The exercise machine may also include a plurality of wheels each including a ridge adapted to engage with a corresponding groove in a track of the exercise machine. The exercise machine may also include a handle including a pair of arms which are positioned at a distance just greater than a width of the carriage.

20 Claims, 37 Drawing Sheets

(56) References Cited

U.S. PATENT DOCUMENTS

| | | | | |
|---|---|---|---|---|
| 5,885,197 | A | 3/1999 | Barton | |
| 5,967,955 | A | 10/1999 | Westfall | |
| 6,179,753 | B1 | 1/2001 | Barker | |
| 7,163,500 | B2 | 1/2007 | Endelman | |
| 7,803,095 | B1 | 9/2010 | Lagree | |
| 7,931,570 | B2 | 4/2011 | Hoffman | |
| 8,249,714 | B1 | 8/2012 | Hartman | |
| 8,585,554 | B2 | 11/2013 | Shavit | |
| 9,849,330 | B2 * | 12/2017 | Lagree | A63B 21/0552 |
| 10,046,193 | B1 * | 8/2018 | Aronson | A63B 21/4034 |
| 2001/0056011 | A1 | 12/2001 | Endelman | |
| 2003/0119635 | A1 | 6/2003 | Arbuckle | |
| 2005/0130810 | A1 | 6/2005 | Sands | |
| 2005/0164856 | A1 | 7/2005 | Parmater | |
| 2006/0046914 | A1 | 3/2006 | Endelman | |
| 2006/0199712 | A1 | 9/2006 | Barnard | |
| 2007/0087921 | A1 | 4/2007 | Graham | |
| 2008/0070765 | A1 | 3/2008 | Brown | |
| 2008/0248935 | A1 | 10/2008 | Solow | |
| 2010/0227748 | A1 | 9/2010 | Campanaro | |
| 2011/0009249 | A1 * | 1/2011 | Campanaro | A63B 23/12 482/131 |
| 2011/0143898 | A1 | 6/2011 | Trees | |
| 2011/0166002 | A1 | 7/2011 | Savsek | |
| 2011/0172069 | A1 | 7/2011 | Gerschefske | |
| 2012/0295771 | A1 | 11/2012 | Lagree | |
| 2013/0017935 | A1 | 1/2013 | Endelman | |
| 2013/0196835 | A1 | 8/2013 | Solow | |
| 2014/0011645 | A1 | 1/2014 | Johnson | |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1 | 5/2014 | Lagree | |
| 2014/0141948 | A1 | 5/2014 | Aronson | |
| 2015/0024914 | A1 | 1/2015 | Lagree | |
| 2015/0057127 | A1 | 2/2015 | Lagree | |
| 2015/0065318 | A1 | 3/2015 | Lagree | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 | 12/2015 | Lagree | |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |
| 2016/0317858 | A1 | 11/2016 | Lagree | |
| 2016/0346593 | A1 | 12/2016 | Lagree | |
| 2016/0361602 | A1 | 12/2016 | Lagree | |
| 2017/0014664 | A1 | 1/2017 | Lagree | |
| 2017/0014672 | A1 | 1/2017 | Lagree | |
| 2017/0036057 | A1 | 2/2017 | Lagree | |
| 2017/0036061 | A1 | 2/2017 | Lagree | |
| 2017/0043210 | A9 | 2/2017 | Lagree | |
| 2017/0065846 | A1 | 3/2017 | Lagree | |
| 2017/0072252 | A1 | 3/2017 | Lagree | |
| 2017/0087397 | A1 | 3/2017 | Lagree | |
| 2017/0100625 | A1 | 4/2017 | Lagree | |
| 2017/0100629 | A1 | 4/2017 | Lagree | |
| 2017/0106232 | A1 | 4/2017 | Lagree | |
| 2017/0113091 | A1 | 4/2017 | Lagree | |
| 2017/0120101 | A1 | 5/2017 | Lagree | |
| 2017/0144013 | A1 | 5/2017 | Lagree | |
| 2017/0157452 | A1 | 6/2017 | Lagree | |
| 2017/0157458 | A1 | 6/2017 | Lagree | |
| 2017/0165518 | A1 | 6/2017 | Lagree | |
| 2017/0165555 | A1 | 6/2017 | Lagree | |
| 2017/0189740 | A1 | 7/2017 | Lagree | |
| 2017/0189741 | A1 | 7/2017 | Lagree | |
| 2017/0209728 | A1 | 7/2017 | Lagree | |
| 2017/0239526 | A1 | 8/2017 | Lagree | |
| 2017/0246491 | A1 | 8/2017 | Lagree | |
| 2017/0246499 | A1 | 8/2017 | Lagree | |
| 2017/0296865 | A1 | 10/2017 | Lagree | |
| 2017/0304673 | A1 | 10/2017 | Lagree | |
| 2017/0326406 | A1 | 11/2017 | Lagree | |
| 2017/0340947 | A1 | 11/2017 | Lagree | |
| 2017/0354840 | A1 | 12/2017 | Lagree | |
| 2018/0015319 | A1 | 1/2018 | Lagree | |
| 2018/0021621 | A1 | 1/2018 | Lagree | |
| 2018/0021655 | A1 | 1/2018 | Lagree | |
| 2018/0036583 | A1 | 2/2018 | Lagree | |
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1 | 4/2018 | Lagree | |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |
| 2018/0133542 | A1 | 5/2018 | Lagree | |
| 2018/0178053 | A1 | 6/2018 | Lagree | |
| 2018/0193691 | A1 | 7/2018 | Lagree | |
| 2018/0250551 | A1 | 9/2018 | Lagree | |
| 2018/0250573 | A1 | 9/2018 | Lagree | |
| 2018/0272179 | A1 | 9/2018 | Lagree | |
| 2018/0280782 | A1 | 10/2018 | Lagree | |
| 2018/0318627 | A1 | 11/2018 | Lagree | |
| 2018/0318646 | A1 | 11/2018 | Lagree | |
| 2018/0326252 | A1 | 11/2018 | Lagree | |
| 2018/0353803 | A1 | 12/2018 | Lagree | |
| 2018/0361190 | A1 | 12/2018 | Lagree | |
| 2018/0361197 | A1 | 12/2018 | Lagree | |
| 2019/0083842 | A1 | 3/2019 | Lagree | |
| 2019/0160320 | A1 | 5/2019 | Lagree | |
| 2019/0160329 | A1 | 5/2019 | Lagree | |
| 2019/0232105 | A1 | 8/2019 | Lagree | |
| 2019/0240530 | A1 | 8/2019 | Lagree | |
| 2019/0247694 | A1 | 8/2019 | Lagree | |
| 2019/0247705 | A1 | 8/2019 | Lagree | |
| 2019/0247707 | A1 | 8/2019 | Lagree | |
| 2019/0255375 | A1 | 8/2019 | Lagree | |
| 2019/0269961 | A1 | 9/2019 | Lagree | |
| 2019/0314672 | A1 | 10/2019 | Lagree | |
| 2019/0358484 | A1 | 11/2019 | Lagree | |
| 2020/0030657 | A1 | 1/2020 | Lagree | |
| 2020/0047051 | A1 | 2/2020 | Lagree | |
| 2020/0054913 | A1 | 2/2020 | Lagree | |
| 2020/0078630 | A1 | 3/2020 | Lagree | |
| 2020/0078634 | A1 | 3/2020 | Lagree | |
| 2020/0222741 | A1 | 7/2020 | Aronson | |

* cited by examiner

EXERCISE MACHINE

CROSS REFERENCE TO RELATED APPLICATIONS

The present application is a continuation of U.S. application Ser. No. 16/890,229 filed on Jun. 2, 2020 which issues as U.S. Pat. No. 11,478,677 on Oct. 25, 2022, which claims priority to U.S. Provisional Application No. 62/856,173 filed Jun. 3, 2019. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a resistance exercise machine with a slidable carriage and accessories providing for a plurality of exerciser positioning surfaces and gripping handles.

Related Art

Any discussion of the related art throughout the specification should in no way be considered as an admission that such related art is widely known or forms part of common general knowledge in the field.

Those skilled in the art will appreciate the novelty and commercial value of a transportable, smoothly operating power spring based resistance training machine that further provides the exerciser with the ability to engage a preferred number of a plurality of power springs of various torque ratings to produce the desired exercise resistance.

SUMMARY

An example embodiment is directed to an exercise machine and reciprocating exercise platform and a plurality of platform and handle accessories. The accessories which include a plurality of handles, end platforms, and machine elevating members provide for expanded functionality of the minimally operable machine system.

An exemplary embodiment of a resistance exercise machine with slidable carriage may include a plurality of add-on gripping handles. In another exemplary embodiment, a resistance exercise machine may comprise a plurality of add-on exercise platforms. In another exemplary embodiment, a resistance exercise machine may comprise a jacking mechanism providing for the elevation of either end of the machine relative to the opposed end.

There has thus been outlined, rather broadly, some of the embodiments of the compact exercise machine in order that the detailed description thereof may be better understood, and in order that the present contribution to the art may be better appreciated. There are additional embodiments of the compact exercise machine that will be described hereinafter and that will form the subject matter of the claims appended hereto. In this respect, before explaining at least one embodiment of the compact exercise machine in detail, it is to be understood that the compact exercise machine is not limited in its application to the details of construction or to the arrangements of the components set forth in the following description or illustrated in the drawings. The compact exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments.

The phrase "biasing member" is used herein to mean an extension spring or elastic member that creates a resistance force increasingly proportional to the length of extension.

The phrases "removably attached" and "removably attach" as used herein shall mean a method used to attach one or more optional accessories to the exercise machine described herein. Although the means of removable attachment are not shown or specified, those skilled in the art will appreciate the many well-known methods of securedly connecting at least two assemblies together, including but not limited to threaded fasteners, cam-lock fasteners, weld pins mated with locating keyhole slots, and telescoping tubes with clamps. The method of removably attaching the accessories to an exercise machine as described herein are not limiting, and any alternative method of securing two assemblies together may be used.

A. Compact Exercise Machine with Accessories.

FIGS. 1-21 illustrate an exemplary embodiment of an exercise machine 100 including a base 140 to which one or more accessories 104, 105, 106, 107 may be fixedly or removably connected. In some embodiments, the accessories 104, 105, 106, 107 may be welded or otherwise fixedly attached to the exercise machine 100. In other embodiments, one or more of the accessories 104, 105, 106, 107 may be removably connected to the exercise machine 100. In this manner, the exercise machine 100 may be easily adjusted between a number of different configurations.

Figure 1:
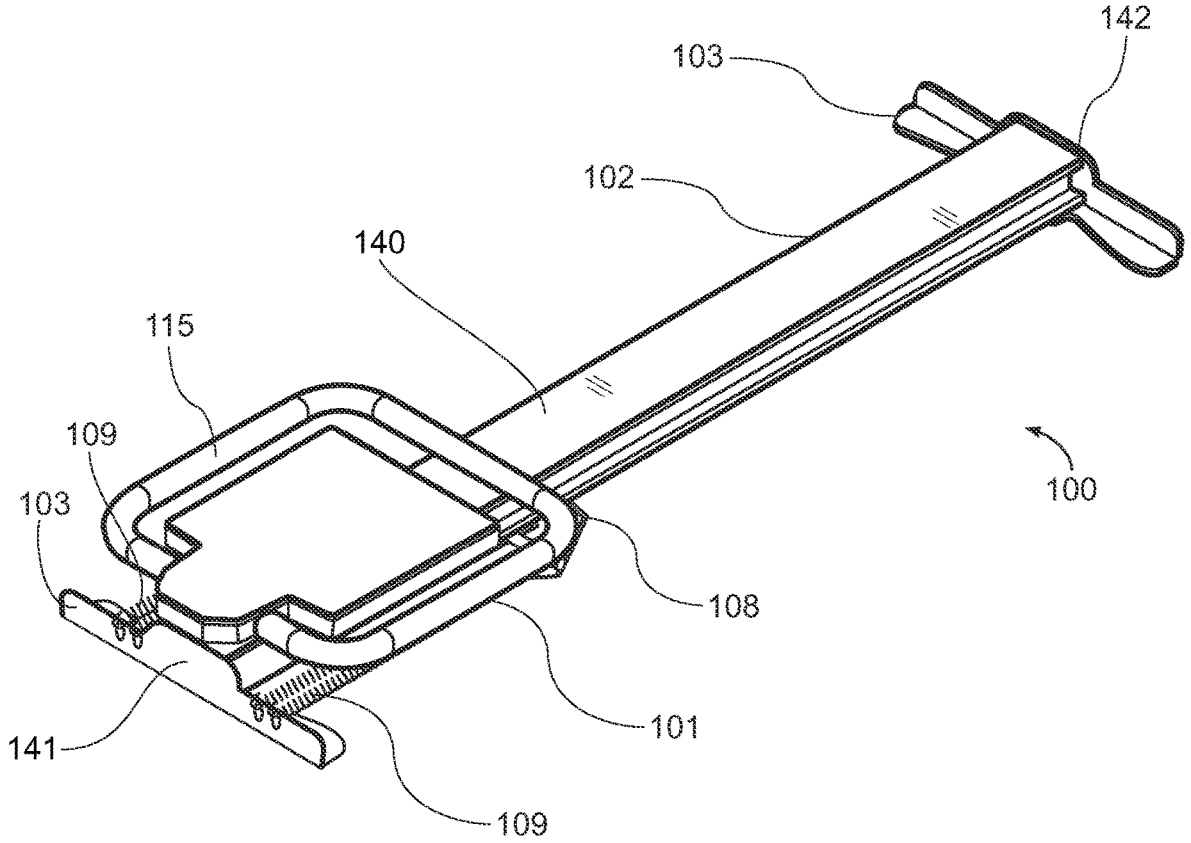
FIG. 1 is a perspective view of a compact exercise machine including a base in accordance with an example embodiment.
Figure 2A:
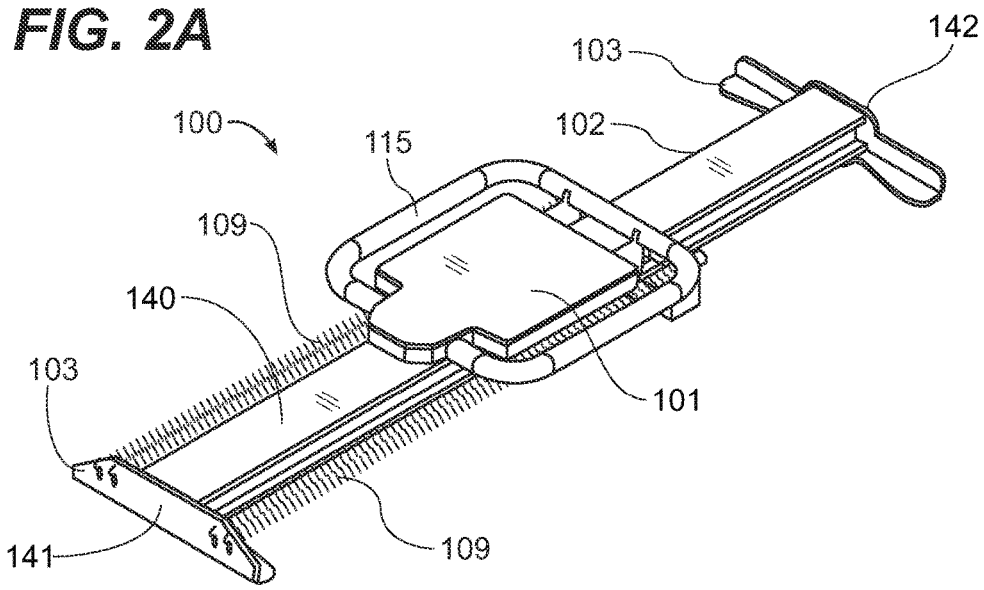
FIG. 2A is a second perspective view of a compact exercise machine including a base in accordance with an example embodiment.
Figure 2B:
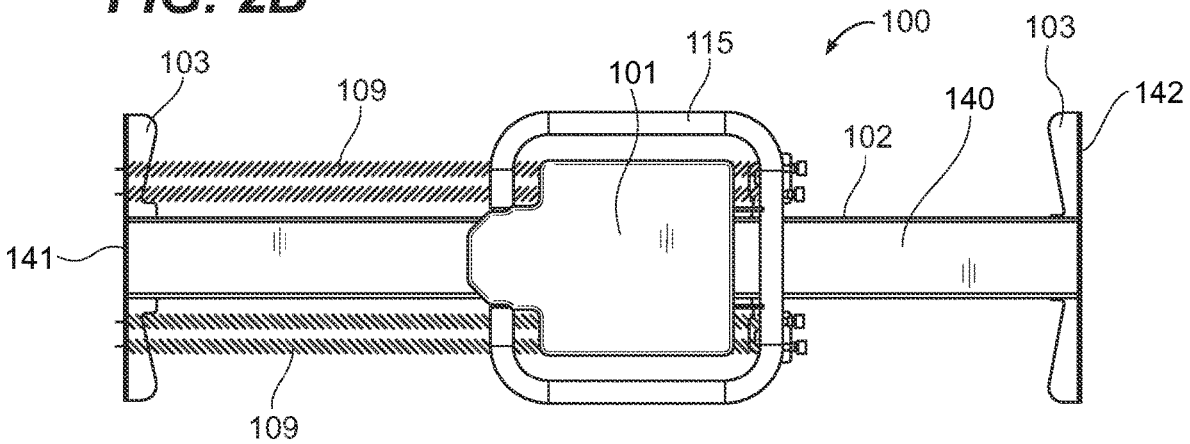
FIG. 2B is a top view of a compact exercise machine including a base in accordance with an example embodiment.

FIGS. 1, 2A and 2B illustrate an exemplary base 140 of an exercise machine 100 to which any number of accessories 104, 105, 106, 107 may be connected to allow for customization of the exercise machine 100. In the exemplary embodiment of FIGS. 3A and 3B, a pair of handles 105*a*, 105*b*, 106*a*, 106*b* are shown connected near the front end 141 of the exercise machine 100 on either the side of the carriage 101. In the exemplary embodiment of FIGS. 4A and 4B, a front end stationary platform assembly 104 has been connected to the front end 141 of the exercise machine 100 to provide a fixed surface on which an exerciser may rest one or more parts of their body when performing a wide range of exercises.

Figure 5A:
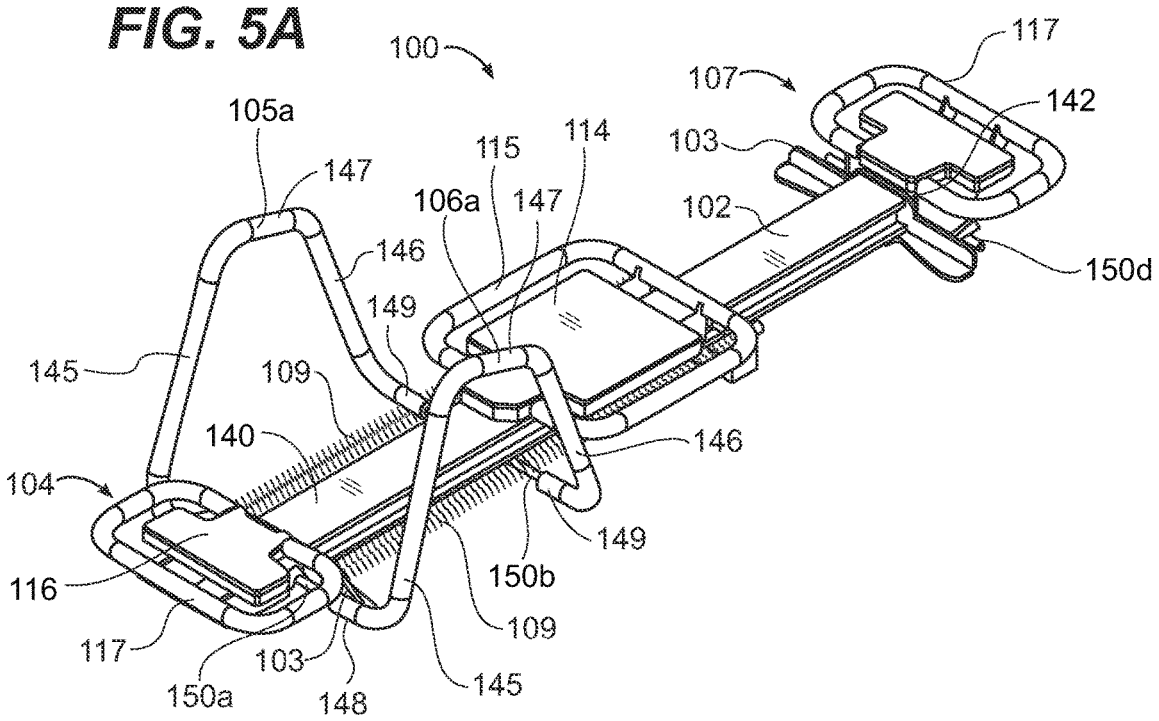
FIG. 5A is a perspective view of a compact exercise machine including a base, a pair of handles, and a pair of end platforms in accordance with an example embodiment.
Figure 5B:
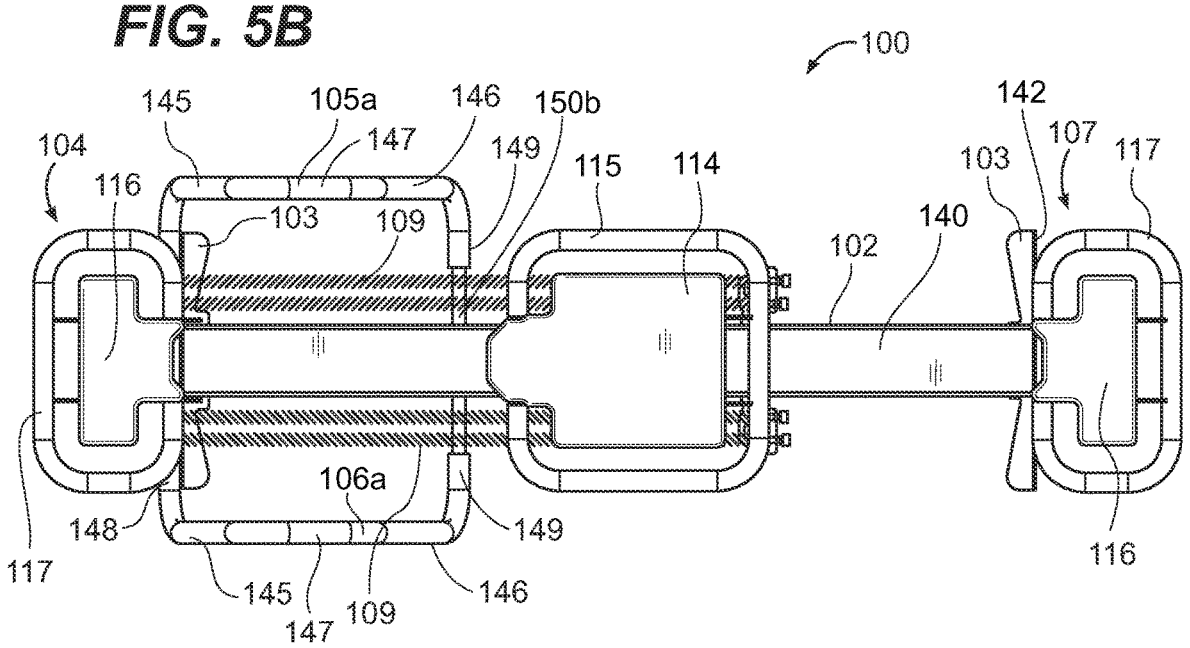
FIG. 5B is a top view of a compact exercise machine including a base, a pair of handles, and a pair of end platforms in accordance with an example embodiment.
Figure 6A:
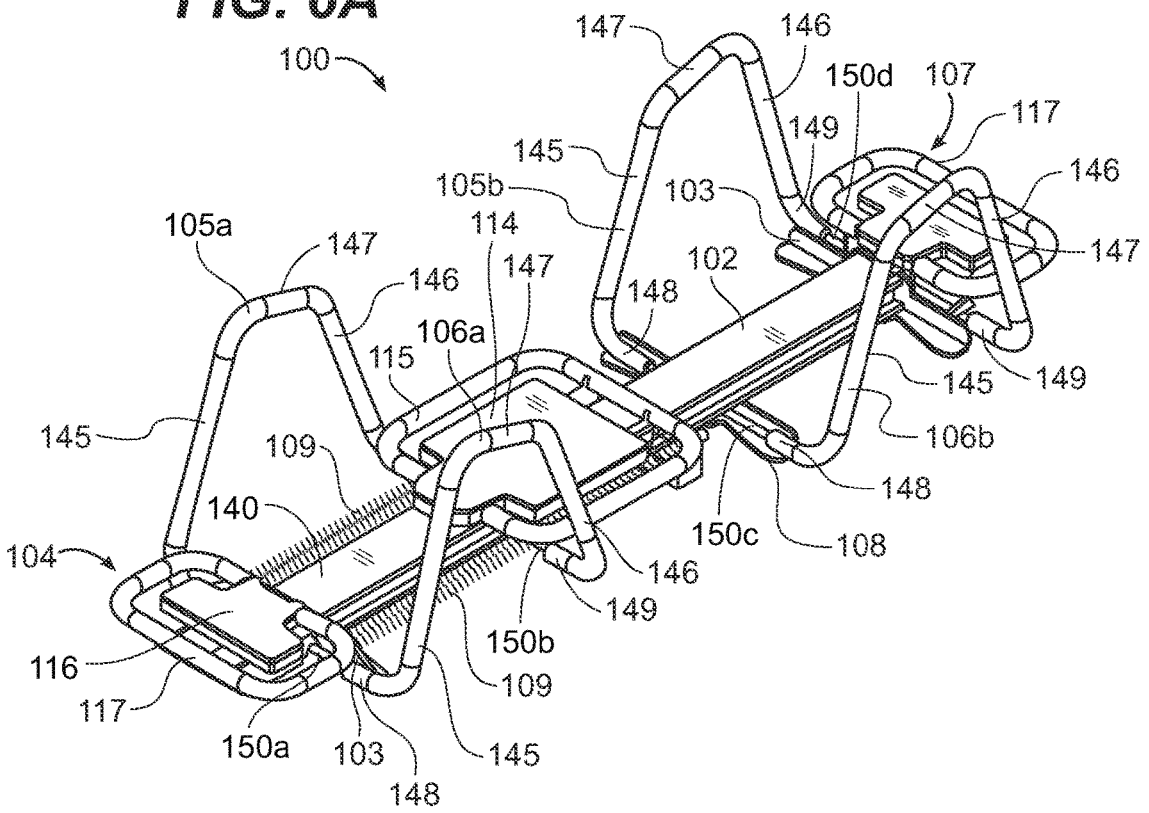
FIG. 6A is a perspective view of a compact exercise machine including a base, two pairs of handles, and a pair of end platforms in accordance with an example embodiment.
Figure 6B:
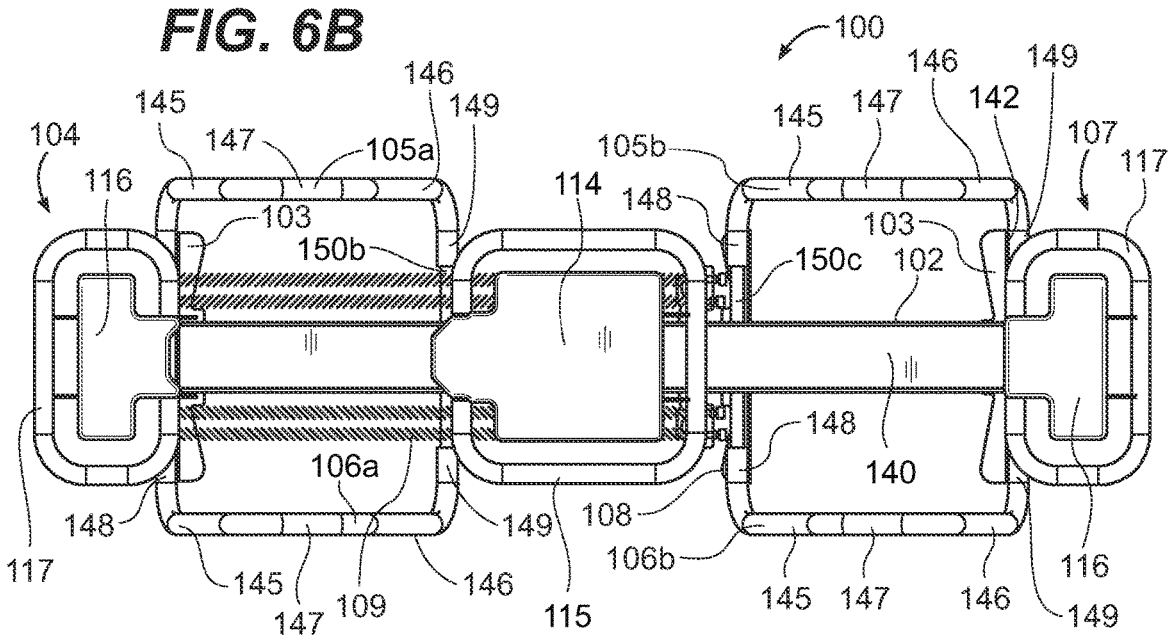
FIG. 6B is a top view of a compact exercise machine including a base, two pairs of handles, and a pair of end platforms in accordance with an example embodiment.

FIGS. 5A and 5B illustrate an embodiment in which a back end stationary platform assembly 107 has been connected to the rear end 142 of the exercise machine 100. FIGS. 6A and 6B illustrates an embodiment in which a pair of handles 105*b*, 106*b* have been connected near the rear end 142 of the exercise machine 100.

Figure 7A:
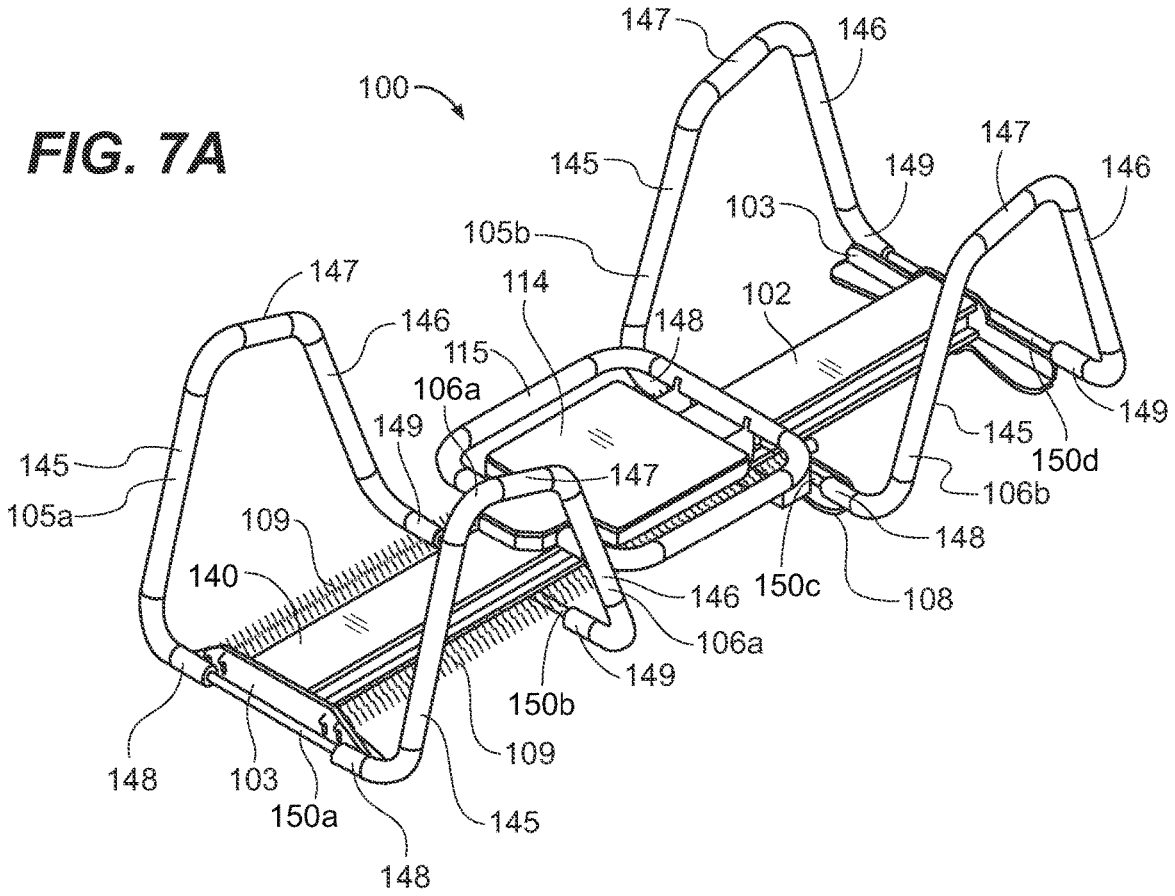
FIG. 7A is a perspective view of a compact exercise machine including two pairs of handles in accordance with an example embodiment.
Figure 7B:
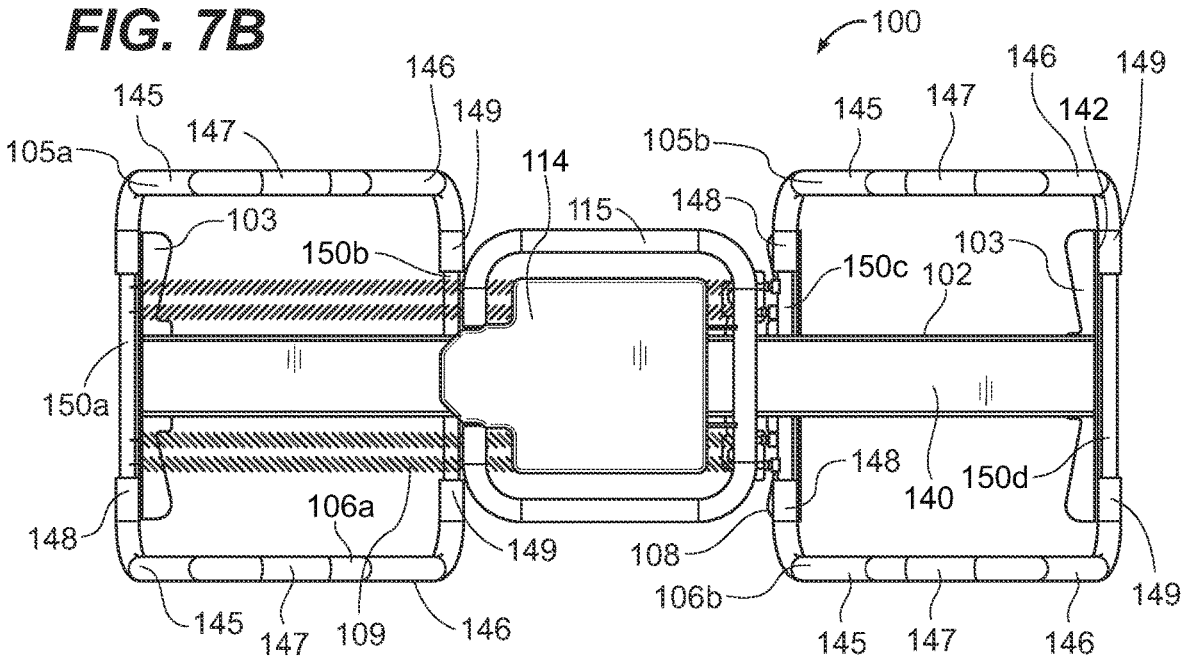
FIG. 7B is a top view of a compact exercise machine including two pairs of handles in accordance with an example embodiment.

FIGS. 7A and 7B illustrate an embodiment including two pairs of handles 105*a*, 105*b*, 106*a*, 106*b* have been connected to the base 140. In the exemplary figures, the handles 105*a*, 106*a* on the front end 141 of the exercise machine 100 are illustrated as comprising the same configuration as the handles 105*b*, 106*b* on the rear end 142 of the exercise machine 100. It should be appreciated that different varieties of handle 105, 106 configurations may be utilized in different embodiments.

Figure 8:
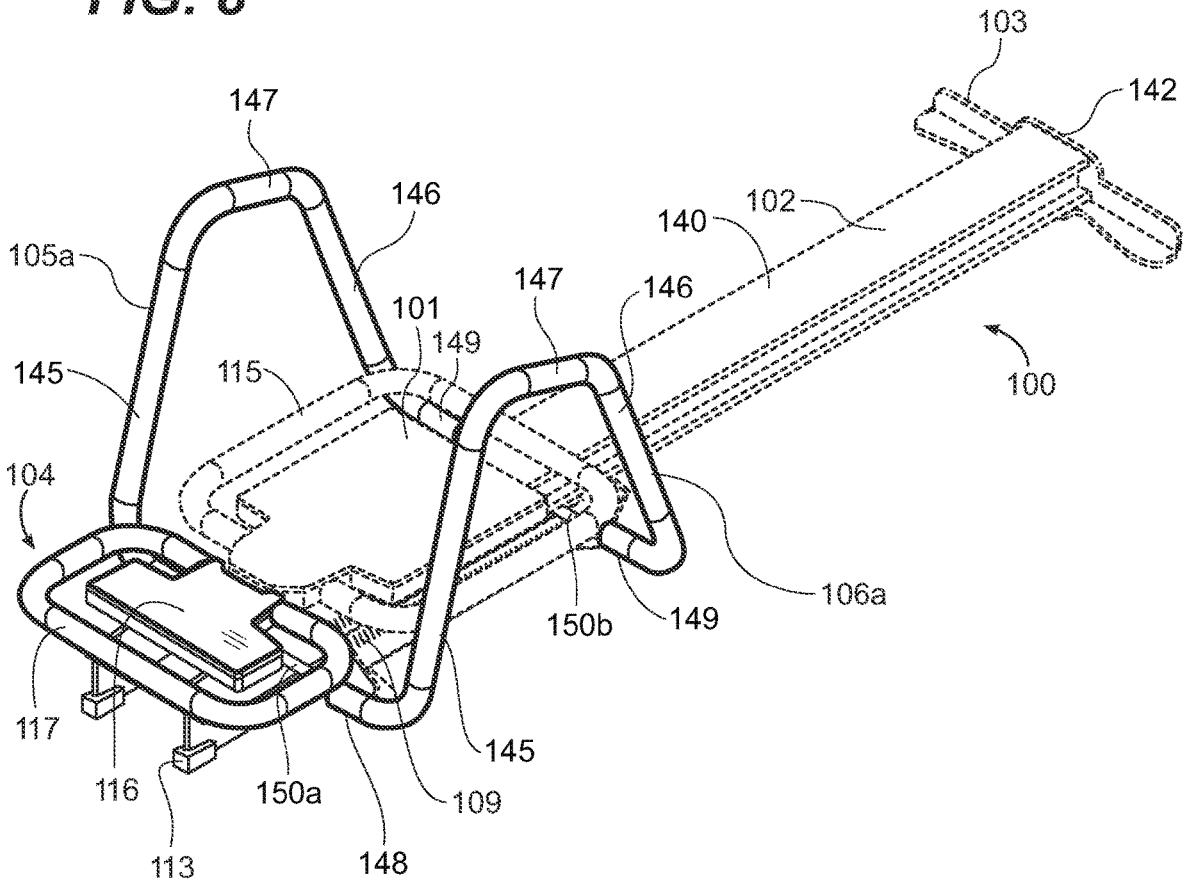
FIG. 8 is a perspective view of a compact exercise machine including a pair of handles and an end platform in accordance with an example embodiment.
Figure 9:
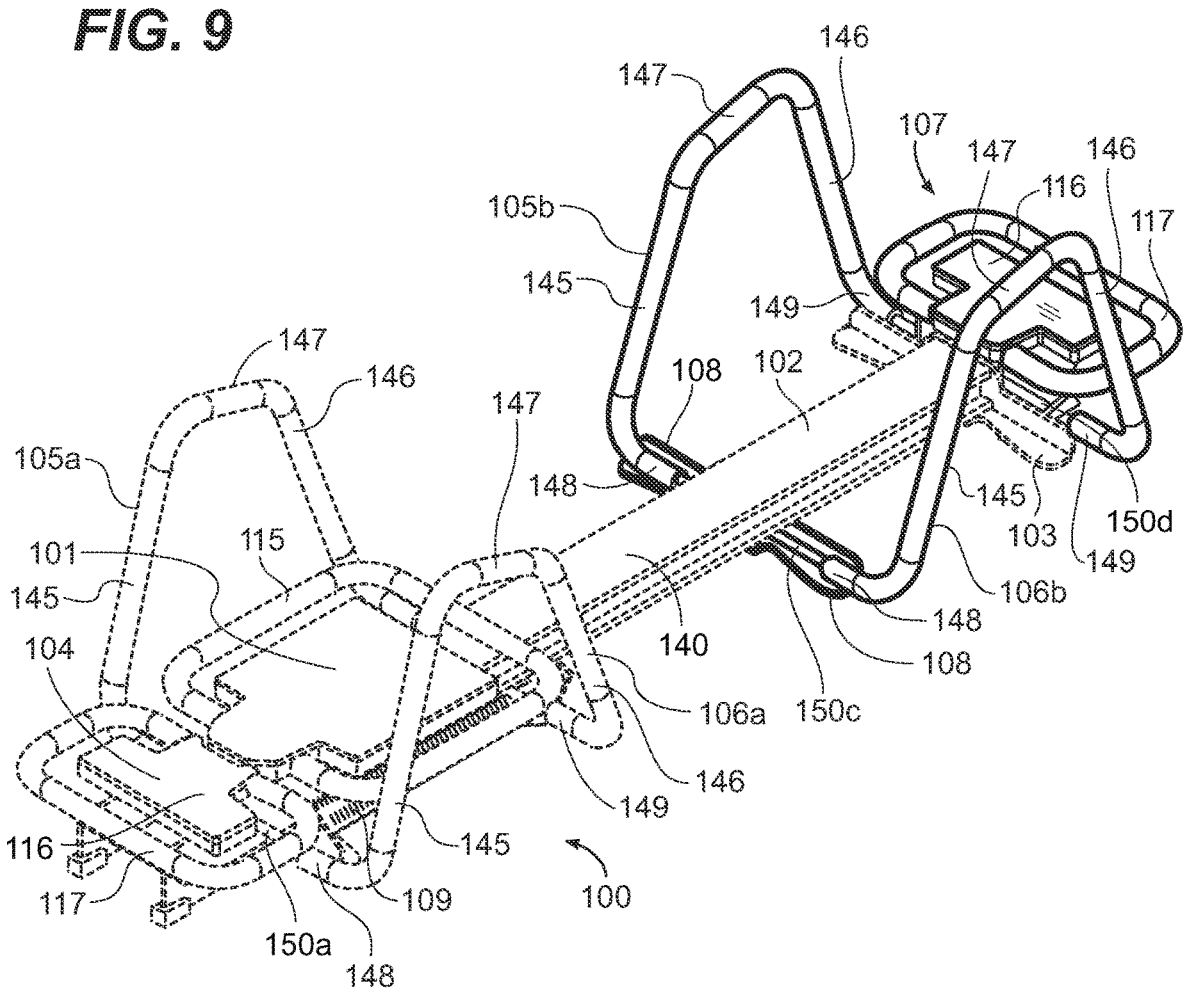
FIG. 9 is a perspective view of a compact exercise machine including two pairs of handles and a pair of end platforms in accordance with an example embodiment.

In the embodiment shown in FIG. 9, it can be seen that the exercise machine 100 includes a pair of handles 105*a*, 106*a* connected near the front end 141 of the exercise machine 100, a pair of handles 105*b*, 106*b* connected near the rear end 142 of the exercise machine 100, a front end stationary platform assembly 104 connected near the front end 141 of the exercise machine 100, and a back end stationary platform assembly 107 connected near the rear end 142 of the exercise machine 100. It should be appreciated that any combination of the accessories 104, 105, 106, 107 shown in FIGS. 1-21 may be utilized, and thus the scope of the methods and systems described herein should not be construed as limited to the illustrated configurations.

FIG. 8 illustrates a front end stationary platform assembly 104 and a pair of handles 105*a*, 106*a* being connected near the front end 142 of the exercise machine 100. FIG. 9 illustrates a rear end stationary platform assembly 104 and a pair of handles 105*b*, 106*b* connected near the rear end 142 of the exercise machine 100. The first front handle 105*a* and the first rear handle 106*a* may be positioned on a first side of the exercise machine 100, with the second front handle 105*b* and the second rear handle 106*b* being positioned on a second, opposite side of the exercise machine 100.

In this manner, four handles 105*a*, 105*b*, 106*a*, 106*b* may be provided for the exerciser to grasp during performance of various different exercises. It should be appreciated that more or less handles may be utilized. For example, on an exercise machine 100 with a longer monorail 102, a third pair of handles 105, 106 could be provided in between the first pair 105*a*, 106*a* and the second pair 105*b*, 106*b*.

It should be appreciated that additional configurations could be supported by the exercise machine 100. For example, the exercise machine 100 may include only right side handles 106*a*, 106*b*, with the left side handles 105*a*, 105*b* being omitted. This configuration could allow more free movement by the exerciser on one side of the exercise machine 100 while retaining gripping surfaces on the opposing side of the exercise machine 100. In some exemplary embodiments, a single handle 105*a*, 105*b*, 106*a*, 106*b* could be connected to either side or either end 141, 142 of the exercise machine 100. It should be appreciated that any combination of handles 105*a*, 105*b*, 106*a*, 106*b* and stationary platform assemblies 104, 107 may be supported by the exercise machine 100.

The manner in which the stationary platform assemblies 104, 107 are connected to the exercise machine 100 may vary in different embodiments. The stationary platform assemblies 104, 107 may in some embodiments be fixedly connected to the exercise machine 100, such as by welding or the like. In other embodiments, the stationary platform assemblies 104, 107 may be removably connected to the exercise machine 100, such as by the use of fasteners, ties, clamps, magnets, frictional engagement, or the like. In some embodiments, the stationary platform assemblies 104, 107 may be connected by mating engagement with the respective ends 141, 142 of the exercise machine 100.

The manner in which the handles 105, 106 are connected to the exercise machines 100 may similarly vary in different embodiments. The handles 105, 106 may be fixedly connected to the exercise machine 100, such as by welding or the like. In other embodiments, the handles 105, 106 may be removably connected to the exercise machine 100, such as by the use of fasteners, ties, clamps, magnets, frictional engagement, or the like.

The shape, size, and configuration of the handles 105, 106 may also vary in different embodiments. In the exemplary embodiment shown in FIGS. 1-9, each of the handles 105, 106 is illustrated as comprising a first arm 145, a second arm 146, and a cross member 147 connected between the first and second arms 145, 146. The angle at which the arms 145, 146 extend from the cross member 147 may vary in different embodiments and should not be construed as limited by the exemplary figures. In the exemplary embodiments shown in the figures, the arms 145, 146 are shown as being angled away from each other. In other exemplary embodiments, the arms 145, 146 may be parallel to each other or angled toward each other. In other embodiments, the cross member 147 may be omitted, with the first and second arms 145, 146 converging such as in a V-shape.

With the shape of handles 105, 106 shown in the exemplary figures, a number of gripping surfaces may be provided for an exerciser. For example, when kneeling on the carriage 101, the exerciser could grasp either or both of the arms 145, 146 of one or more handles 105, 106. As a further example, the exerciser could grasp either or both cross members 147 of one or more handles 105, 106, such as when standing upon the carriage 101. As yet another example, the exerciser could grasp a single handle 105, 106 in two places, such as by grasping both arms 145, 146 or by grasping a single arm 145, 146 and a cross member 147 of the same handle 105, 106.

The shape and configuration of the exemplary handles 105, 106 shown in the figures is particularly suitable for providing a wide range of grasping surfaces for an exerciser on an exercise machine 100 which utilizes a movable carriage 101. The arms 145, 146 of each handle 105, 106 extend angularly, with the first arm 145 extending angularly towards the first end 141 of the exercise machine 100 and the second arm extending angularly towards the second end 142 of the exercise machine 100. By utilizing such a configuration, an exerciser may more easily follow the handle 105, 106 by grasping at different points along the arms 145, 146 while moving the carriage 101.

In the exemplary embodiment shown in the figures, the cross members 147 is shown extending substantially horizontally between the respective ends of the arms 145, 146 of each handle 105, 106. In this manner, the exerciser may grasp onto the cross members 147 for any number of reasons, such as for support when lifting or lowering their body with respect to the exercise machine 100. The cross members 147 may also be grasped when performing exercises in which the exerciser is standing upon the carriage 101.

Figure 11:
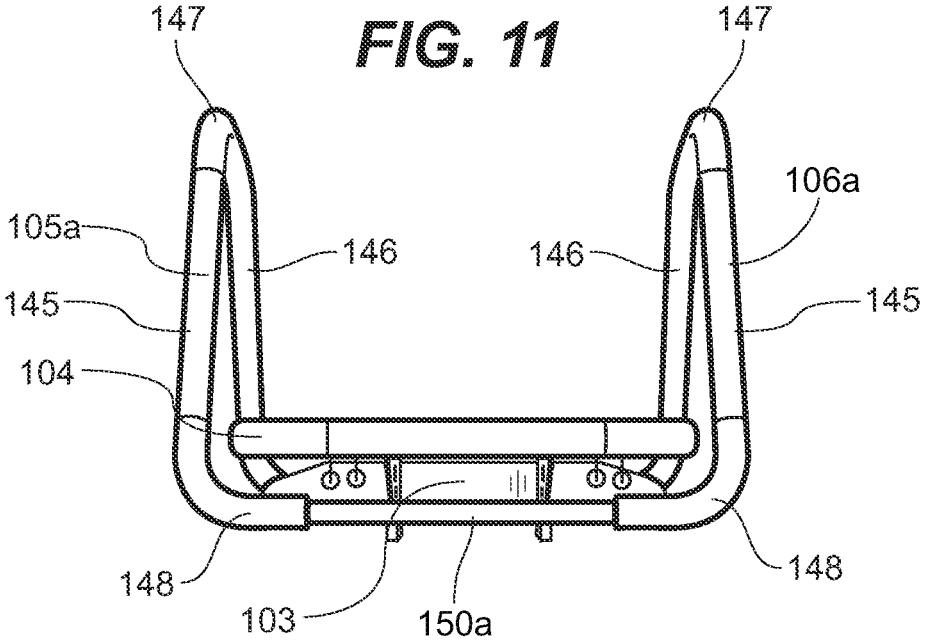
FIG. 11 is a frontal view of a compact exercise machine in accordance with an example embodiment.
Figure 12:
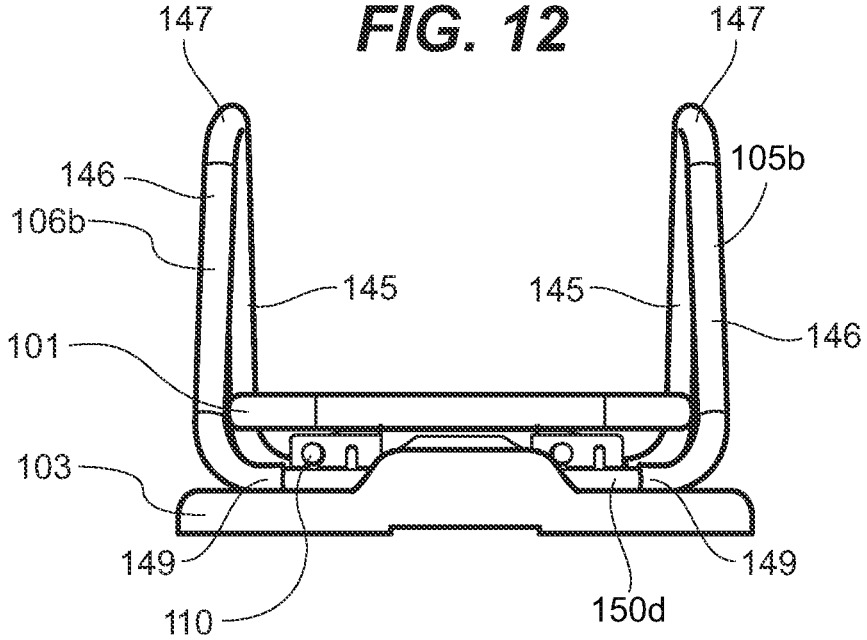
FIG. 12 is a rear view of a compact exercise machine in accordance with an example embodiment.

As best shown in FIGS. 11 and 12, the handles 105, 106 may be connected to the exercise machine 100 so as to minimize the effective width of the exercise machine 100. In this manner, the space which the exercise machine 100 takes up in an exercise studio or home gym may be reduced so as to save space. In the exemplary embodiment shown in the figures, the handles 105, 106 are shown extending upwardly from a point that is near the respective sides of the exercise machine 100.

In the exemplary embodiments shown, the arms 145, 146 of the handles 105, 106 extend upwardly at points which are just greater than the width of the carriage 101 so as to allow the carriage 101 to freely pass therethrough. By utilizing handles 105, 106 which extend upwardly at a minimized width, such as the minimum width which allows the carriage 101 (and the exerciser when standing or kneeling upon the carriage 101) to pass therethrough, the effective width of the overall exercise machine 100 (including the handles 105, 106) may be minimized.

Figure 13:
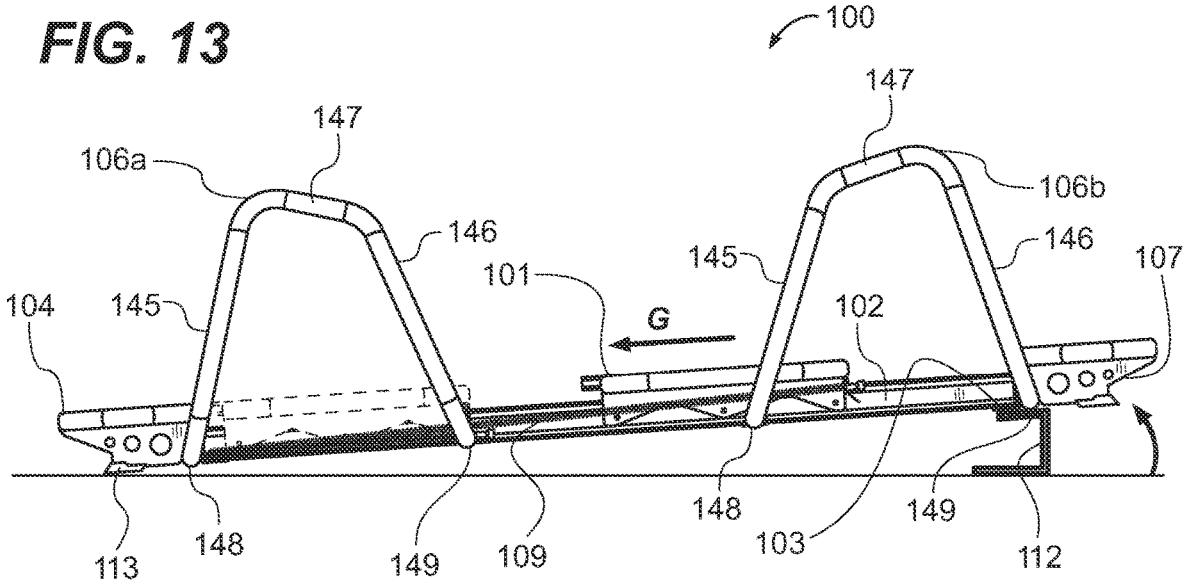
FIG. 13 is a side view of an elevated compact exercise machine in accordance with an example embodiment.
Figure 14:
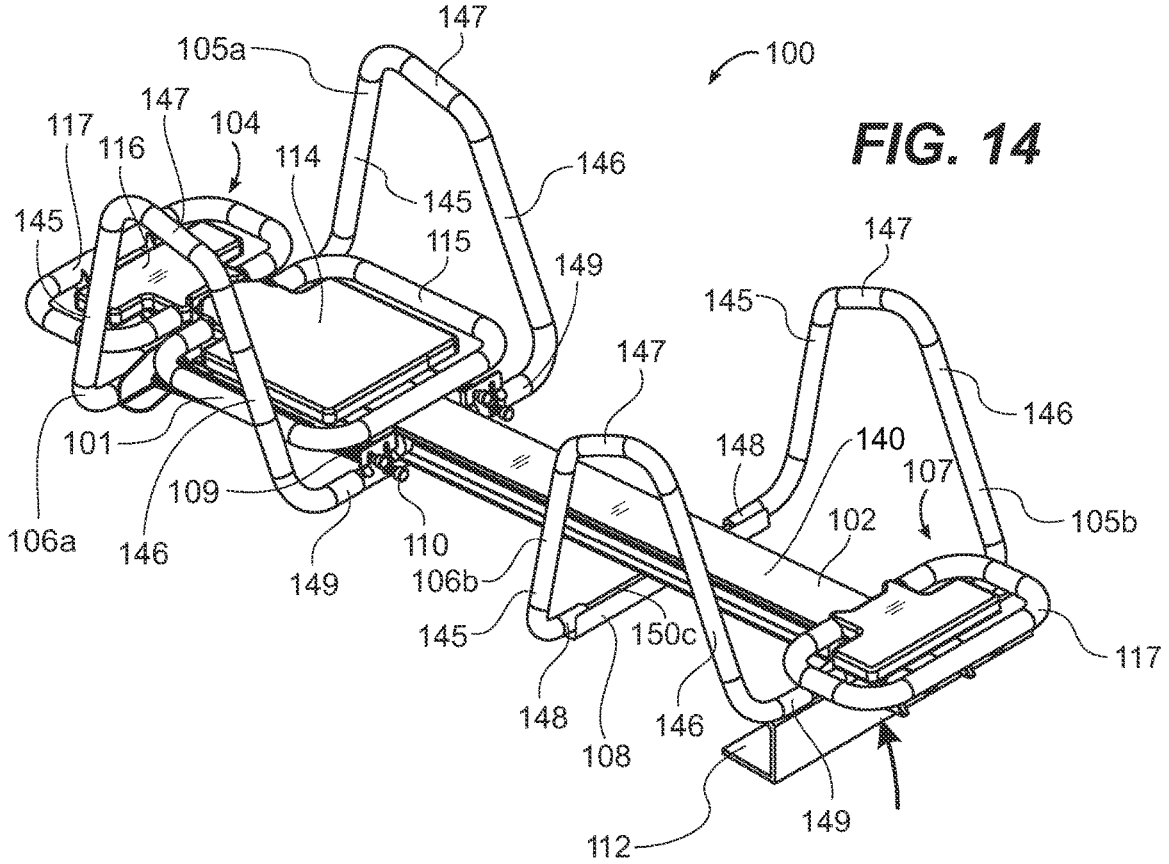
FIG. 14 is a perspective view of an elevated compact exercise machine in accordance with an example embodiment.
Figure 15:
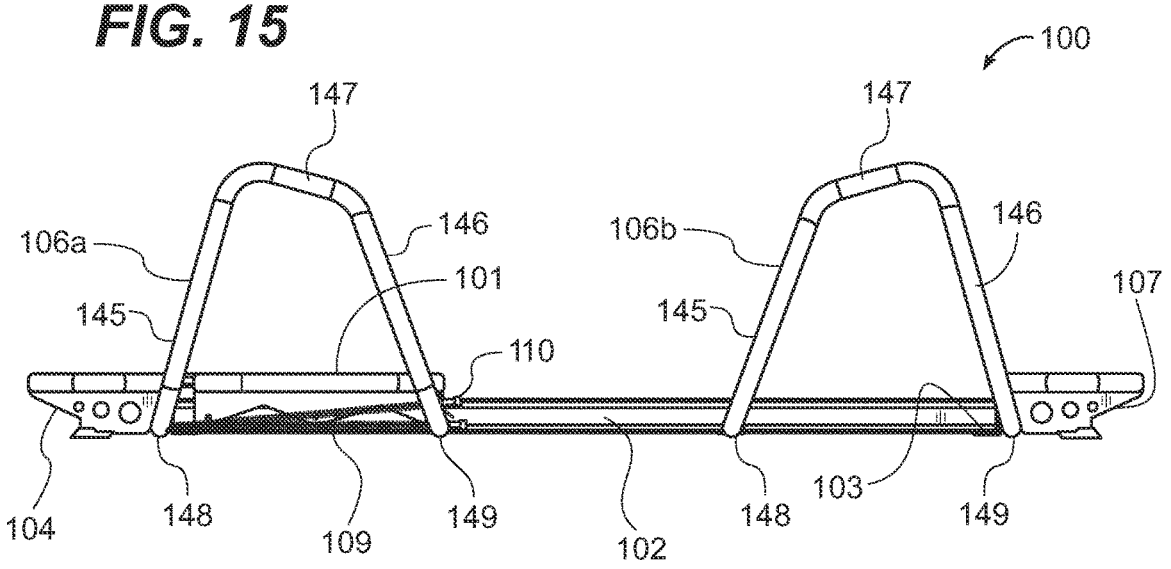
FIG. 15 is a first side view of a compact exercise machine in accordance with an example embodiment.
Figure 16:
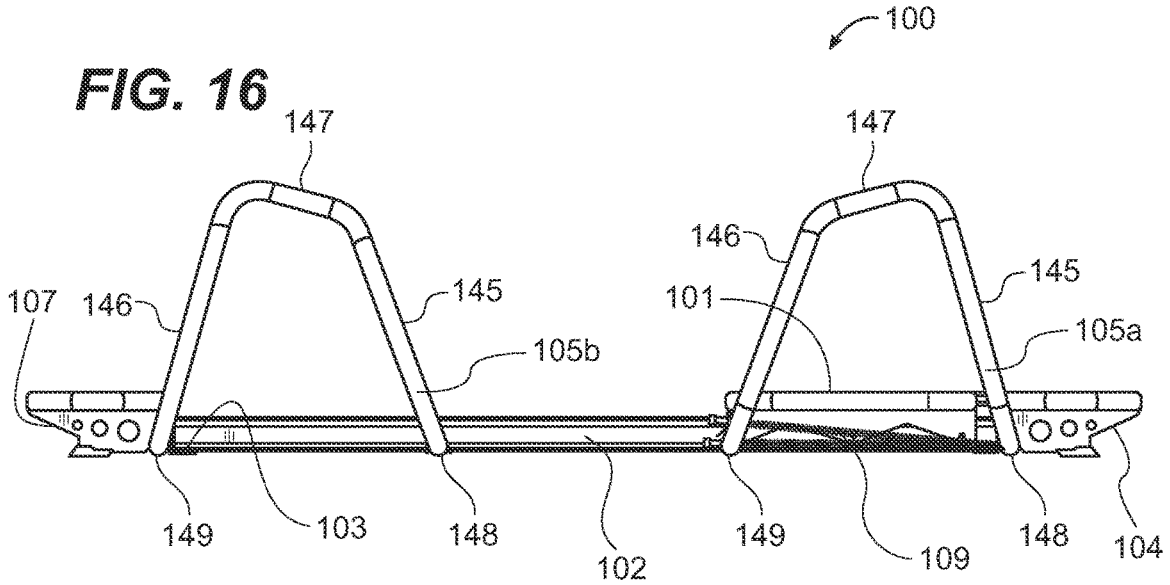
FIG. 16 is a second side view of a compact exercise machine in accordance with an example embodiment.

Each of the arms 145, 146 is connected at its first end to the cross member 147 as best shown in FIGS. 13 and 14. In some embodiments, the first arm 145, second arm 146, and cross member 147 may be integrally formed. In other embodiments, one or more of the first arm 145, second arm 146, and cross member 147 may comprise discrete portions which are connected together. The second ends of the arms 145, 146 are removably or fixedly connected to the exercise machine 100 as discussed herein.

The exemplary embodiment shown in FIGS. 1-21 illustrates that each of the handles 105, 106 comprises a pair of connectors 148, 149 adapted to engage with corresponding couplers 152 so that the handles 105, 106 may be positioned on either side of the exercise machine 100. In the exemplary embodiment shown, the second end of the first arm 145 of each handle 105, 106 includes a first connector 148 and the second end of the second arm 146 of each handle 105, 106 includes a second connector 149.

Figure 17:
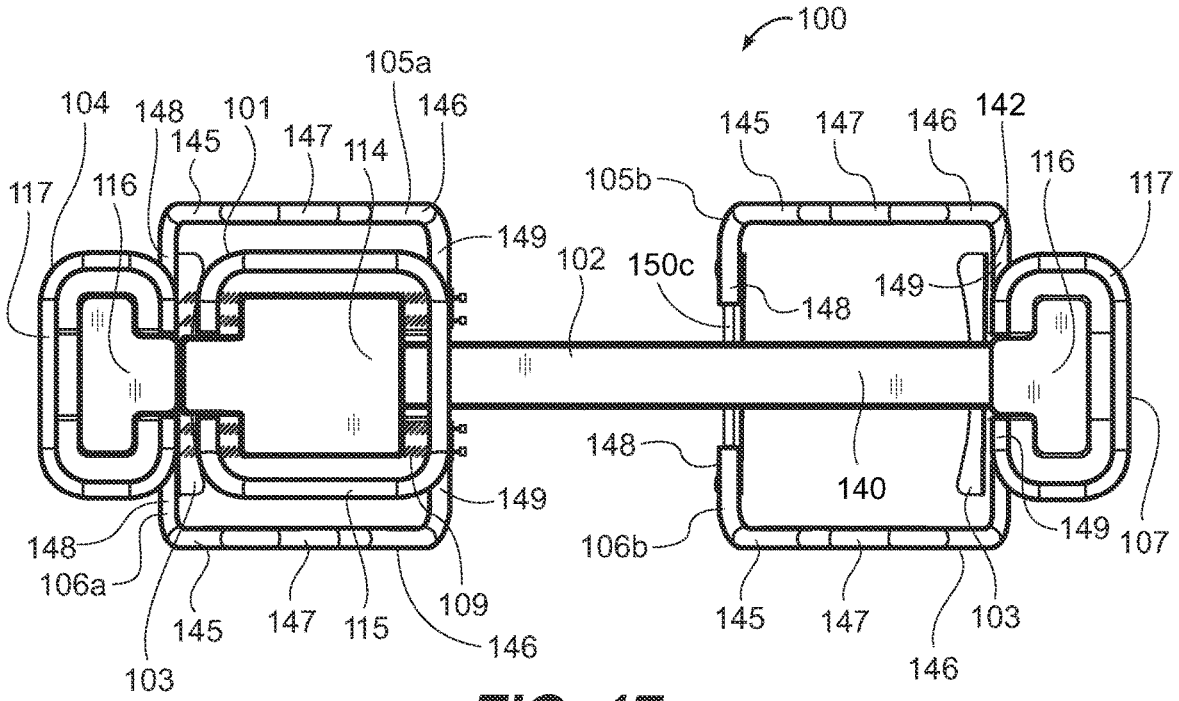
FIG. 17 is a top view of a compact exercise machine in accordance with an example embodiment.
Figure 18:
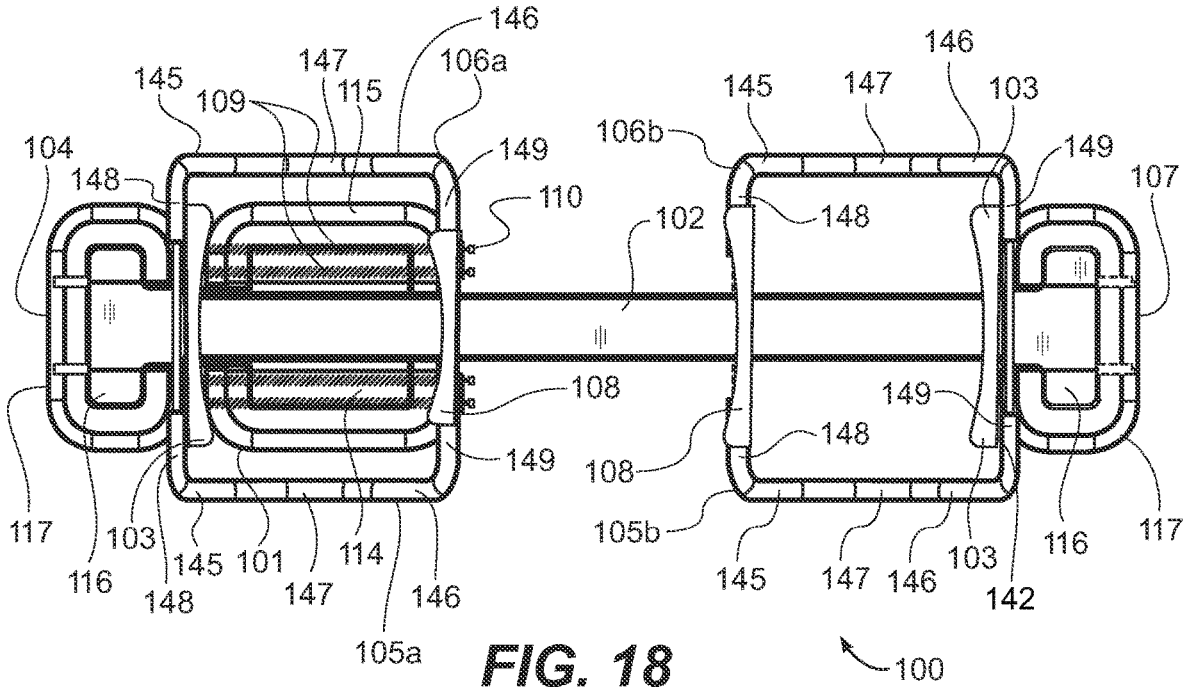
FIG. 18 is a bottom view of a compact exercise machine in accordance with an example embodiment.

As shown in FIGS. 17 and 18, the first connector 148 may comprise a tubular portion which extends from the distal second end of the first arm 145 so as to receive a coupler 150 which is connected to or positioned underneath the base 140 of the exercise machine 100. Similarly, the second connector 149 may comprise a tubular portion which extends from the distal second end of the second arm 146 so as to receive the coupler 150 which is connected to or positioned underneath the base 140 of the exercise machine 100.

The connectors 148, 149 may extend at various angles with respect to the distal ends of the respective arms 145, 146, including at substantially a right angle as shown in the figures. Further, the direction in which the connectors 148, 149 extend may vary in different embodiments, with the exemplary embodiments shown in the figures illustrating connectors 148, 149 which extend towards the exercise machine 100 so as to engage with corresponding couplers 150.

Various types of connectors 148, 149 and couplers 150 may be utilized, and thus the scope should not be construed as limited by the exemplary embodiments shown in the figures and discussed herein. For example, the figures illustrate a mating engagement between the connectors 148, 149 of the handles 105, 106 and the couplers 150 of the exercise machine 100, with the connectors 148, 149 comprising a female connector and the couplers 150 comprising a male connector. Although not shown, the reverse configuration could be utilized, with the connectors 148, 149 on the handles 105, 106 being male and the couplers 150 on or underneath the exercise machine 100 being female.

In the exemplary embodiment of the figures, each of the couplers 150 are illustrated as comprising an elongated member such as a rod, bar, or the like, which extends perpendicularly with respect to the monorail 102 of the exercise machine 100. In the exemplary embodiments shown in FIGS. 6A, 6B, and 18, four couplers 150*a*, 150*b*,

150*c*, 150*d* are shown being utilized: a first coupler 150*a* for connecting to the first arms 145 of the front end handles 105*a*, 106*a*, a second coupler 150*b* for connecting to the second arms 146 of the front end handles 105*a*, 106*a*, a third coupler 150*c* for connecting the first arms 145 of the rear end handles 105*b*, 106*b*, and a fourth coupler 150*d* for connecting the second arms 146 of the rear end handles 105*b*, 106*b*. However, it should be appreciated that the arrangement, orientation, and number of couplers 150 may vary in different embodiments.

The couplers 150 may be fixedly or removably connected to the exercise machine 100. The first coupler 150*a* is shown as being connected to the front end 141 of the exercise machine 100, the fourth coupler 150*d* is shown as being connected to the rear end 142 of the exercise machine 100 and the second and third couplers 150*b*, 150*c* are shown as being connected between the first and fourth couplers 150*a*, 150*d*. The second and third couplers 150*b*, 150*c* may be connected to intermediate support members 108, with the intermediate support members 108 being connected to or positioned underneath the exercise machine 100. The first and fourth couplers 150*a*, 150*d* may be connected to the front and rear ends 141, 142 of the exercise machine 100 respectively. In the exemplary embodiment shown in FIG. 12, the fourth coupler 150*d* is shown as being connected to the floor support member 103 at the rear end of the exercise machine 100.

FIG. 1 is an exemplary diagram showing an isometric view of an embodiment of an exercise machine 100 comprising a center structural monorail 102 extending longitudinally substantially the length of the machine 100, the monorail 102 supported at least at the opposed ends by a floor support member 103, a slidable carriage assembly 101 movably affixed to the monorail by a plurality of wheels 128 which will be described in the specification below, the carriage 101 slidable substantially the length of the monorail 102, and at least one biasing member 109 with a first end affixed to the stationary floor support member 103 at the front of the machine 100, and the second end removably attachable to the slidable carriage 101.

When at least one biasing member 109 is attached between the slidable carriage 101 and the proximate floor support member 103, a linear resistance force substantially aligned with the longitudinal axis of the monorail 102 is exerted on the slidable carriage 101 as the carriage 101 is slid along the length of the monorail 102. The linear force exerted against the slidable carriage 101 by an exerciser must exceed the resistance force exerted against the carriage 101 by the biasing member 109 as a means of moving the carriage 101 towards the opposed distal end of the monorail 102.

For discussion purposes herein, when a front of the machine 100 is referenced, the front refers to that one end of the machine 100 shown in the drawing as the proximate end where the slidable carriage 101 rests in a default position along substantially at one distal end of the monorail structure 102 when at least one biasing member 109 is removably attached between a floor support member 103 and the slidable carriage 101.

FIGS. 2A and 2B show isometric and top views of an exemplary embodiment of an exercise machine 100 substantially as just described in FIG. 1. Various accessories 104, 105, 106, 107 may be added to the machine 100 to provide for expanded functionality, thereby providing for a substantially increased number and types of exercises that may be performed on the machine 100.

Those skilled in the art will appreciate that commercial value of an exercise machine 100 comprising a slidable carriage 101 and biasing members 109 which induce a variable resistance against the slidable carriage 101 during the reciprocating movement of the carriage 101 relative to the front and back end of the machine 100 appreciates significantly when a line of optional accessory components can be acquired by the exerciser who desires to customize the functionality of their individual exercise machine 100 to support their desired types of exercises that they will perform on the machine 100.

The following series of illustrations direct attention specifically to exemplary embodiments of primary optional accessories, with a more detailed description being provided herein below. While the figures and descriptions herein illustrate numerous example embodiments of accessories to be connected to the exercise machine 100, it should be appreciated that the exemplary embodiments listed are non-exhaustive, and that the exercise machine 100 may be adapted to receive various accessories not described herein.

Certain optional accessories are shown as cumulative beginning by adding a first accessory, then a second accessory, and then a third and fourth accessory in sequence. It should be noted that any one or more of any of the following accessories may be affixed to or removed from the machine 100 without the requirement to affix or remove any other described accessory.

In the exemplary embodiments shown in the figures, accessories are illustrated as comprising a front end stationary platform assembly 104 which may be fixedly or removably attached to the front end 141 of the exercise machine 100 and a rear end stationary platform assembly 107 which may be fixedly or removably attached to the rear end 142 of the exercise machine 100. Additional accessories shown in the exemplary figures include a pair of front handles 105*a*, 106*b* which may be fixedly or removably attached near the front end 141 of the exercise machine 100 and a pair of rear handles 105*b*, 106*b* which may be fixedly or removably attached near the rear end 142 of the exercise machine 100.

Figure 3A:
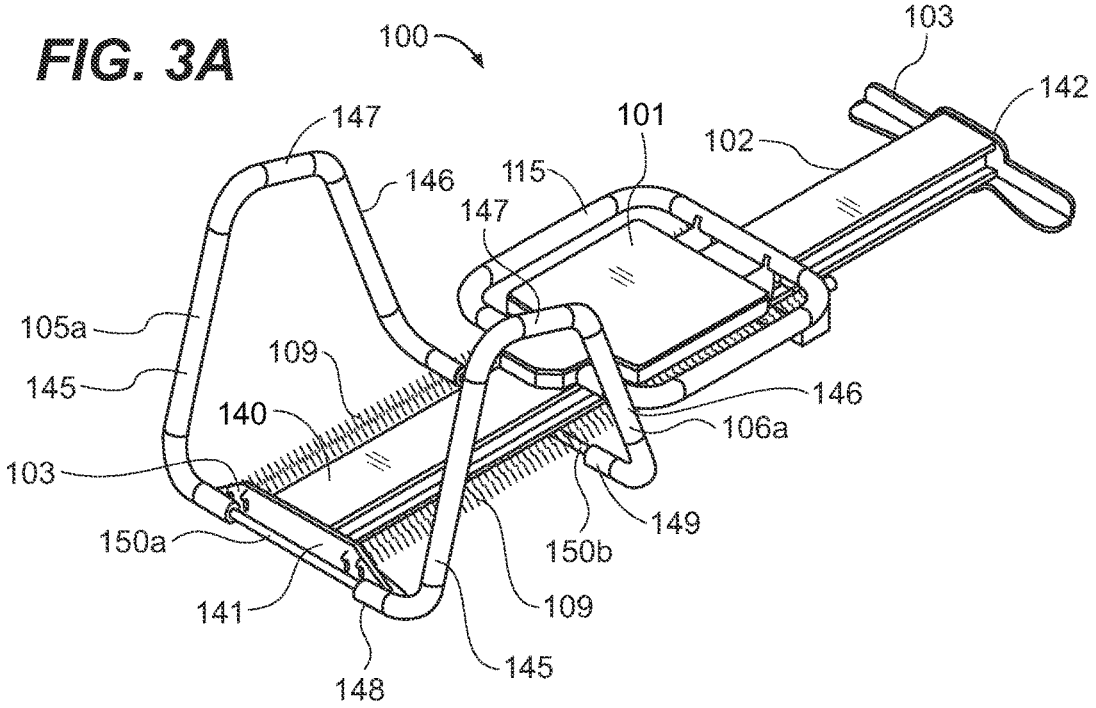
FIG. 3A is a perspective view of a compact exercise machine including a base and a pair of handles in accordance with an example embodiment.
Figure 3B:
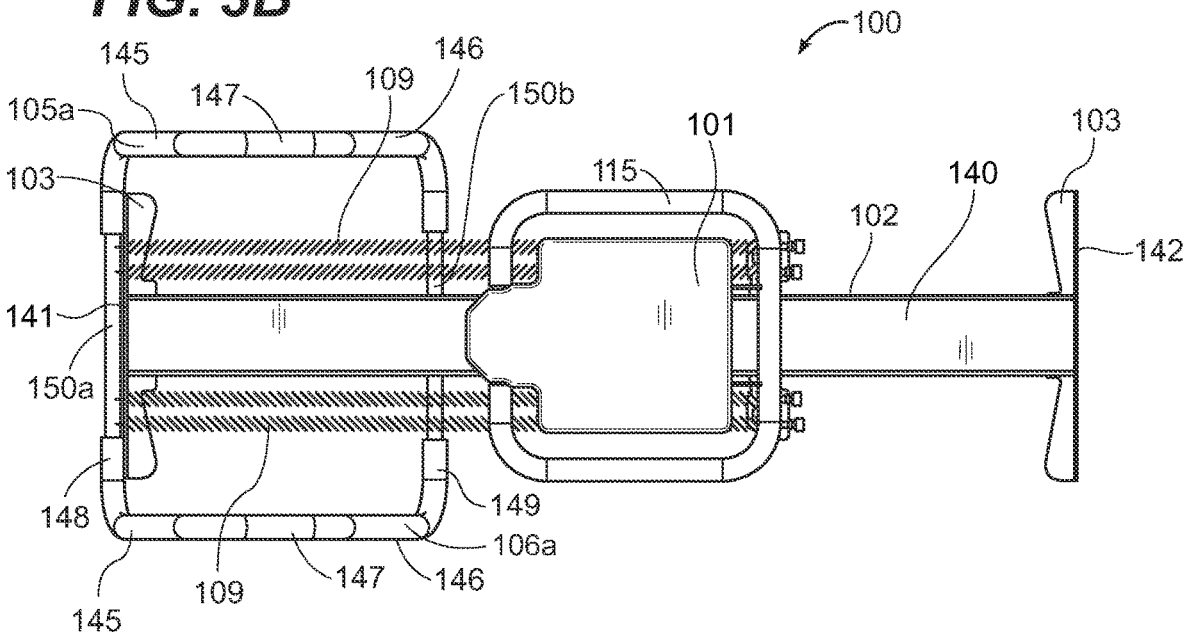
FIG. 3B is a top view of a compact exercise machine including a base and a pair of handles in accordance with an example embodiment.

FIGS. 3A and 3B show isometric and top views of an embodiment of an exercise machine 100 substantially as just described in FIGS. 1, 2A, and 2B with handles 105*a*, 106*a* affixed to the front end 141 of the machine 100, specifically a reversible right handle 105*a* and a reversible left handle 106*a*, the handles 105*a*, 106*a* being substantially mirror images of one another, the distance between the opposed edges of the handles 105*a*, 106*a* defining the width of the machine 100.

The handles 105*a*, 106*a* may be affixed, or removably attached to the front end 141 of the machine 100. As shown in the drawing, the opposed handles 105*a*, 106*a* are positioned on the machine 100 such that the distance between the facing edges of the opposed handles 105*a*, 106*a* is greater than the dimension of laterally projecting carriage handle 115 of the slidable carriage 101 as measured transverse to the longitudinal axis of the machine 100. An exerciser positioned on the slidable carriage 101 may grasp the handles 105*a*, 106*a* while exerting a linear force against the carriage 101 greater than the force of the biasing member 109 thereby moving the carriage 101 in a direction towards the opposed back end of the machine 100.

Figure 4A:
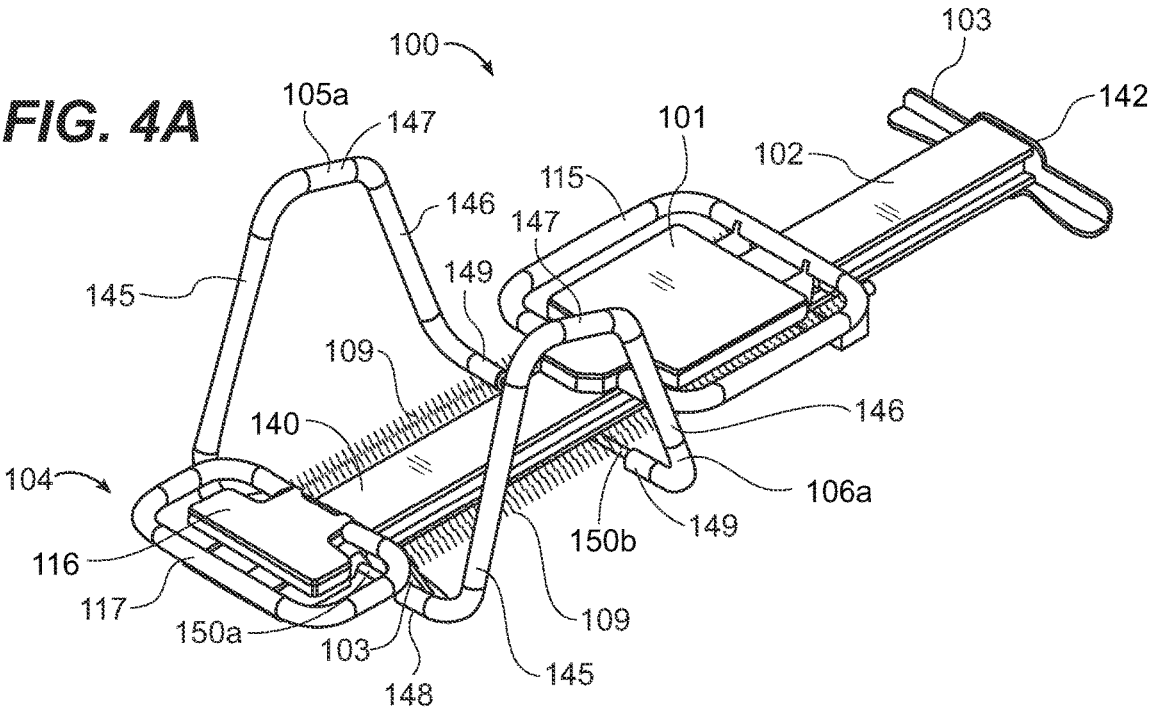
FIG. 4A is a perspective view of a compact exercise machine including a base, a pair of handles, and an end platform in accordance with an example embodiment.
Figure 4B:
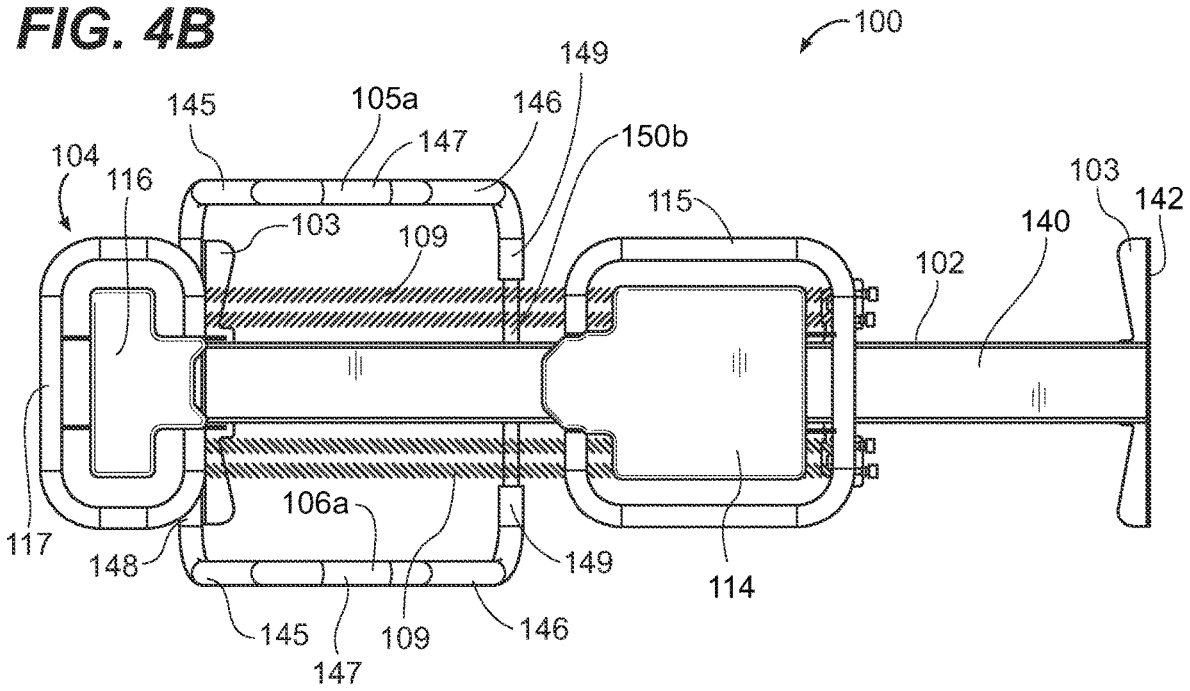
FIG. 4B is a top view of a compact exercise machine including a base, a pair of handles, and an end platform in accordance with an example embodiment.

FIGS. 4A and 4B show isometric and top views of an embodiment of an exercise machine with handles 105, 106 substantially as previously described and a front end stationary platform assembly 104 affixed proximate to the front end floor support member 103. The front end stationary platform 104 may provide for additional support for performance of exercises during which an exerciser is partially supported by the slidable carriage 101, and partially supported by the stationary front platform assembly 104.

FIGS. 5A and 5B show isometric and top views of an exemplary embodiment of an exercise machine 100 with handles 105, 106 and front end stationary platform assembly substantially as previously described and a back end stationary platform assembly 107 affixed proximate to the back end floor support member 103. The back end stationary platform 107 provides for additional support for performance of exercises during which an exerciser is partly supported by the slidable carriage 101, and partly supported by the back end stationary front platform assembly 107.

FIGS. 6A and 6B show isometric and top views of an embodiment of an exercise machine 100 with front handles 105*a*, 106*a*, front end and back end stationary platform assemblies 104, 107 substantially as previously described and a back end reversible right handle 105*b* and reversible left handle 106*b* affixed proximate to the back end floor support member 103, and further affixed to an intermediate support member 108. The back end handles 105*b*, 106*b* provide for additional support for performance of exercises.

FIGS. 7A and 7B show isometric and top views of an embodiment of an exercise machine 100 with front handles 105*a*, 106*a* and rear handles 105*b*, 106*b*. Front end reversible right and left handles 105*a*, 106*a* are shown connected near the front end 141 of the exercise machine 100 by couplers 150*a*, 105*b* as described herein. Back end reversible right and left handles 105*b*, 106*b* are shown connected near the rear end 142 of the exercise machine 100 by couplers 105*c*, 105*d* as described herein. In this exemplary embodiment, the front and back end stationary platforms 104, 107 have been omitted. In another exemplary embodiment, the front and back end stationary platforms 104, 107 may be utilized with the handles 105*a*, 105*b*, 106*a*, 106*b* being omitted instead.

It should be noted that the drawing shows that the reversible handles 105, 106 as being substantially mirror images of each other. Further, either handle 105, 106 may be affixed to or detached from the front end or back end of the machine 100 with the left and right reversible handles 105*b*, 106*b* proximate to the back end 142 of the machine 100 as just described positioned respectively on the exerciser's left or right side when the exerciser is facing the back end of the machine 100, and the left and right reversible handles 105*a*, 106*a* proximate to the front end 141 of the machine 100 being positioned respectively on the exerciser's left or right side when the exerciser is facing the front end 141 of the machine 100.

The figures which illustrate handles 105, 106 being substantially mirror images of one another, and the pair of handles 105*a*, 106*a* affixed to the front end 141 of the machine 100 being substantially mirror images of the handles 105*b*, 106*b* affixed to the back end 142 of the machine 100 is not meant to be limiting, and individual front left and right handles 105*a*, 106*a*, and individual back end right and left handles 105*b*, 106*b* may be unique in both functional geometry and positioning with respect to each other with the same effect as substantially mirror image geometry and handle 105, 106 positioning.

FIG. 8 is an exemplary diagram showing an isometric view of an embodiment of an exercise machine 100 with front end handles 105*a*, 106*a* and one end platform 104. More specifically, the exercise machine 100 as previously described in FIG. 1 is shown in outline form by dotted lines so as to direct emphasis to the positioning of the below described accessories relative to the exercise machine 100, to minimize duplication of lengthy descriptions, and so as to not distract away from the described accessories shown with solid lines, the machine elements described in FIG. 1 are not repeated but nevertheless are considered integral to the machine 100 accessories.

A front end stationary platform assembly 104 is shown affixed to the front end 141 of the exercise machine 100 to provide exercisers with a stationary surface for standing or otherwise positioning upon, the assembly 104 comprising a stationary platform 116 with an upper surface substantially coplanar with the upper exercise surface of the slidable carriage 101, and a stationary platform handle 117 providing a hand gripping member with the upper surface substantially co-planar with the upper surface of the stationary platform 101, the inner surface of the handle 117 sufficiently spaced apart from the outer edges of the stationary platform 116 to allow for the insertion of the exerciser's hand or food, the handle 117 substantially encircling the stationary platform 116. One or more platform supporting members 131 of the stationary platform 116 are supported by front end support feet 113.

The front end stationary platform assembly 104 may be affixed to the exercise machine 100 during the manufacturing and assembly process, or may be removably attached to the exercise machine by an exerciser by various methods, including but not limited to those shown in the exemplary figures and described herein.

A reversible left handle 105 and right handle 106 are shown affixed on opposed sides of the machine 100, relatively positioned laterally adjacent to the left and right edges of the carriage handle 115 so as to allow the carriage 101 to reciprocate along the longitudinal axis of the monorail 102 without interference from the reversible handles 105, 106.

The drawing shows that the left and right handles 105, 106 are substantially mirror images of each other, however mirror image handles 105, 106 are not meant to be limiting, and handles 105, 106 of differing geometry may be used without deviating from the present embodiment. Further, the handles 105, 106 may be affixed to the exercise machine 100 during the manufacturing and assembly process, or may be removably attached to the exercise machine 100 by an exerciser in various manners.

FIG. 9 is an exemplary diagram showing an isometric view of an embodiment of an exercise machine 100 with a plurality of handles 105*a*, 106*a*, 105*b*, 106*b* and end platforms 104, 107. More specifically, the exercise machine 100, front reversible handles 105*a*, 106*a*, and front end stationary platform 104 as previously described are shown in outline form by dotted lines for efficiency, and so as to direct emphasis to the positioning of the below described accessories relative to the exercise machine.

A back end stationary platform assembly 107 is shown affixed to the rear end 141 of the exercise machine 100, the back end stationary platform assembly 107 comprising a stationary platform 116 with an upper surface substantially coplanar with the upper exercise surface of the slidable carriage 101, and a stationary platform handle 117 providing a hand gripping member with the upper surface substantially co-planar with the upper surface of the stationary platform 116, the inner surface of the handle 117 sufficiently spaced apart from the outer edges of the stationary platform 116 to allow for the insertion of the exerciser's hand or food, the handle 117 substantially encircling the stationary platform 116.

The figures show a back end stationary platform assembly 107 substantially comprising the same geometry and components as the front end stationary platform assembly 104, however a differing geometry and components may be used without deviating from the present embodiment. Further, the back end stationary platform assembly 107 may be affixed to the exercise machine 100 during the manufacturing and assembly process, or may be removably attached to the exercise machine by an exerciser by various methods.

The exercise machine may be further accessorized by providing a reversible left handle 105 and reversible right handle 106, the handles 105, 106 just described being affixed to an intermediate support member 108 and coupler 150, and to the back end floor support member 103. The reversible handles 105, 106 may be affixed to the exercise machine 100 during the manufacturing and assembly process, or may be removably attached to the exercise machine 100 by an exerciser by various methods.

As can be readily seen, the reversible left and right handles 105*b*, 106*b* shown on the back end of the machine 100 may be reversed and affixed or removably attached to the front end of the machine 100. However, the disclosure of substantially mirror image handles 105, 106 reversible to either end of the machine 100 is not limiting, and a plurality of handles 105, 106 comprising relatively different geometries may be used with the same effect without deviating from the present embodiment.

Figure 10A:
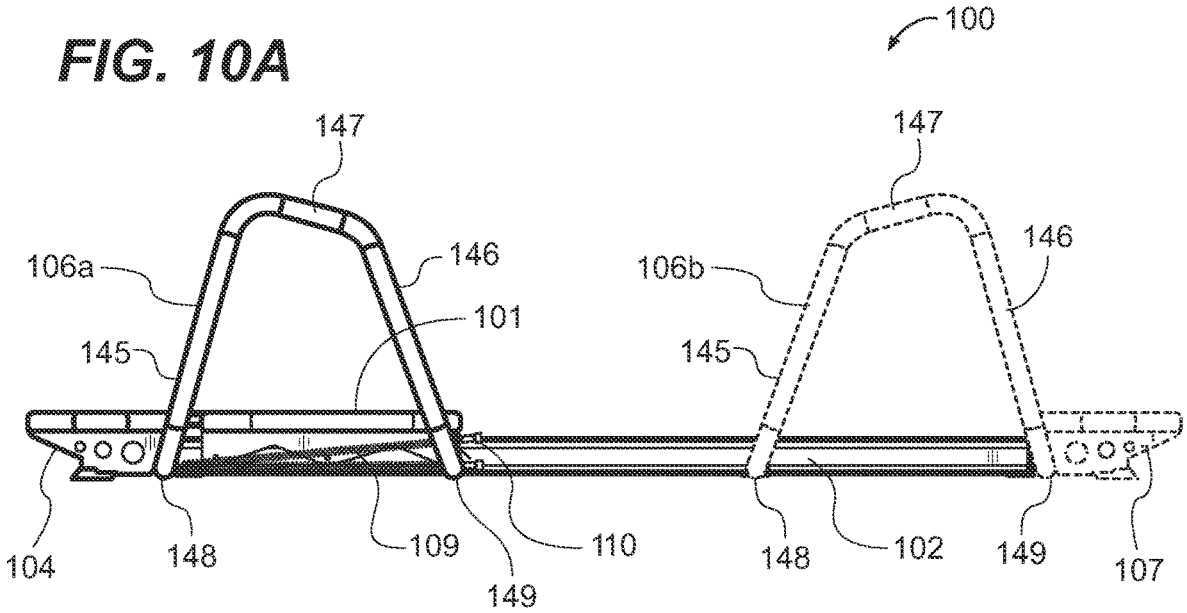
FIG. 10A is a side view of a compact exercise machine with a carriage in a resting position in accordance with an example embodiment.
Figure 10B:
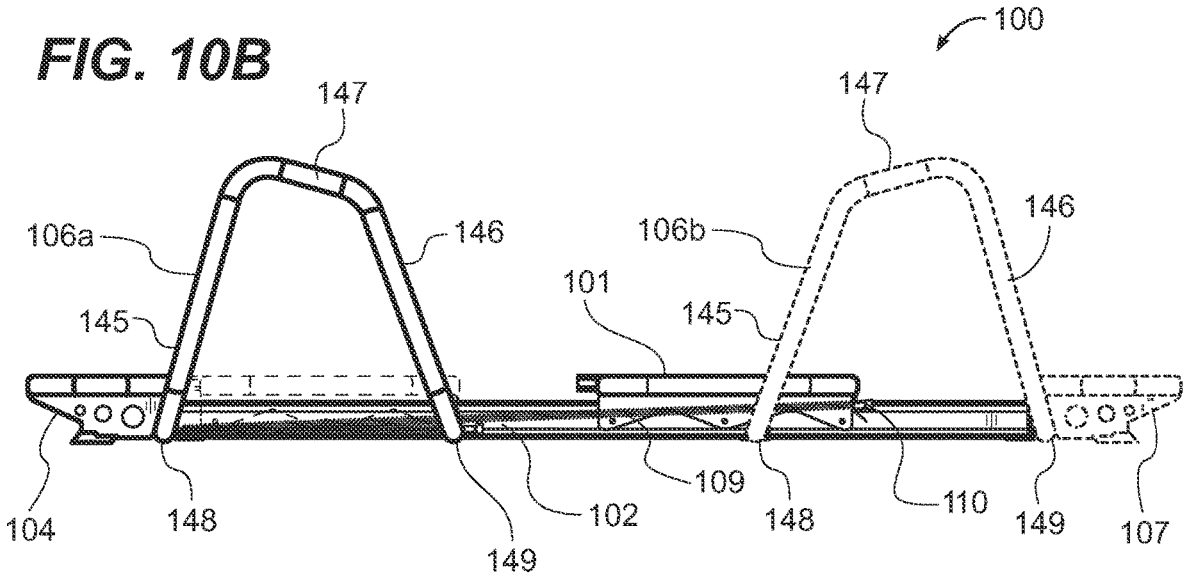
FIG. 10B is a side view of a compact exercise machine with a carriage in a moved position in accordance with an example embodiment.

FIGS. 10A and 10B are exemplary diagrams showing side views of an exemplary embodiment of an exercise machine 100 with a slidable carriage 101. In the figures, a back end stationary platform assembly 107 and back end right reversible handle 105*a*, 105*b* are substantially mirror images of the front end stationary platform assembly 104 and front end reversible handles 106*a*, 106*b* as previously described and are therefore shown in outline form by dotted lines without duplicating a detailed description for efficiency.

In the exemplary embodiment of FIG. 10A, a slidable carriage 101 is shown positioned upon the structural monorail 102 proximate to the front end stationary platform 104. At least one biasing member 109 with a first end affixed to a stationary member of the front end of the machine 100 has been removably attached to the back end of the slidable carriage 101 by relocating the engagement knob 110 upwardly from the lower disengaged position into an upper engaged position. Movement of the slidable carriage 101 from the position shown to a position along the structural monorail 102 towards the rear end 142 of the machine 100 will thereafter require an exerciser to apply a substantially horizontal force to the carriage 101 in a direction towards the back end of the machine 100, the required force being sufficiently greater than the opposing biasing force created by the biasing member 109.

FIG. 10B is an exemplary diagram showing a side view of an embodiment of an exercise machine with a repositioned slidable carriage 101 relative to the starting position as shown by a dashed carriage 101 outline proximate to the front end stationary platform 104. As can be readily seen, a biasing member 109 having been removably engaged with the slidable carriage 101 by means of an engagement knob 110 has stretched considerably in length in response to the movement of the slidable carriage 101. The lengthening of the biasing member 109 creates a variable force, for instance, in accordance with Hooke's Law of elasticity, against the slidable carriage 101 in a direction towards the front end stationary platform 104.

FIG. 11 is an exemplary diagram showing a front perspective view of an embodiment of an exercise machine. More specifically, the front end 141 of the exercise machine 100 as previously described in FIG. 2B comprises a front end stationary platform assembly 104, a front end floor support member 103, and a reversible right handle 106.

FIG. 12 is an exemplary diagram showing a back perspective view of an embodiment of an exercise machine. More specifically, the back end of the exercise machine as previously described in FIG. 2B comprises a back end floor support member 103, a slidable carriage assembly 101, and a reversible left handle 106. An engagement knob 110 is shown having been removably engaged with an engagement member affixed substantially to the proximate end of the structure of the slidable carriage assembly 101.

FIGS. 13 and 14 are exemplary diagrams showing side and perspective views of an embodiment of an exercise machine 100 with one elevated end. An exercise machine 100 as previously described comprises a front end stationary platform assembly 104 and a back end stationary platform assembly 107. A back end elevating member 112 has been inserted below the back end floor support member 103, thereby causing the back end of the machine 100 to be inclined above the floor by a distance equal to the vertical height of the elevating member 112, and the front end of the machine 100 to be fully supported only by the front end support feet 113.

As can be seen, the slidable carriage assembly 101 has been slidably repositioned along the structural monorail 102 distal to the front end stationary platform 104 against the force of the biasing member 109 as previously described. As a result of having elevated the back end of the machine by a back end elevating member 112, the gravitational force G is applied to the slidable carriage 101 in a direction indicated by the arrow, thereby becoming cumulative with the force of the biasing member 109 to increase the total exercise resistance required to move the carriage 101. The added gravitational force varies depending on the weight of the exerciser positioned upon the slidable carriage 101.

FIG. 17 is an exemplary diagram showing a top view of an embodiment of an exercise machine 100 with a front end stationary platform assembly 104 comprising a stationary platform handle 117 and stationary platform 116, a slidable carriage assembly 101 comprising a carriage platform 114 and carriage handle 115, two pairs of a reversible left handle 106*a*, 106*b* and reversible right handle 105*a*, 105*b* removably affixed proximate to the opposed front and back end stationary platforms 104, 107, a floor support member 103 and a structural monorail 102.

FIG. 18 is an exemplary diagram showing a bottom view of an embodiment of an exercise machine 100 with a front end stationary platform assembly 104, a back end stationary platform assembly 107, a plurality of floor support members 103, a plurality of intermediate support members 108, a structural monorail 102, and a plurality of biasing members 109 removably engageable by their respective engagement knobs 110.

Figure 19:
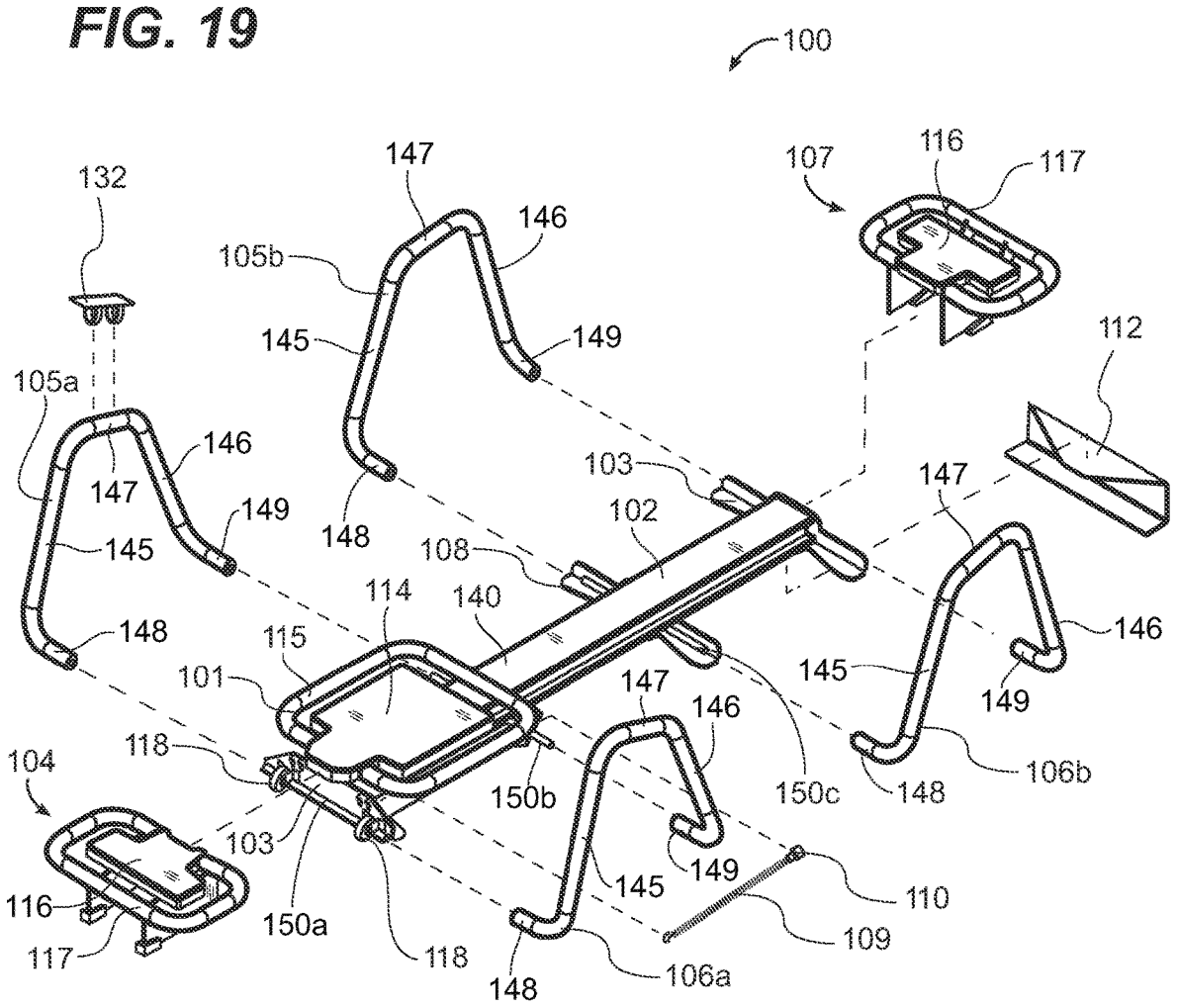
FIG. 19 is an exploded view of a compact exercise machine in accordance with an example embodiment.
Figure 20:
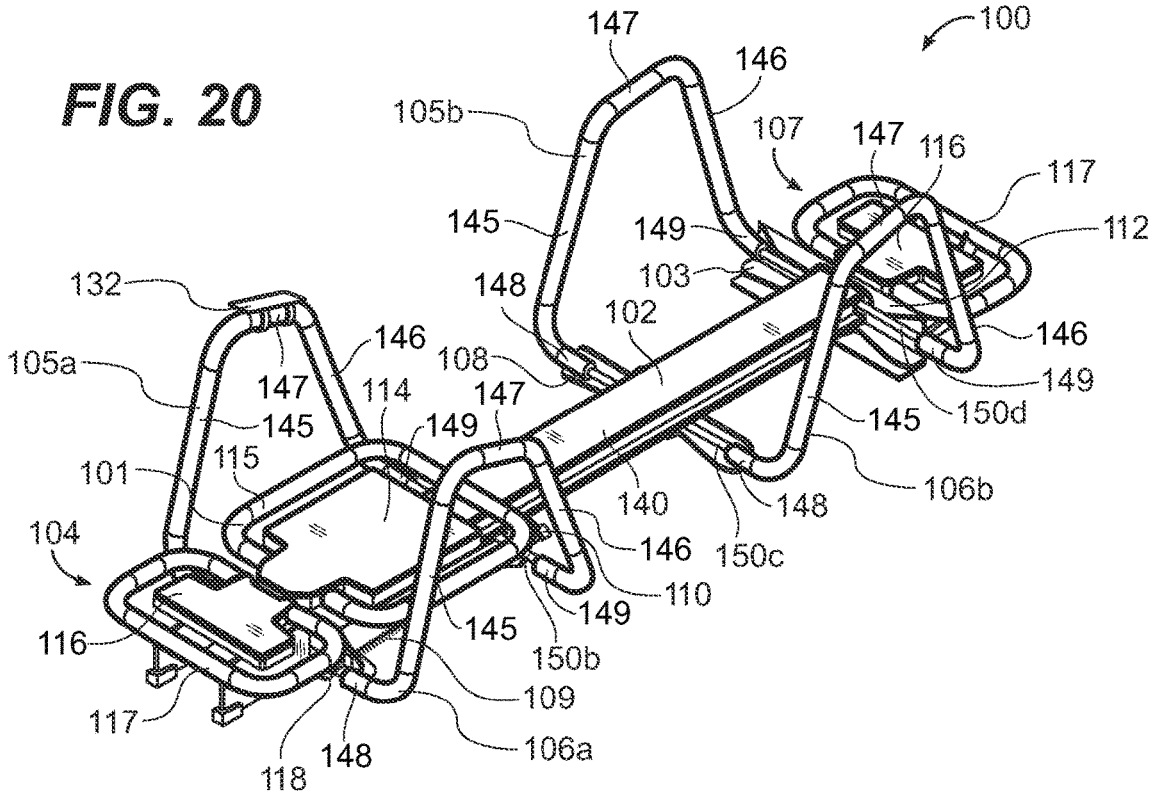
FIG. 20 is a perspective view of a compact exercise machine including a device holder in accordance with an example embodiment.
Figure 21:
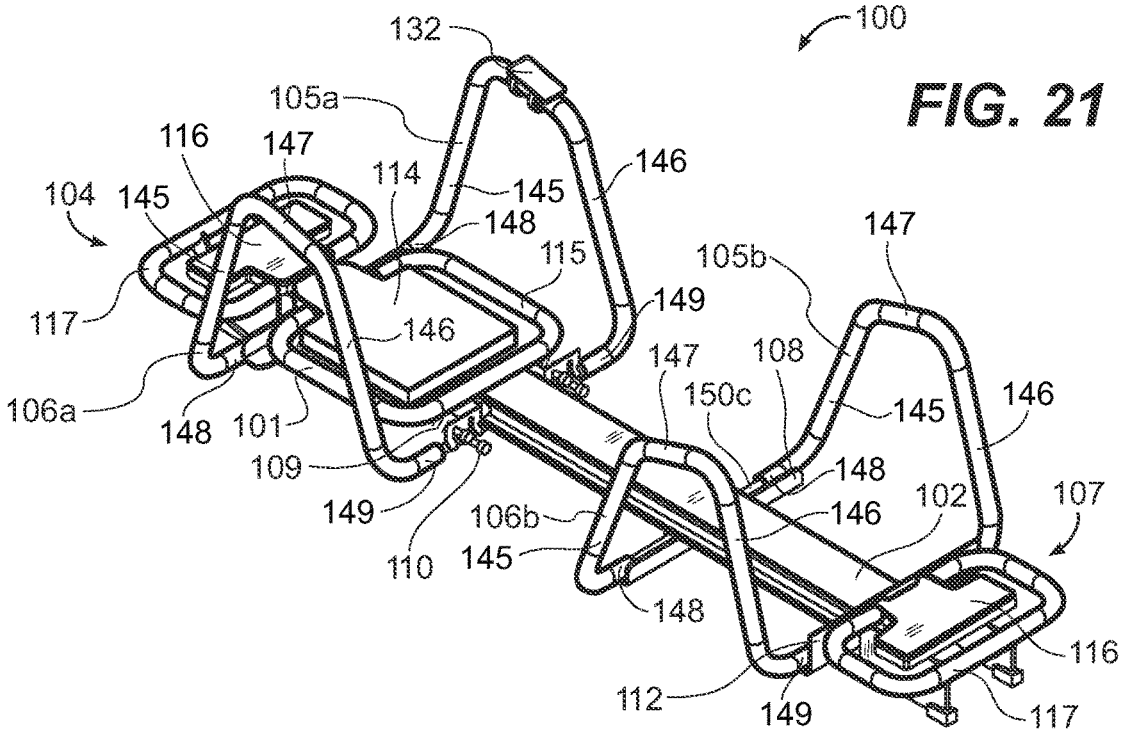
FIG. 21 is a second perspective view of a compact exercise machine including a device holder in accordance with an example embodiment.

FIG. 19 is an exemplary diagram showing an exploded isometric view of an embodiment of an exercise machine 100. More specifically, an exercise machine 100 and accessories may comprise a front end stationary platform assembly 104, a back end stationary platform assembly 107, a slidable carriage assembly 101, a plurality of floor support members 103, a plurality of intermediate support members 108 and couplers 150, a structural monorail 102, at least one biasing member 109 and engagement knob 110, a plurality of reversible right handles 105 and reversible left handles 106, a plurality of transportation wheels 118 affixed proximate to the front end of the machine which provide for easy relocation of the exercise machine, and a back end elevating member 112.

An electronic device holder 132 may provide for an exerciser to secure their smartphone or electronic notebook to the exercise machine 100 during exercise. The electronic device holder 132 may be affixed to the machine 100, or be removably attached to the machine 100 at exerciser-preferred locations, for instance upon the cross member 147 of the front reversible right handle 105*a* as shown by the connecting dashed lines, by clamping, secured with mechanical fasteners, or strapped using hook and loop belts that would encircle the structure to which it is mounted.

C. Rotatable Lifting Handle.

FIGS. 22-34 illustrate an embodiment of an exercise machine 100 which includes an additional optional accessory comprised of a rotatable lifting handle 120. The rotatable lifting handle 120 may be utilized to adjust the exercise machine 100 between a level, horizontal position and an angled, inclined or declined position. Although not shown, if a pair of rotatable handles 120 are utilized at both ends 141, 142 of the exercise machine 100, the exercise machine 100 may be lifted at a level incline by rotating both of the handles 120. The rotatable handle 120 may be utilized with one or more of the stationary platforms 104, 107 and/or handles 105, 106 in any combination.

As best shown in FIGS. 22-26, the rotatable lifting handle 120 may be rotated in a first direction to raise an end 141, 142 of the exercise machine 100 and rotated in a second direction to lower an end 141, 142 of the exercise machine 100. When rotated in the first direction, the rotatable lifting handle 120 will elevate the end 141, 142 of the exercise machine 100 to which it is attached.

If only one end 141, 142 of the exercise machine 100 is so elevated, the exercise machine 100 will be inclined or declined at an angle with respect to the floor surface 124. When rotated in the second direction, which is opposite with respect to the first direction, the rotatable lifting handle 120 will lower the end 141, 142 of the exercise machine 100 to which it is attached back to its original position, returning the exercise machine 100 to a level orientation.

The shape, size, and configuration of the rotatable lifting handle 120 may vary in different embodiments. In the exemplary embodiments shown in FIGS. 30-34, a rotatable lifting handle 120 is illustrated as comprising a pair of arms 152, 153 which extend substantially parallel to each other. The arms 152, 153 are connected at their respective ends by a lifting member 122 which extends in a direction transverse, such as perpendicular, with respect to the arms 152, 153 such as shown in FIGS. 29, 30, 33, and 34.

Figure 29:
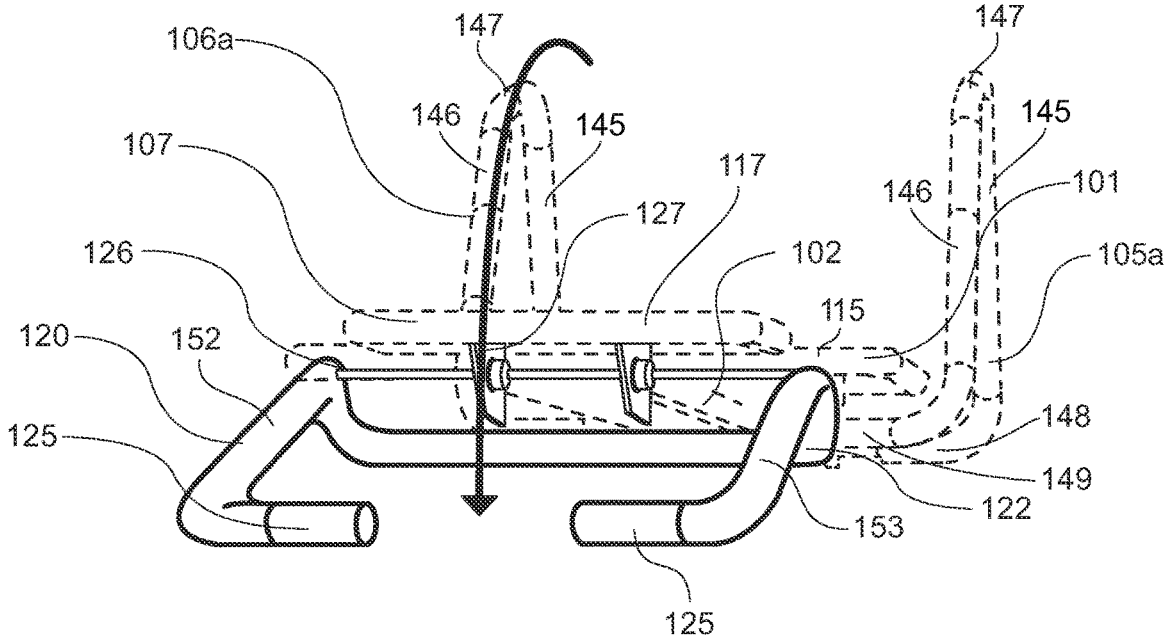
FIG. 29 is a frontal perspective view of a compact exercise machine including a rotatable lifting handle in accordance with an example embodiment.
Figure 30:
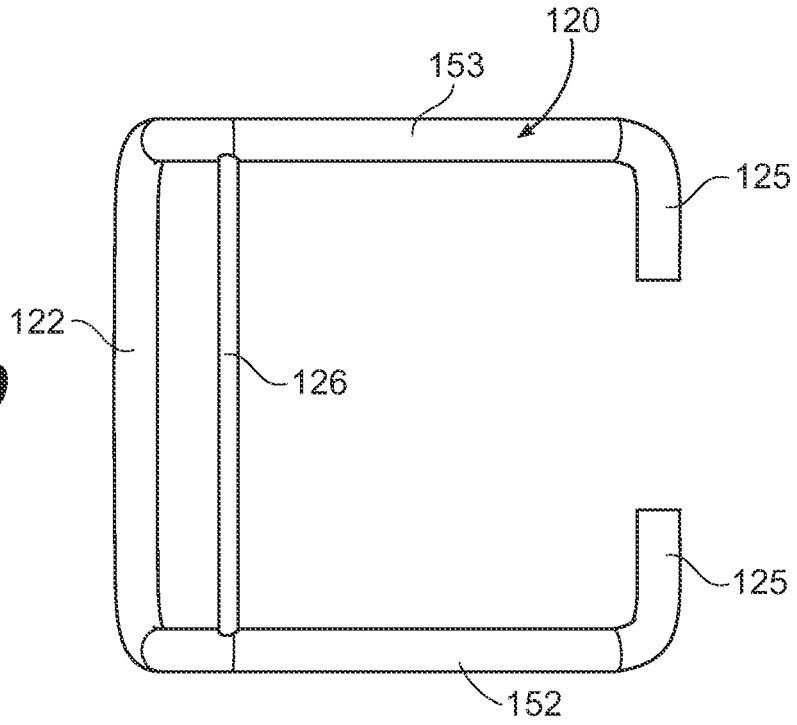
FIG. 30 is a top view of a rotatable lifting handle in accordance with an example embodiment.
Figure 31:
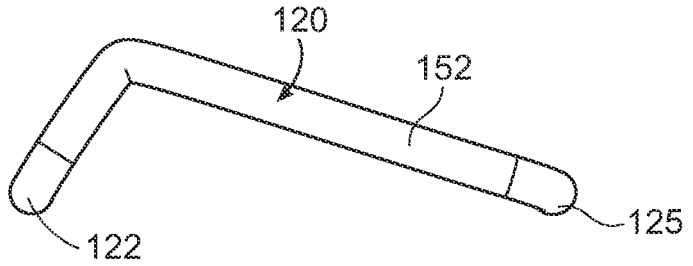
FIG. 31 is a side view of a rotatable lifting handle in accordance with an example embodiment.
Figure 32:
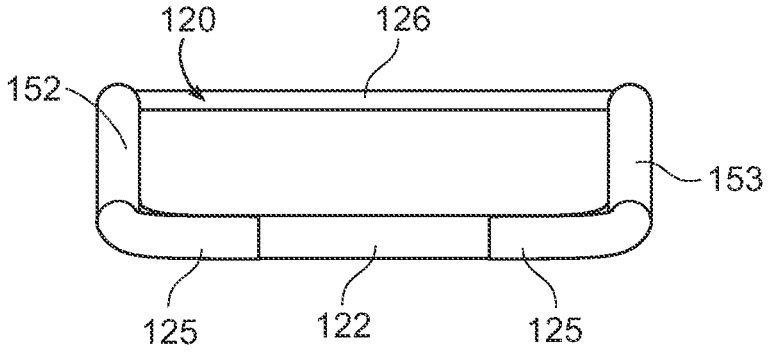
FIG. 32 is an end view of a rotatable lifting handle in accordance with an example embodiment.
Figure 33:
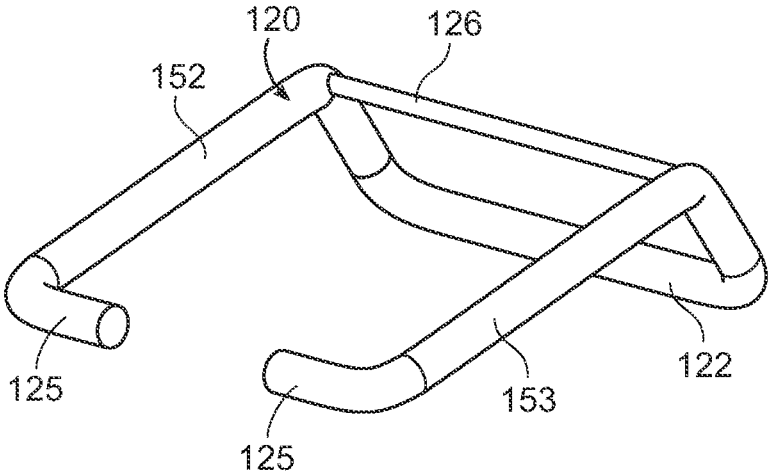
FIG. 33 is a perspective view of a rotatable lifting handle in accordance with an example embodiment.

The rotatable lifting handle 120 may further comprise an axle 126 which is connected between the arms 152, 153 in a parallel orientation with respect to the lifting member 122. The rotatable lifting handle 120 may rotate about the axle 126, such as when the axle 126 is connected to an exercise machine 100 by one or more axle support members 127 such as shown in FIG. 29.

The axle 126 may be positioned at various locations on the rotatable lifting handle 120 so long as the rotatable lifting handle 120 is able to rotate about the axle 126. In the exemplary embodiment shown in FIG. 33, the axle 126 is illustrated as connected between the respective intersections of each arm 152, 153 with either side of the lifting member 122. As shown, the lifting member 122 extends in a substantially perpendicular direction with respect to each of the arms 152, 153, with the axle 126 being connected at the curve forming each intersection of each arm 152, 153 with the lifting member 122.

Figure 27:
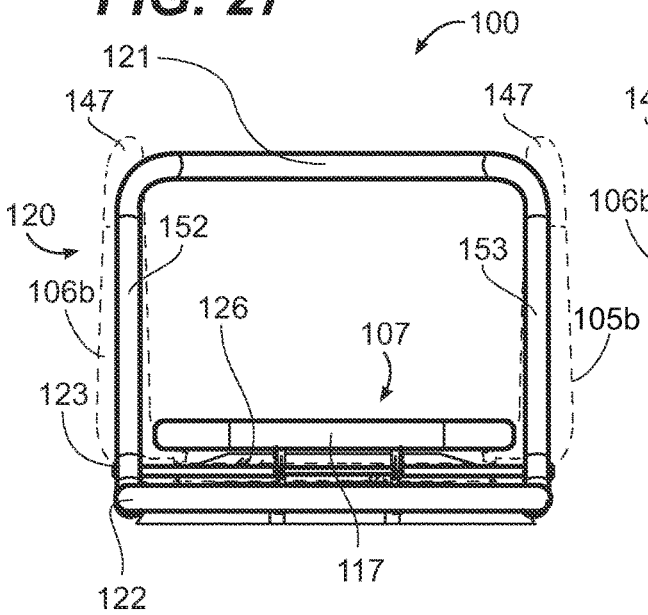
FIG. 27 is a frontal view of a compact exercise machine including a first exemplary embodiment of a rotatable lifting handle in accordance with an example embodiment.
Figure 34:
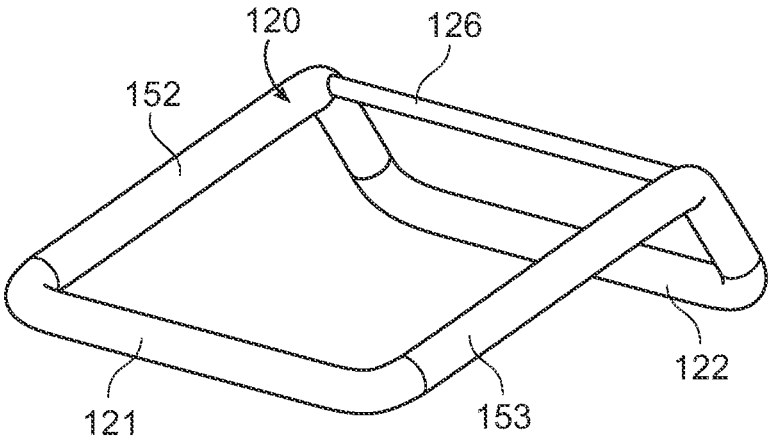
FIG. 34 is a perspective view of an alternate embodiment of a rotatable lifting handle in accordance with an example embodiment.
Figure 35:
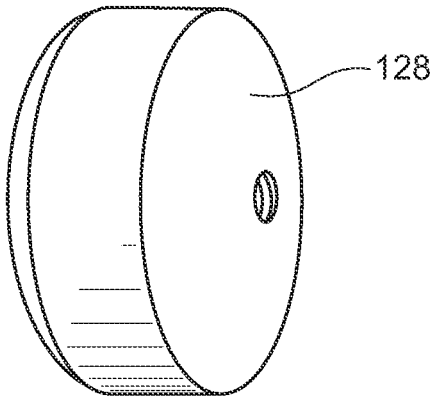
FIG. 35 is a perspective view of a carriage wheel in accordance with an example embodiment.
Figure 36:
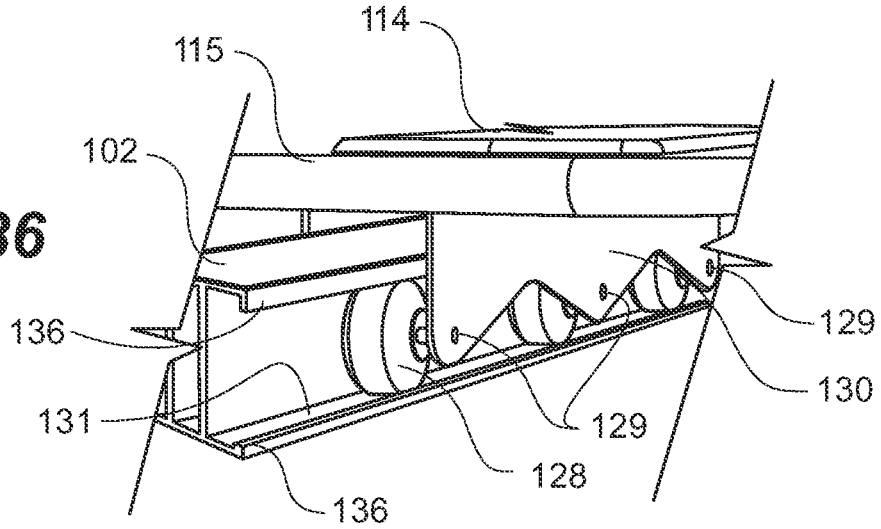
FIG. 36 is a perspective view of a wheel track and carriage wheels of a compact exercise machine in accordance with an example embodiment.

As shown in FIGS. 27 and 34, the rotatable lifting handle 120 may comprise a single transverse gripping bar 121 which extends between the first and second arms 152, 153 of the rotatable lifting handle 120. In other embodiments such as shown in FIGS. 24-26 and 28-33, the rotatable lifting handle 120 may comprise a pair of transverse gripping handles 125 which extend angularly from the distal ends of the respective first and second arms 152, 153, thus creating a gap between the transverse gripping handles 125 through which all or parts of an exerciser's body may pass through.

Figure 23:
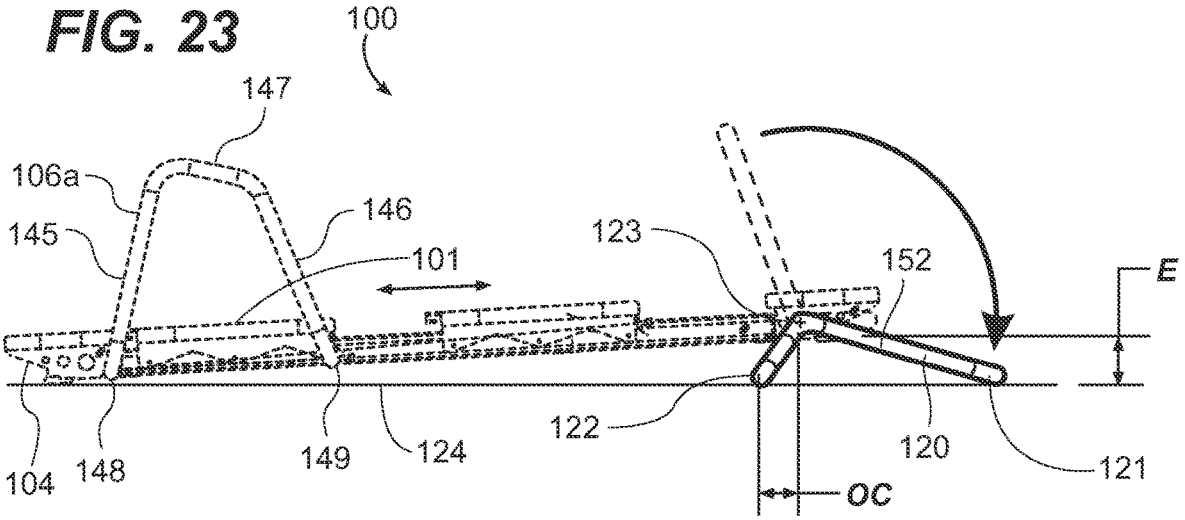
FIG. 23 is a side view of a compact exercise machine including a rotatable lifting handle in a raised position in accordance with an example embodiment.

As shown in FIGS. 24-26 and 29, when the rotatable lifting handle 120 is grasped and rotated in the first direction, the lifting member 122 and transverse gripping bar 121 or transverse gripping handles 125 will engage with the floor surface 124 to lift the end 141, 142 of the exercise machine 100 to which the rotatable lifting handle 120 is connected. In such a raised position, the lifting handle 122 may engage with the ground surface at an angle such as shown in FIG. 23. More specifically, both the transverse gripping bar 121 or transverse gripping handles 125, as well as the lifting member 122, engage with the ground surface 124 such that the side of the rotatable lifting handle 120 forms a triangular shape with the ground surface 124 as shown in FIG. 23.

Figure 22:
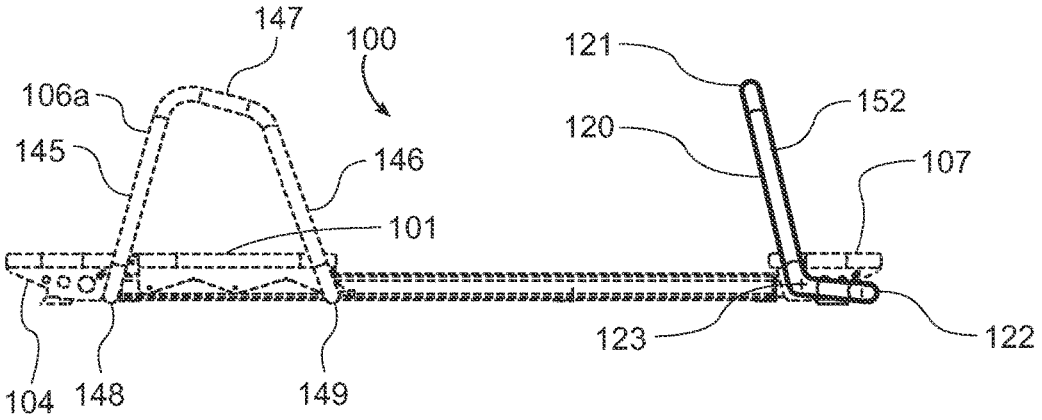
FIG. 22 is a side view of a compact exercise machine including a rotatable lifting handle in a lowered position in accordance with an example embodiment.

When the rotatable lifting handle 120 is grasped and rotated in the second direction, the lifting member 122 will rotate back to its original position in which the lifting member 122 is substantially parallel to the floor surface 124 such as shown in FIG. 22. The lifting member 122 may or may not contact the floor surface 124 when in the original, stowed position. As shown in FIG. 22, in the stowed position, the lifting member 122 may not engage with the ground surface 124, with the arms 152, 153 of the rotatable lifting handle 120 forming substantially an L-shaped (or reversed L-shaped) configuration with the lifting member 122 as shown in FIG. 22.

As shown in FIGS. 22 and 23, the length of the arms 152, 153 may be greater than the length of the respective sides of the lifting member 122. However, in other exemplary embodiments, the sides of the lifting member 122 may be longer than the length of the arms 152, 153. It should be appreciated that the ratio of length between the sides of the lifting member 122 and the arms 152, 153 may vary in different embodiments, with such a ratio determining the distance that the end 141, 142 of the exercise machine 100 is lifted and thus the angle of incline/decline with the respect to the floor surface 124.

Figure 28:
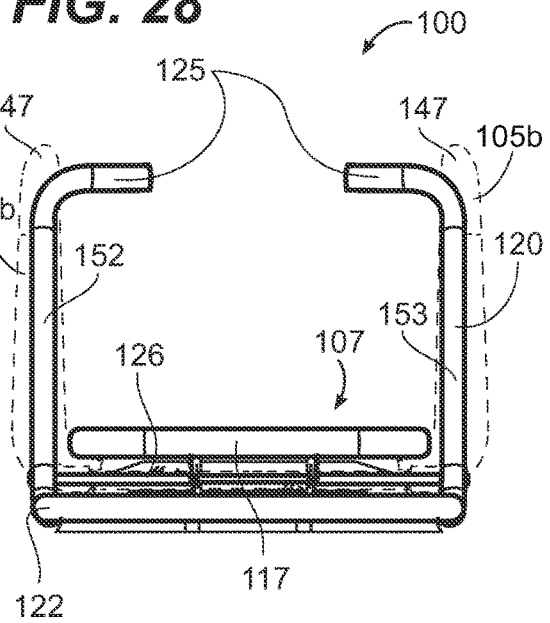
FIG. 28 is a frontal view of a compact exercise machine including a second exemplary embodiment of a rotatable lifting handle in accordance with an example embodiment.

The manner in which the rotatable lifting handle 120 is grasped and rotated may vary according to different embodiments and the preferences of different exercisers. For example, in a rotatable lifting handle 120 utilizing a single transverse gripping bar 121 such as shown in FIG. 27, the exerciser may grasp one or more of the arms 152, 153 and/or transverse gripping bar 121 to rotate the rotatable lifting handle 120 in either direction. As a further example, in a rotatable lifting handle 120 utilizing a pair of transverse gripping handles 125 such as shown in FIG. 28, the exerciser may grasp one or more of the arms 152, 153 and/or one or more of the transverse gripping handles 125 to rotate the rotatable lifting handle 120 in either direction.

FIG. 22 is an exemplary diagram showing a side view of an embodiment of an exercise machine 100 with a stowed lifting handle 120 in a first position. An exercise machine 100 comprising a front end and back end stationary platform 104, 107, left and right reversible handles 105, 106, and a slidable carriage 101 as previously described are shown in outline form by dotted lines for efficiency, and further to direct emphasis to the positioning and function of the below described accessory relative to the exercise machine 100.

A rotatable lifting handle 120 rotatably movable about a rotation axis 123 transverse to the central longitudinal axis of the machine is shown with an upper portion comprising a transverse gripping bar 121, and a lower portion comprising a lifting member 122. The angle measured radially from the rotation axis 123 between the upper portion and the lifting portion of the lifting handle 120 may exceed 90 degrees so as to create an over-center condition when engaged. The benefit of the over-center condition relative to the rotation axis 123 will become apparent upon being fully disclosed below.

An axle which is substantially aligned with the central rotation axis 123 may be rotationally affixed to the back end stationary platform structure 107. Methods of affixing rotationally movable elements relative to a stationary element are well known to those skilled in the art, and merely for example may include a continuous axle extending between the lateral edges of the opposed left and right side arms 145, 146 of the lifting handle 120, or individual axles affixed to each the left side and right side of the machine 100 structure. Though not shown, the methods of affixing the rotatable lifting handle 120 to the exercise machine 100 structure as just described are not meant to be limiting, and any known method of affixing the rotatable handle 120 to the stationary machine structure may be used.

As can be seen, while in the stowed position, the lifting member 122 may be retained between the floor surface and the underside of the back end stationary platform 107 without the need for any devices or mechanisms to lock the lifting handle 120 in the position shown. The positioning of the lifting member 122 between the exercise machine 100 and the floor surface 124 when in such a position may provide a locking support for the transverse gripping bar 121 or transverse gripping handles 125. At the same time, the upper portion of the rotatable lifting handle 120, specifically the transverse gripping bar 121 or transverse gripping handles 125 that extend horizontally between the left and right handle arms 145, 146, may be securedly positioned for use by an exerciser.

FIG. 23 is an exemplary diagram showing a side view of an embodiment of an exercise machine 100 with a manually actuated lifting handle 120. As a means of realizing the benefits of an inclined back end of the machine 100 as described above, an exerciser may quickly and easily elevate the machine by rotating the transverse gripping bar 121 about the rotation axis 123 in the first direction by moving the gripping bar 121 along the arced line in the direction of the arrow. Rotation of the transverse gripping bar 121 causes the lifting member 122 to rotate under the back end of the machine 100, thereby causing the machine 100 to elevate a preferred distance as indicated by E. The advantage of an angle between the gripping bar 121 and lifting member 122 relative to the rotation axle can now be readily seen. The over-center dimension OC creates a stable relationship between the lifting member 122 and transverse gripping bar 121 that prevents unwanted rotation of the handle 120 during exercise, regardless of the weight of an exerciser upon the exercise machine 100.

Figure 24:
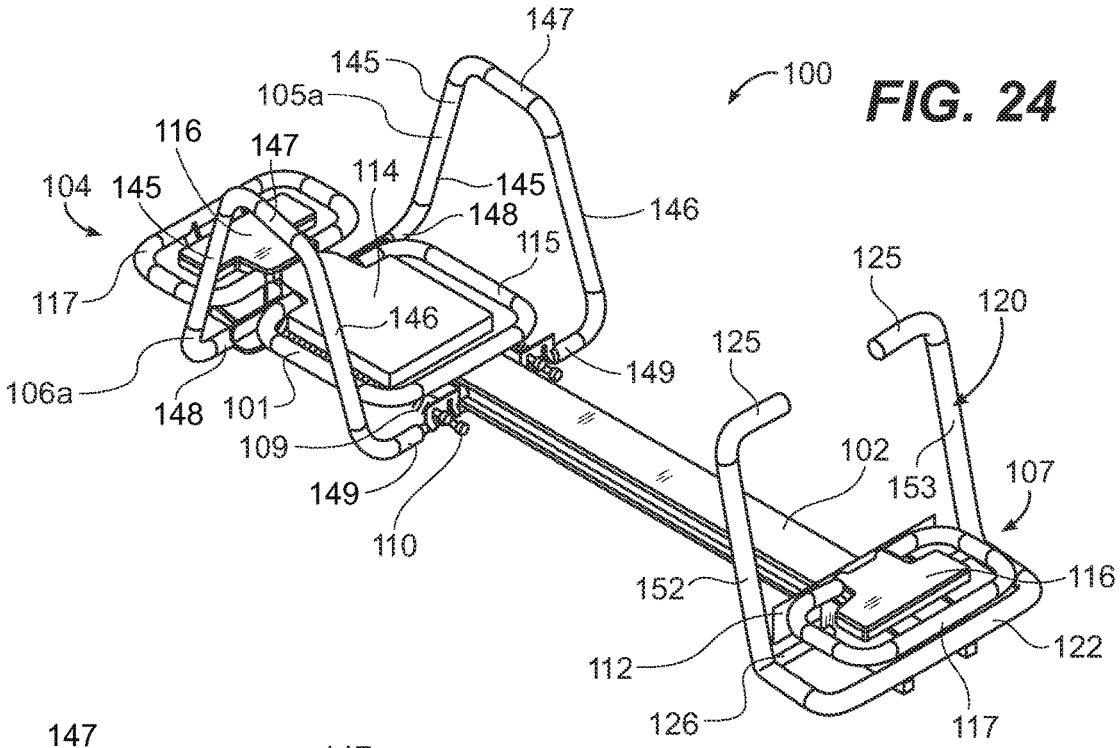
FIG. 24 is a perspective view of a compact exercise machine including a rotatable lifting handle in a lowered position in accordance with an example embodiment.
Figure 25:
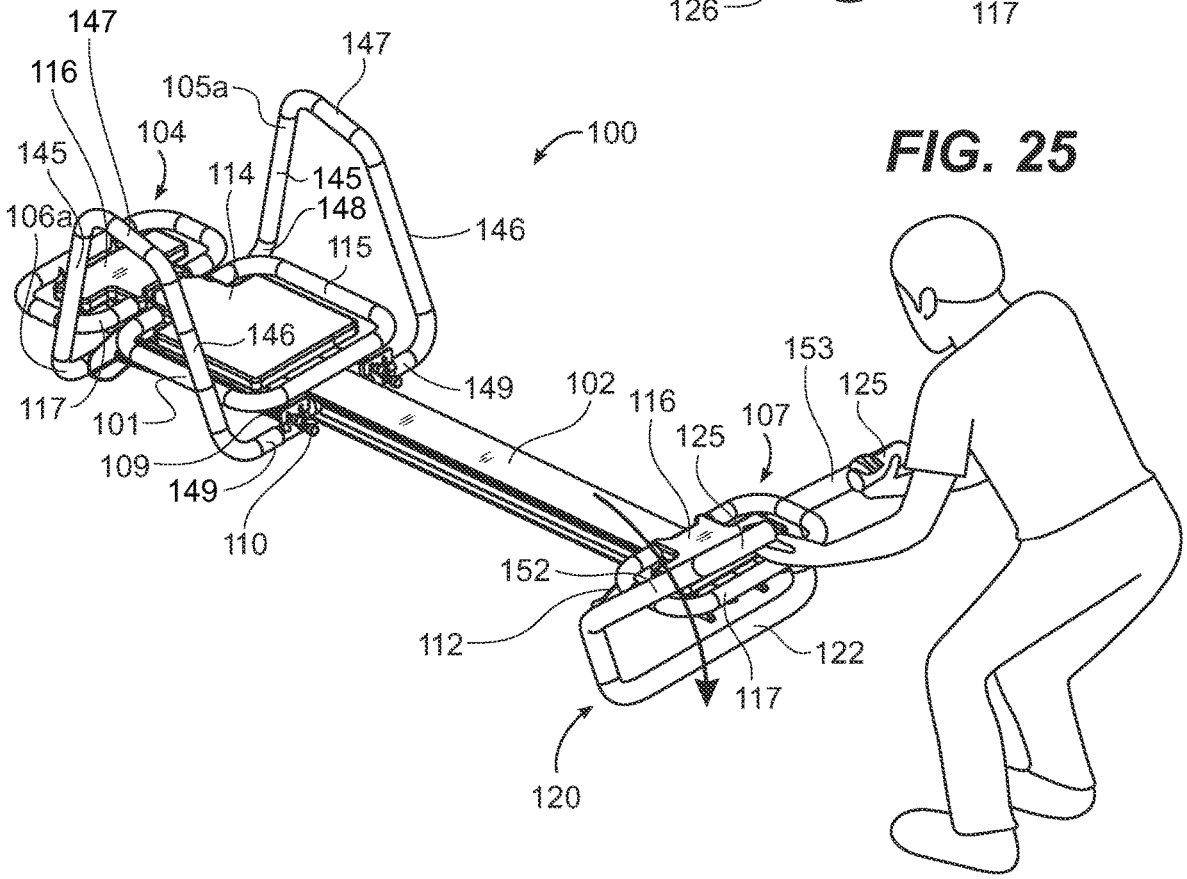
FIG. 25 is a perspective view of a compact exercise machine including a rotatable lifting handle being rotated into a raised position in accordance with an example embodiment.
Figure 26:
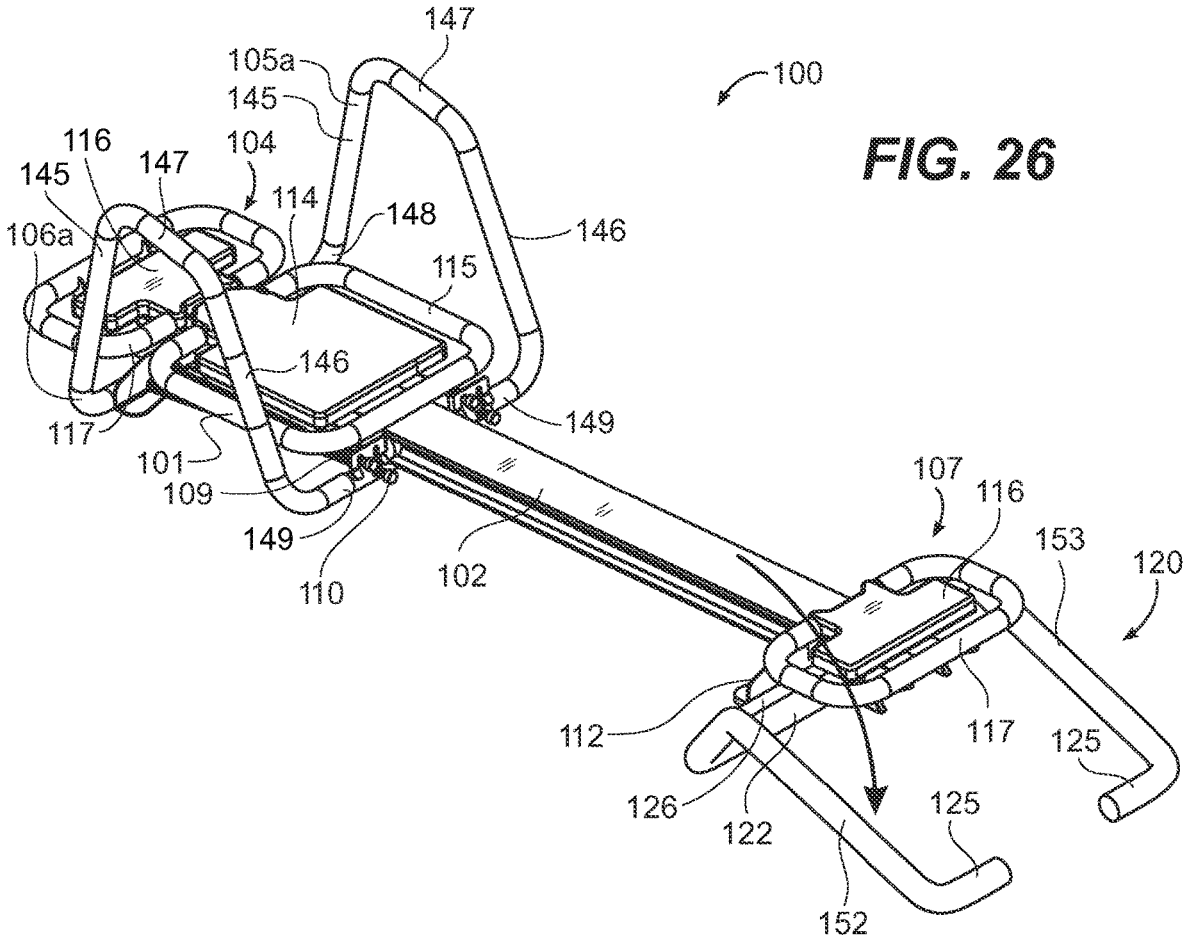
FIG. 26 is a perspective view of a compact exercise machine including a rotatable lifting handle rotated into a raised position in accordance with an example embodiment.

As shown in FIG. 24, the rear end 142 of the exercise machine 100 may be declined by lifting the transverse gripping bar 121 in a second direction, reversing the direction of rotation until the lifting member 122 is positioned securely under the back end stationary platform assembly 107, though not necessarily engaging with the floor surface 124.

FIG. 27 is an exemplary diagram showing a back end view of an embodiment of an exercise machine 100 comprising a lifting handle 120 with a continuous transverse gripping bar 121. More specifically, a rotatable lifting handle 120 comprises an upper transverse gripping bar 121 extending between the left and right upright arms 145, 146 of the lifting handle 120, and a lifting member 122 extending between the vertical left and right arms 145, 146 of the lifting handle 120. As can be seen, the transverse gripping bar 121 may extend parallel with respect to the lifting member 122.

The lifting handle 120 may be rotatably affixed to the exercise machine 100 structure by an axle 126 extending along the transverse rotation axis 123 substantially the distance between the lateral edges of the left and right vertical arms 145, 146 of the lifting handle 120, and rotationally secured to the exercise machine 100. As seen in FIG. 29, the axle 126 may extend parallel with respect to both the lifting member 122 and the transverse gripping bar 121.

The location(s) on the exercise machine 100 to which the lifting handle 120 is connected may vary in different embodiments, including but not limited to near or at the respective ends 141, 142 of the exercise machine 100, such as by being connected to the front end or back end stationary platform assemblies 104, 105, or to various other positions between the ends 141, 142 of the exercise machine 100. The exemplary figures should thus not be construed as limiting with respect to where on the exercise machine 100 the lifting handle 120 may be connected, or how many lifting handles 120 may be utilized on a single exercise machine 100.

FIG. 28 is an exemplary diagram showing a back end view of an embodiment of an exercise machine with transverse gripping handles 125 in use with a lifting handle 120. It is sometimes preferred by an exerciser to easily change positions from one side of a lifting handle 120 to the opposite side of the lifting handle 120. As one variation of the embodiment just described in FIG. 28, rather than providing a continuous transverse gripping bar 121, the facing ends of the opposed transverse gripping handles 125 have been spaced apart sufficiently to allow an exerciser to step through the opening for repositioning on the machine 100 on the opposite side of the handle 120.

FIG. 29 is an exemplary diagram showing a back perspective view of an embodiment of an exercise machine 100 with an actuated lifting handle 120. The axle 126 of a rotatable lifting handle 120 is shown as being movably affixed to a structural member of the back end stationary platform 107 of an exercise machine by at least one axle support member 127.

The number of axle support members 127 utilized, as well as their positioning on the exercise machine 100, may vary in different embodiments and thus should not be construed as limited by the exemplary figures. In the exemplary embodiment shown in the figures, a pair of axle support members 127 comprising plate-like members each having aligned openings through which bearings may be connected are shown, with the axle 126 of the rotatable lifting handle 120 being connected through the bearings so as to rotate with respect to the axle support members 127 and the exercise machine 100.

As previously described, as an exerciser pulls the transverse gripping handles 125 in the first direction along the path of the arc as indicated by the arrow, the lifting member 122 rotates under the rear end 142 of the exercise machine 100, thereby elevating the back end stationary platform 107, the proximate end 142 of the structural monorail 102, and correspondingly the slidable carriage assembly 101 and the proximate ends of the reversible left and right handles 106, 105. In this manner, the exercise machine 100 may be easily and selectively rotated into an inclined or declined position with respect to the floor surface 124.

Although the exemplary embodiments shown in the figures illustrate manual adjustment of the rotatable lifting handle 120, it should be appreciated that other methods of adjustment may be utilized to rotate the rotatable lifting handle 120 between various angular positions with respect to the exercise machine 100.

For example, actuators could be utilized, such as by for example one or more actuators connected between the rotatable lifting handle 120 and the exercise machine 100 so as to rotate the rotatable lifting handle 120 with respect to the exercise machine 100 and, in so doing, lift or lower the exercise machine 100. As a further non-limiting example, a first actuator could be connected between a first side of the lifting member 122 and the exercise machine 100 and a second actuator could be connected between a second side of the lifting member 122 and the exercise machine 100. Various types of actuators may be utilized, such as hydraulic, gas, electric, linear actuators, and the like.

D. Carriage Wheels.

FIGS. 35-44 illustrate exemplary embodiments of a carriage trolley wheel 128 arrangement of an exercise machine 100. FIGS. 35-39 illustrate a first exemplary embodiment of a carriage trolley wheel 128 arrangement utilizing convex, circular carriage wheels 128 which do not include a wheel ridge 133. It should be appreciated that in other embodiments a concave carriage wheel 128, or other shapes of wheels, may be utilized.

FIGS. 40-44 illustrate an exemplary embodiment carriage wheels 128 having a wheel ridge 133 adapted to engage with a corresponding wheel ridge centering track 135 on the wheel track 131. It should be appreciated that an opposite arrangement could be utilized, with the carriage wheels 128 including a groove instead of a wheel ridge 133.

In exemplary embodiments, convex, double "VEE" or concave wheels could be used so long as the wheel track 131 (male or female) mates with a corresponding male or female geometry on the carriage wheel 128. For example and without limitation, linear "VEE" groove guide wheels could be used. In such an embodiment, the wheel track 131 would have a ridge and the carriage wheels 128 would have a groove which rides over the ridge.

A portion of the structural monorail 102 is shown incorporating a monorail wheel track 131 on each of the opposed sides of the monorail 102, the tracks 131 extending substantially the length of the structural monorail 102. A slidable carriage assembly 101 which may comprise for example a carriage handle 115 and carriage platform 114 are supported above the structural monorail 102 a carriage support trolley 130.

A plurality of carriage wheels 128 are rotatably affixed to the support trolley 130 on their respective carriage wheel axles 129. As shown in FIGS. 37, 38, 42, and 43, the distal side of the carriage support trolley 130, carriage wheels 128 and axles 129 and monorail wheel track 131 are substantially mirror images of the proximate side as. The carriage support trolley 130 may provide for the slidable repositioning of the carriage 101 along substantially the length of the structural monorail 102 in response to the forces applied to the carriage 101 by an exerciser.

The number of carriage wheels 128 used to support a single carriage 101 may vary in different embodiments. Further, the positioning and spacing apart of the various carriage wheels 128 used may vary in different embodiments and thus should not be construed as limited by the exemplary figures. As shown in FIGS. 36, 38, 39, 41, 43, and 44, groups of three wheels 128 may be connected to the carriage 101 by a carriage support trolley 130. In the exemplary embodiments shown, three wheels 128 of each set are equally-spaced apart and positioned so as to traverse within one or more wheel tracks 131 of the exercise machine 100.

As shown in FIGS. 36, 37, 39, 41, 42, and 44, the wheel tracks 131 may comprise flanges 136 which retain the wheels 128 within the wheel tracks 131. In the exemplary embodiment shown in the figures, four flanges 136 are shown on the two wheel tracks 131, an upper and lower flange 136 on the first wheel track 131 and a second upper and lower flange 136 on the second track 131. Each of the wheels 128 are prevented from sliding off the tracks 131 by the flanges 136. As best shown in FIG. 27, the carriage support trolley 130 may be positioned just outside the respective flanges on the tracks 131.

Figure 37:
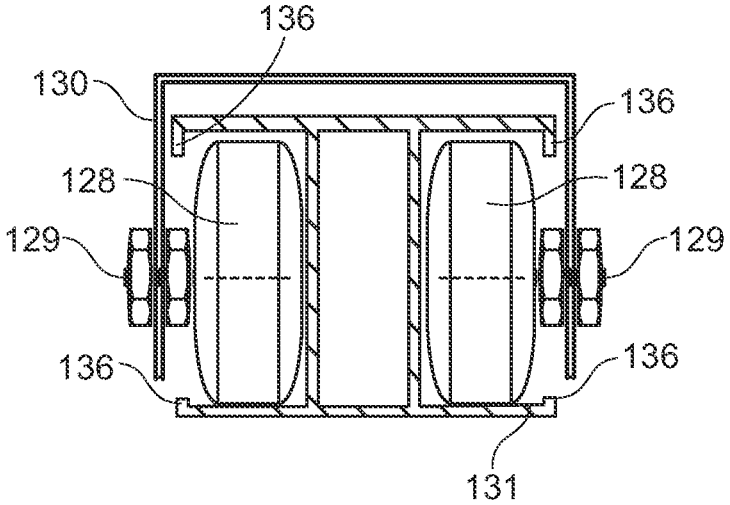
FIG. 37 is an end sectional view of a wheel track and carriage wheels of a compact exercise machine in accordance with an example embodiment.
Figure 38:
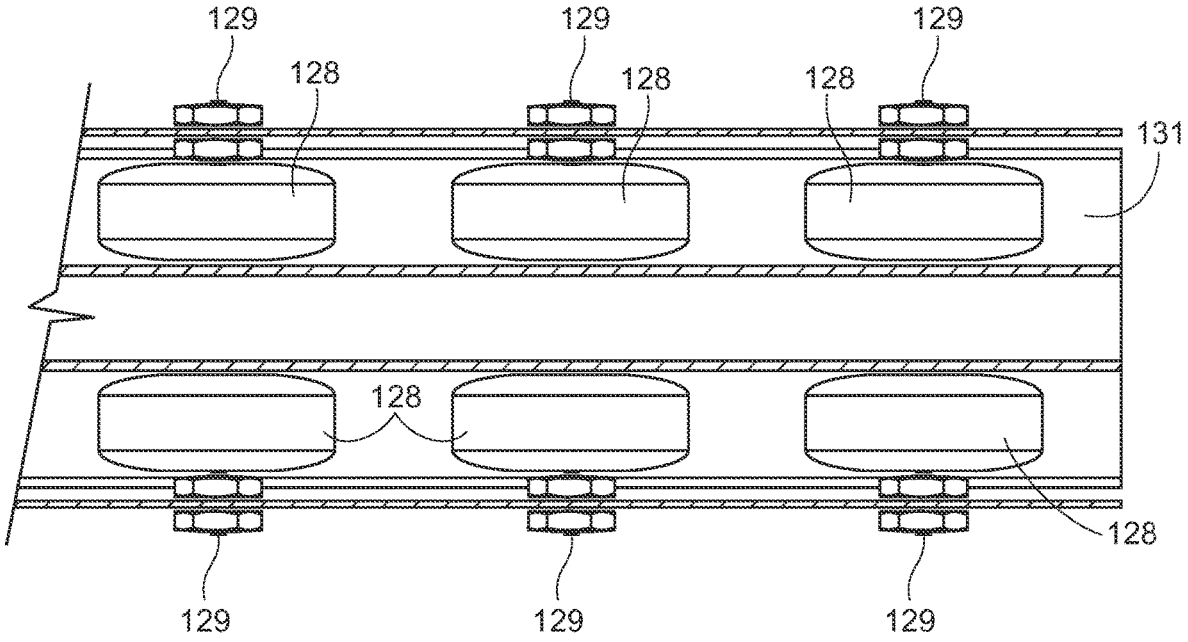
FIG. 38 is a top sectional view of a wheel track and carriage wheels of a compact exercise machine in accordance with an example embodiment.
Figure 39:
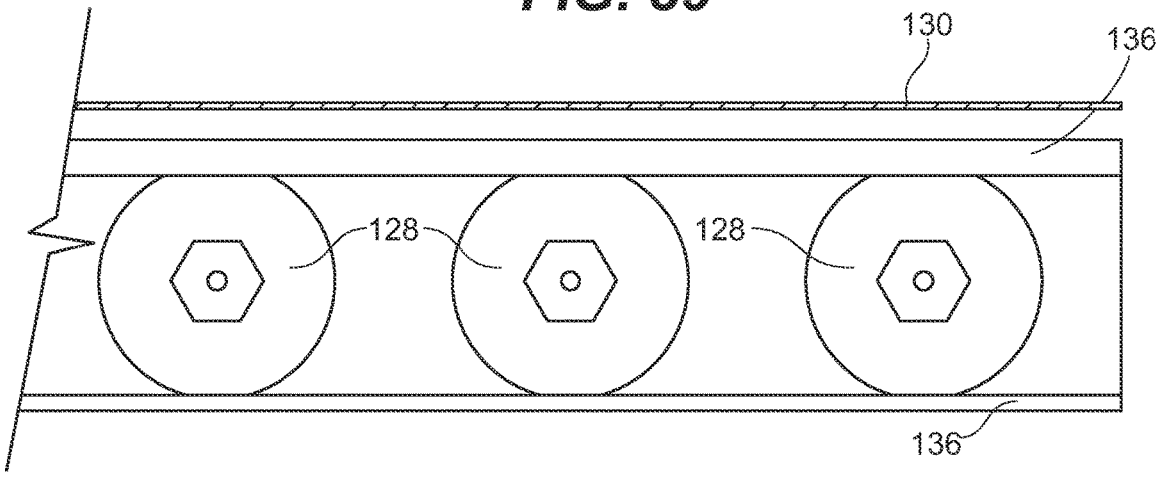
FIG. 39 is a side sectional view of a wheel track and carriage wheels of a compact exercise machine in accordance with an example embodiment.

FIG. 37 is an exemplary diagram showing an embodiment of a variation of a carriage support trolley 130 wheel 128 arrangement, illustrating a sectional view of a structural monorail 102 and end view of a carriage support trolley 130 structure and carriage wheels 128. Those skilled in the art will appreciate that while trolley wheels 128 will roll upon a wheel track 131, and be retained therein regardless of the reasonable downforces applied to an exercise machine 100 slidable carriage 101, such as by flanges 136, it is well understood that transverse forces applied to the carriage 101 will often cause the loss of parallel alignment between the central axis of the plurality of wheels 128 with the wheel track 131, and the central axis of the wheel track 131, thereby causing increased friction between the wheels 128 and wheel track 131, an increase in disconcerting lateral chatter, and loss of fluid reciprocal motion of the carriage 101 along the length of the structural monorail 102 during exercise.

Figure 41:
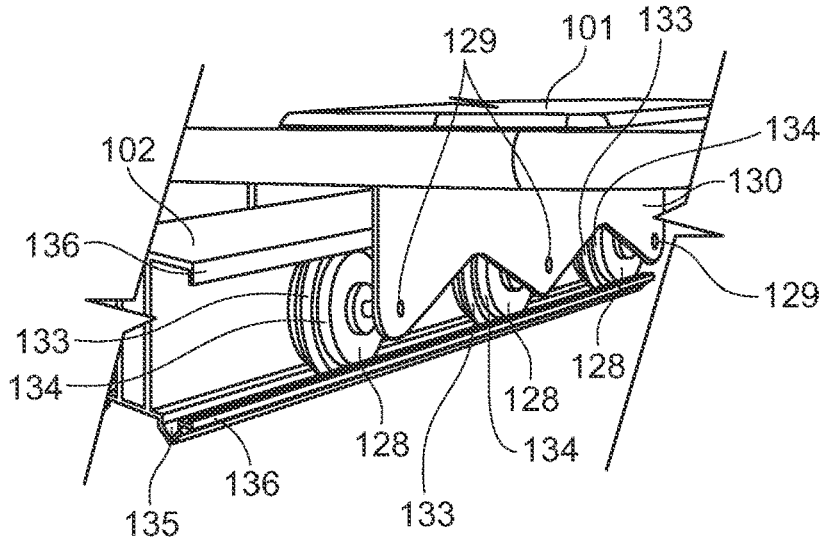
FIG. 41 is a perspective view of a wheel track and carriage wheels each including a wheel ridge of a compact exercise machine in accordance with an example embodiment.
Figure 42:
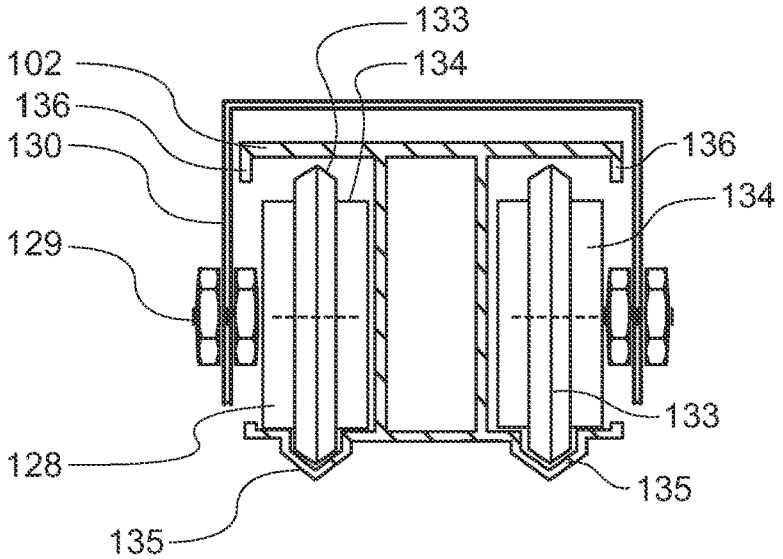
FIG. 42 is an end sectional view of a wheel track and carriage wheels each including a wheel ridge of a compact exercise machine in accordance with an example embodiment.

In the exemplary embodiments shown in FIGS. 36-39 and 41-44, views of the structural monorail 102 are shown comprising a wheel track 131 on each of the right and left sides of the monorail 101 structure. An end view of a carriage support trolley 130 is shown in FIGS. 37 and 42 comprising a plurality of carriage wheels 128 affixed to the left and right substantially vertical portions of the carriage support trolley 130 by their respective wheel axles 129.

To maintain alignment of the central axis of the carriage support trolley 130 parallel to the central axis of the structural monorail 102, a male and corresponding female geometry is shown. More specifically, a wheel ridge centering track 135 is incorporated into the monorail wheel track 131 to receive a corresponding wheel ridge 133 and maintain alignment of the plurality of wheels 128 within the corresponding wheel ridge centering track 135 and thus the wheel track 131 overall. A substantially flat portion of the wheel 128 provides for a longer wearing wheel load bearing surface 134, eliminating the requirement for the narrow contact surface of the wheel ridge 133 to support heavy loading.

Figure 40:
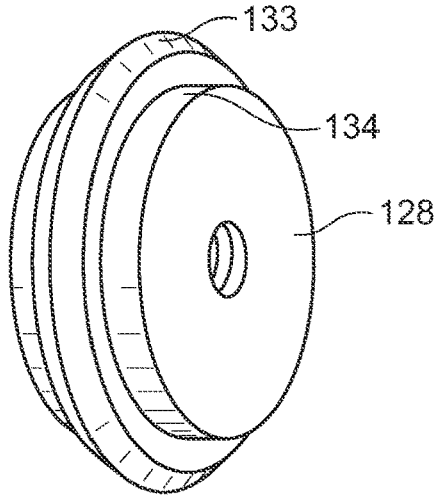
FIG. 40 is a perspective view of a carriage wheel including a wheel ridge in accordance with an example embodiment.

As best shown in FIGS. 40, each of the carriage wheels 128 is illustrated as comprising a wheel ridge 133 which extends around the outer circumference of each carriage wheel 128. The wheel ridge 133 may comprise a raised rib or other raised portion which extends radially around the outer edge of the carriage wheel 128 so as to engage within a corresponding wheel ridge centering track 135 formed within the wheel track 131. In some exemplary embodiments, the carriage wheel 128 may comprise a groove instead of a ridge, with the groove engaging with the wheel track 131.

The shape, size, orientation, and positioning of the wheel ridge 133 may vary in different embodiments. In the exemplary embodiments shown in FIGS. 40-43, the wheel ridge 133 extends around the full circumference of the carriage wheel 128, with the wheel ridge 133 being centered on the wheel's 128 outer edge. The wheel ridge 133 may be raised with respect to the remainder of the wheel 128, such as with respect to the wheel load bearing surface 134 such as shown in FIGS. 40 and 42.

On either side of the wheel ridge 133, wheel load bearing surfaces 134 are shown which engage with and roll along the wheel track 131. As shown in the figures, the wheel load bearing surfaces 134 may be radially offset with respect to the raised wheel ridge 133. It should be appreciated that other configurations could be utilized, such as for example alternate positioning or orientation of the wheel ridge 133, or use of one or more discrete wheel ridge 133 portions which do not fully encircle the circumference of the carriage wheel 128.

Figure 43:
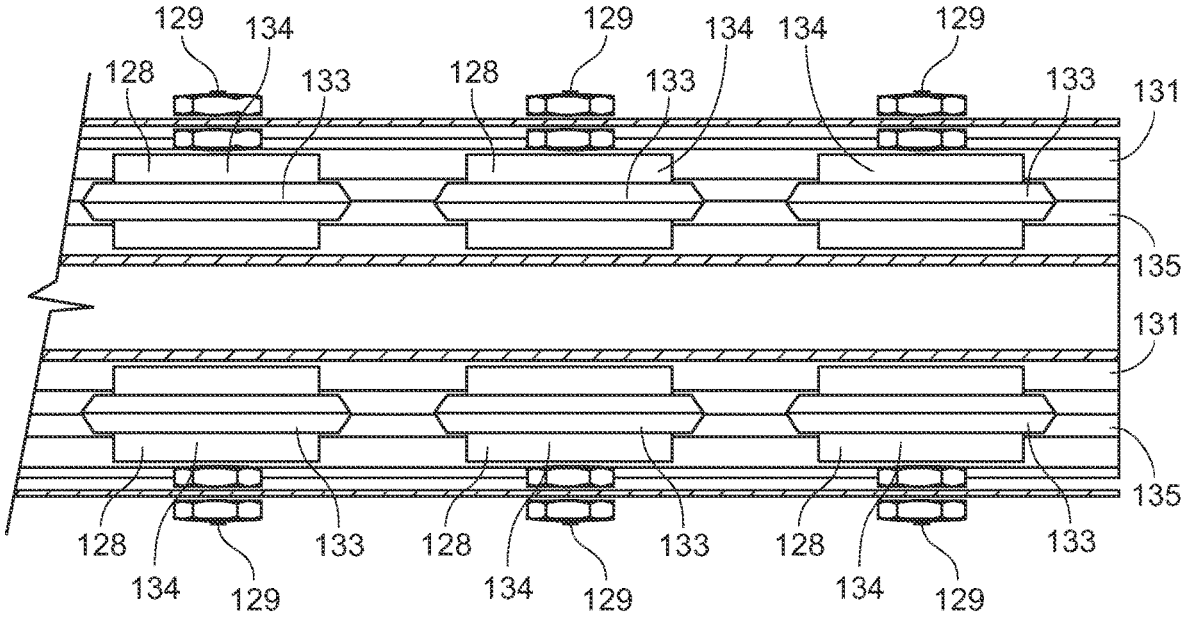
FIG. 43 is a top sectional view of a wheel track and carriage wheels each including a wheel ridge of a compact exercise machine in accordance with an example embodiment.
Figure 44:
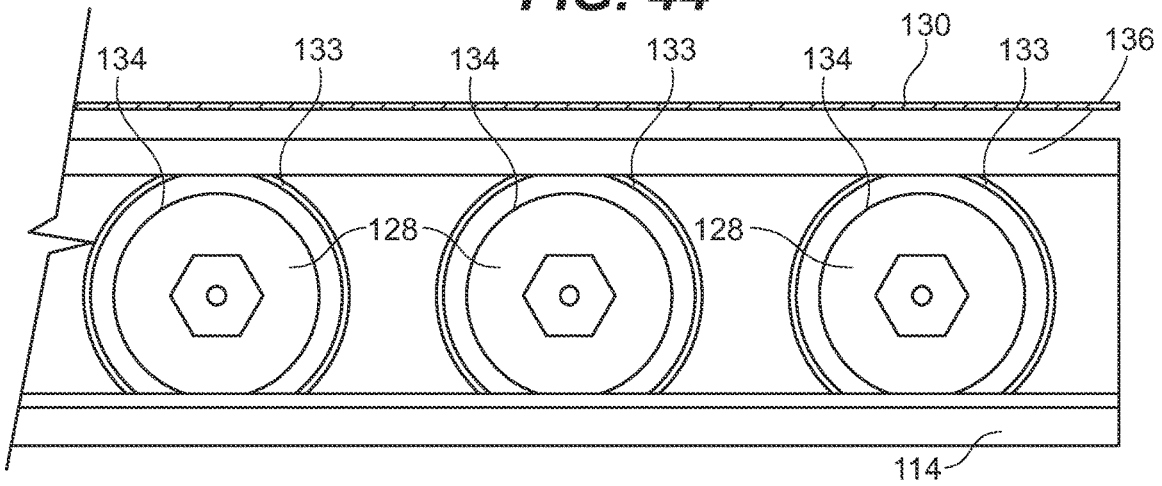
FIG. 44 is a side sectional view of a wheel track and carriage wheels each including a wheel ridge of a compact exercise machine in accordance with an example embodiment.

As shown in FIGS. 41-43, the wheel ridge 133 engages within the wheel ridge centering track 135 to prevent the carriage wheel 128 from sliding from side-to-side as well as to prevent lateral chatter which can be distracting for an exerciser. The wheel ridge 133 is shown as comprising a triangular cross-section, though it should be appreciated that other shapes could be utilized. For example, the wheel ridge 133 could comprise a square- or rectangle-shaped configuration or, in some embodiments, a rounded configuration. Similarly, while the wheel ridge centering track 135 is shown with a corresponding triangular cross-section, various other shapes may be utilized for the wheel ridge centering track 135. The shape of the wheel ridge centering track 135 may correspond with the shape of the wheel ridge 133 in some exemplary embodiments.

Therefore, as can be appreciated, the improved centering portion of the trolley wheels 128 that mate with a corresponding wheel ridge 133 in the monorail track 131, and the relatively flat load bearing surface of the trolley wheels 128 that ride on the relatively flat portion of the monorail track provides an improved combination of wheel 128 to track centering and superior load support, thereby eliminating the increased friction between the wheels 128 and wheel track 131, an increase in disconcerting lateral chatter, and loss of fluid reciprocal motion of the carriage 101 along the length of the structural monorail 102.

E. Exercise Machine.

FIGS. 45-63 illustrate another exemplary embodiment of an exercise machine 200. As best shown in FIGS. 45-49, the exercise machine 200 may comprise a frame 201 including a first end 202 and a second end 203. The exercise machine 200 may include a base 204 which rests upon the ground surface underneath the exercise machine 200. The exercise machine 200 may also comprise a track 210 on which a carriage 230 may be movably connected.

Figure 45:
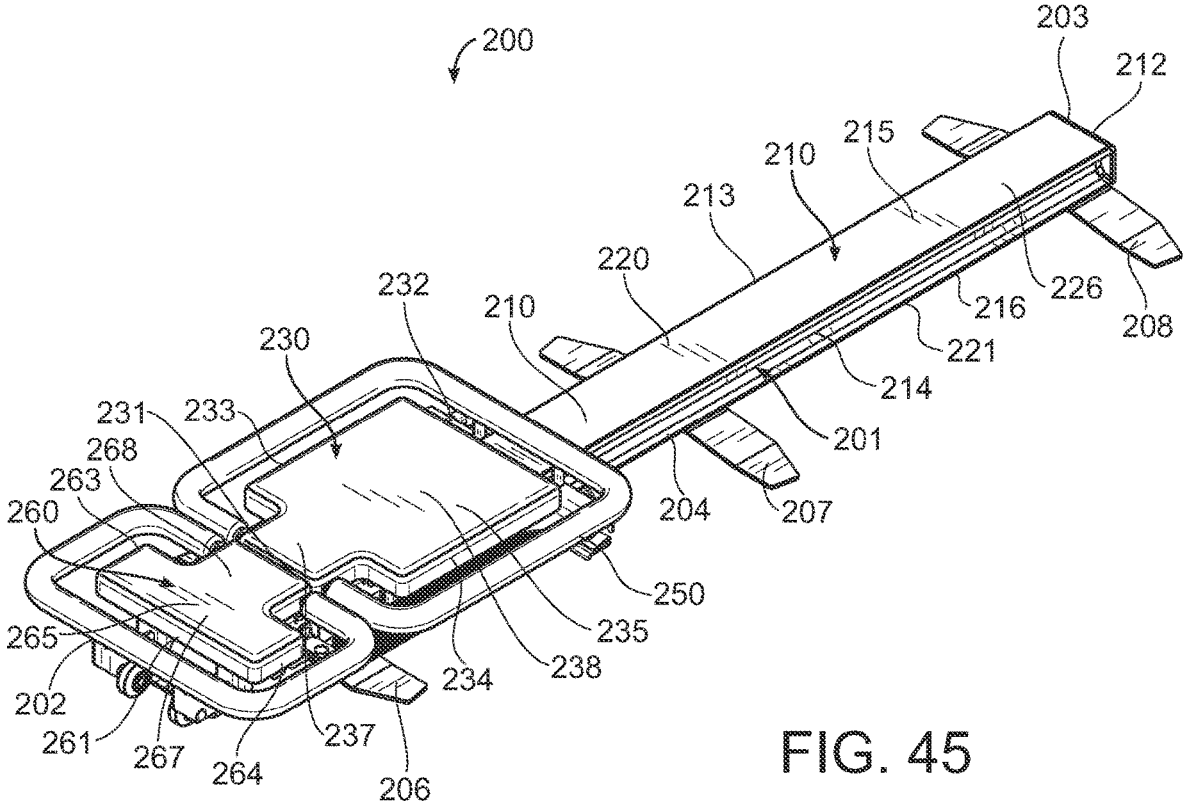
FIG. 45 is a perspective view of an exercise machine in accordance with an example embodiment.

In the exemplary embodiment shown in FIG. 45, the base 204 of the exercise machine 200 is illustrated as comprising a plurality of supports 206, 207, 208, with each of the supports 206, 207, 208 resting on the ground surface underneath the exercise machine 200. The shape, size, and configuration of the supports 206, 207, 208 may vary in different embodiments and thus should not be construed as limited by the exemplary figures. In the exemplary embodiment shown in FIG. 45, each of the supports 206, 207, 208 is illustrated as comprising flat legs which extend outwardly from the sides 213, 214 underneath the track 210 of the exercise machine 200. The use of supports 206, 207, 208 which extend in both directions from the respective sides 213, 214 of the track 210 ensures that the exercise machine 200 does not tip over on one side or the other.

In the exemplary embodiment shown in the figures, the exercise machine 200 includes three supports 206, 207, 208: a first end support 206 positioned at or near the first end 202 of the exercise machine 200, a second end support 208 positioned at or near the second end 203 of the exercise machine 200, and a middle support 207 which is positioned between the first and second end supports 206, 208. While the middle support 207 is illustrated as being positioned at the mid-point between the two end supports 206, 208, it should be appreciated that the middle support 207 may be positioned at other locations. Further, in some embodiments, multiple middle supports 207 may be utilized. In other embodiments, the middle support 207 may be omitted entirely.

Figure 46:
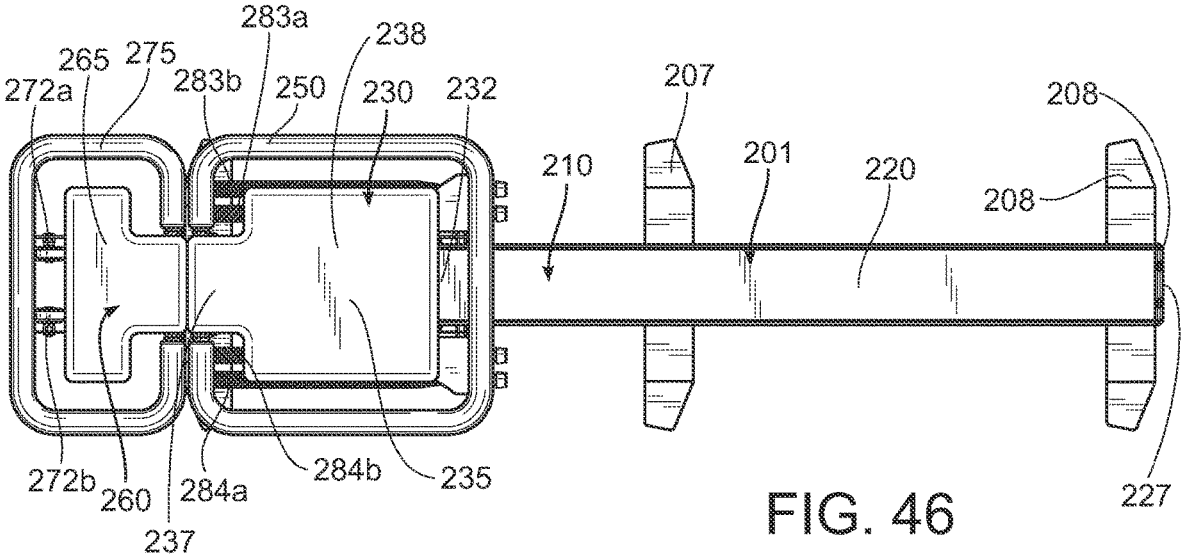
FIG. 46 is a top view of an exercise machine with the carriage in the resting position in accordance with an example embodiment.
Figure 47:
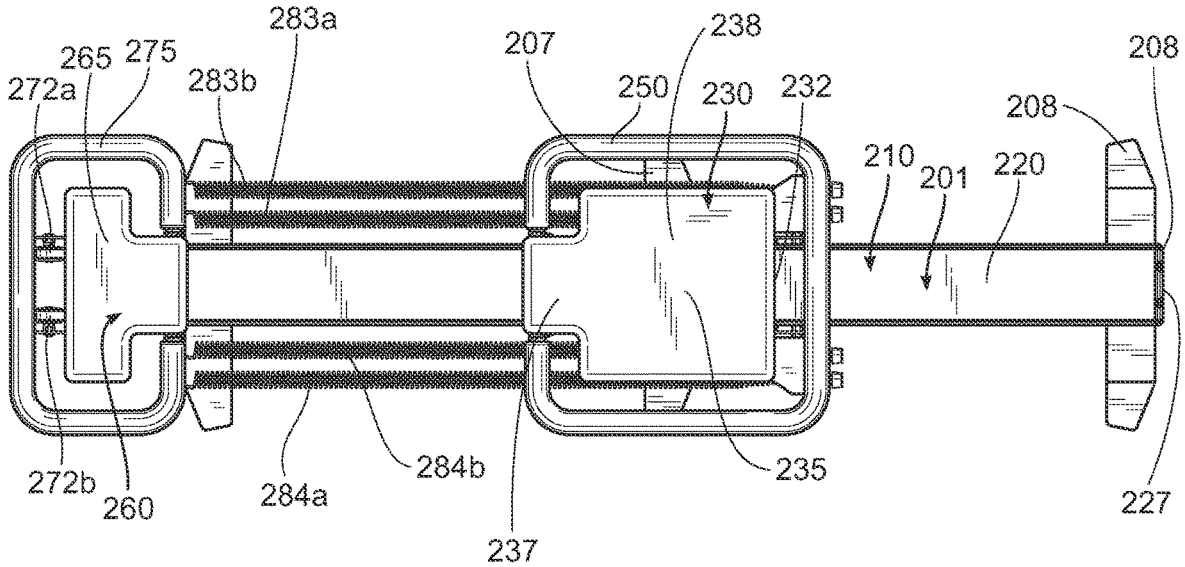
FIG. 47 is a top view of an exercise machine with the carriage in the extended position in accordance with an example embodiment.
Figure 48:
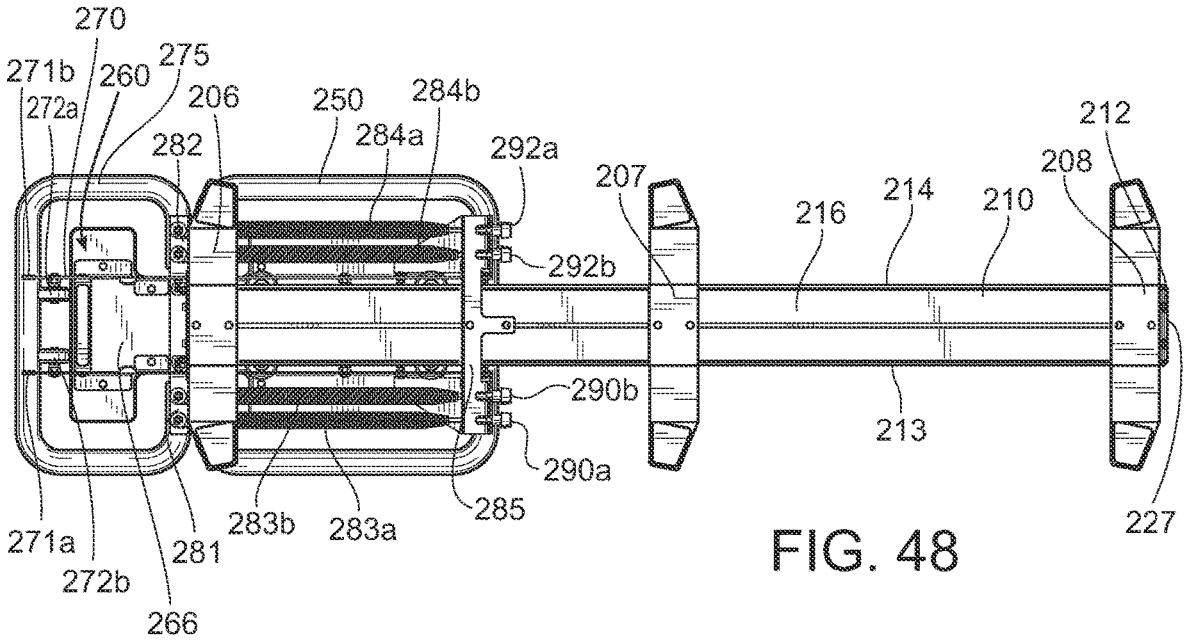
FIG. 48 is a bottom view of an exercise machine with the carriage in the resting position in accordance with an example embodiment.
Figure 49:
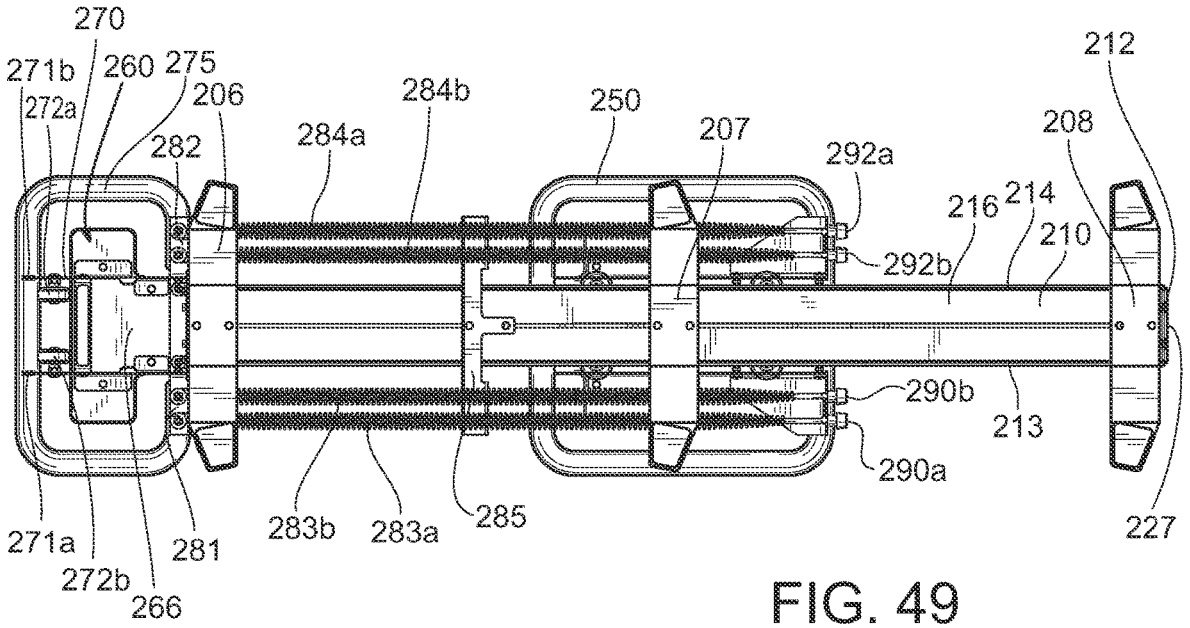
FIG. 49 is a bottom view of an exercise machine with the carriage in the extended position in accordance with an example embodiment.

In some embodiments, one or both of the end supports 206, 208 may function as a handle for tilting and moving the exercise machine 200. As shown in FIG. 46, the first end 202 of the exercise machine 200 may include platform wheels 272*a*, 272*b*. The second end 203 of the exercise machine 200 may be lifted by grasping the second end support 208 and lifting upwardly. In this manner, the exercise machine 200 may be tilted up onto its first end 202 so that the platform wheels 272*a*, 272*b* engage with the ground surface. In this manner, the exercise machine 200 may be easily lifted and moved by a single user grasping the second end support 208.

As shown in FIGS. 45-49, 52, and 54, the exercise machine 200 may comprise a track 210 on which a carriage 230 is movably connected. The track 210 may comprise a single monorail 226 as shown in the figures and described herein. In other embodiments, the track 210 may comprise multiple rails, such as a pair of parallel rails. Thus, the track of the exercise machine 200 should not be construed as limited to the monorail configuration shown in the exemplary figures.

Figure 52:
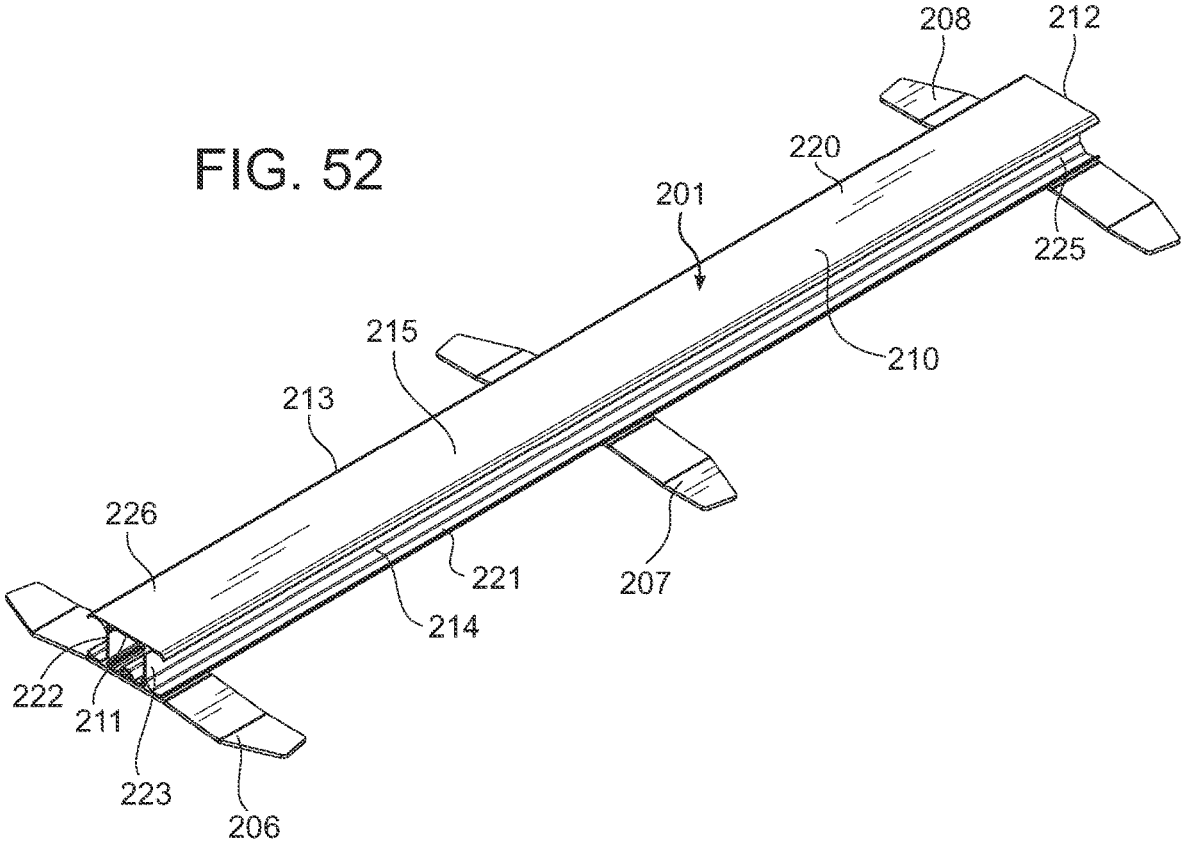
FIG. 52 is a perspective view of a frame including a base and a track of an exercise machine in accordance with an example embodiment.
Figure 53:
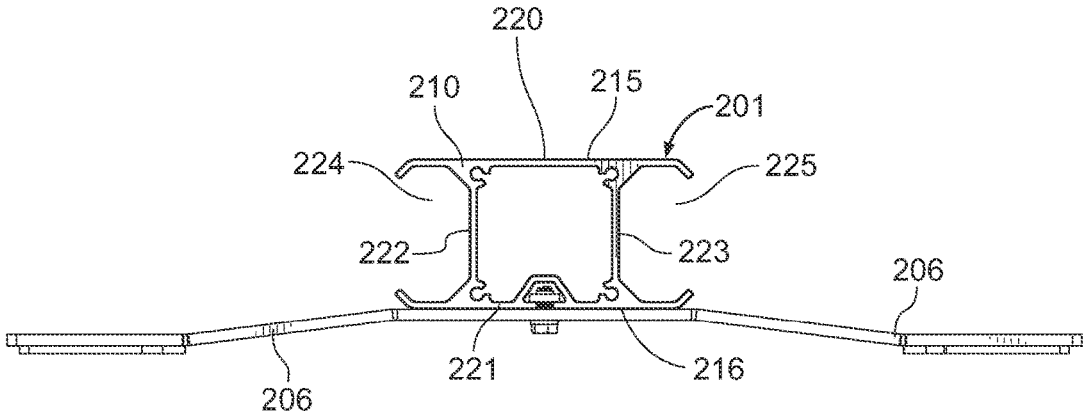
FIG. 53 is an end view of a frame including a base and a track of an exercise machine in accordance with an example embodiment.
Figure 54:
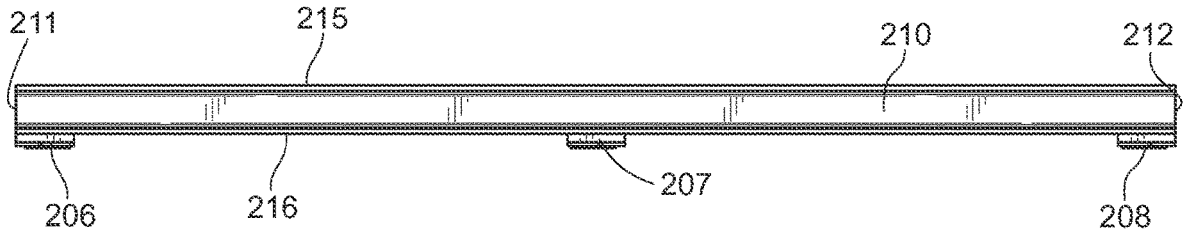
FIG. 54 is a side view of a frame including a base and a track of an exercise machine in accordance with an example embodiment.

The track 210 may include a first end 211, a second end 212, a first side 213, a second side 214, an upper end 215, and a lower end 216 as shown in FIGS. 52-54 and 62. An end cap 227 may be removably or fixedly attached to one or both ends 2115, 216 of the track 210. The track 210 is best shown in FIGS. 52-54, in which it can be seen that the track 210 comprises an upper member 220 and a lower member 221, with the upper member 220 and the lower member 221 each being horizontally-oriented, distally-spaced, and parallel. The outer ends of the upper and lower members 220, 221 may be slightly curved or may include a flange so as to prevent the carriage 230 from disengaging by sliding off either side 213, 214 of the track 210.

Continuing to reference FIGS. 52-54 and 62, the track 210 is shown as comprising a first side member 222 and a second side member 223. The first side member and second side member 223 each extend vertically between the upper member 220 and the lower member 221. The first and second side members 222, 223 may be recessed with respect to the outer edges of the respective upper and lower members 220, 221 such as shown in FIG. 53 so as to define a first side groove 224 on the first side 213 of the track 210 and a second side groove 225 on the second side 214 of the track 210.

As shown in the figures, the first side groove 224 is defined by the upper member 220, lower member 221, and first side member 222. Similarly, the second side groove 225 is defined by the upper member 220, lower member 221, and second side member 223. Although the figures illustrate that the side grooves 224, 225 extend for the length of the track 210 between its first and second ends 211, 212, it should be appreciated that, in some embodiments, the side grooves 224, 225 may extend for only part of the length of the track 210.

The grooves 224, 225 of the track 210 may function as guides for the carriage wheel assembly 240 as discussed in more detail below. The first wheels 244*a*, 244*b*, 244*c*, 245*a*, 245*b* of the carriage wheel assembly 240 may engage and move within the first side groove 224 of the track 210 and the second wheels 246*a*, 246*b*, 246*c*, 247*a*, 247*b* may engage and move within the second side groove 225 of the track 210. The flanges on the distal ends of the respective upper member 220 and lower member 221 retain the wheels 244*a*, 244*b*, 244*c*, 245*a*, 245*b*, 246*a*, 246*b*, 246*c*, 247*a*, 247*b* within the respective side grooves 224, 225 and thus prevent the carriage 230 from being disengaged from the track 210.

As shown throughout FIGS. 45-63, the exercise machine 200 may include a carriage 230 which is movably connected to the track 210. The carriage 230 may be configured to slide along the track 210 in both directions, such as by reciprocating. As best shown in FIGS. 55-58, the carriage 230 may comprise a substantially rectangular or square shape including a first end 231, a second end 232, a first side 233, a second side 234, an upper end 235, and a lower end 236. The carriage 230 may include a first portion 237 and a second portion 238, with the first portion 237 being narrower than the second portion 238.

As shown in FIGS. 46-49, the carriage 230 is movably connected to the track 210 of the exercise machine 200 such that the carriage 230 may be moved in either direction on the track 210. The carriage 230 may be adapted to move along the entire length of the track 210 between its first and second ends 211, 212, or may be adapted to move only along a portion of the track 210. In the exemplary embodiment shown in the figures, the carriage 230 is movably connected to the track 210 by a carriage wheel assembly 240 on the lower end 236 of the carriage 230.

Figure 56:
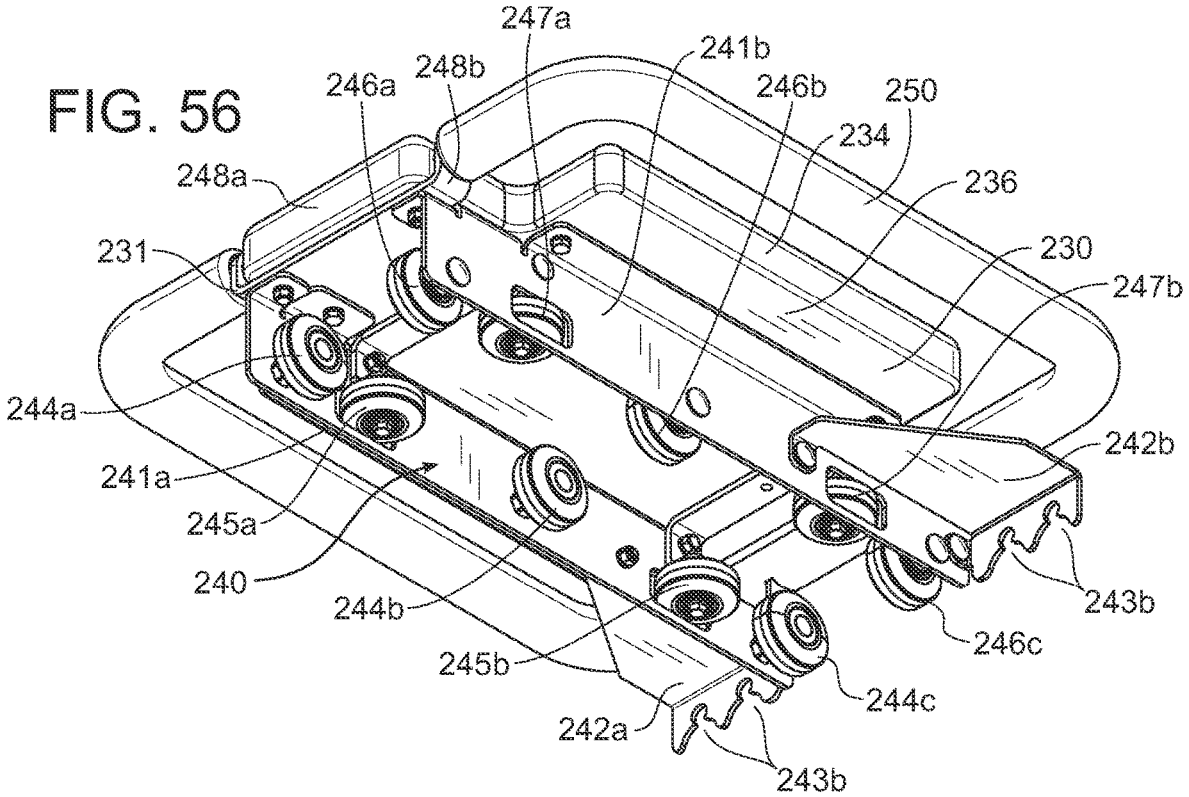
FIG. 56 is a lower perspective view of a carriage of an exercise machine in accordance with an example embodiment.
Figure 57:
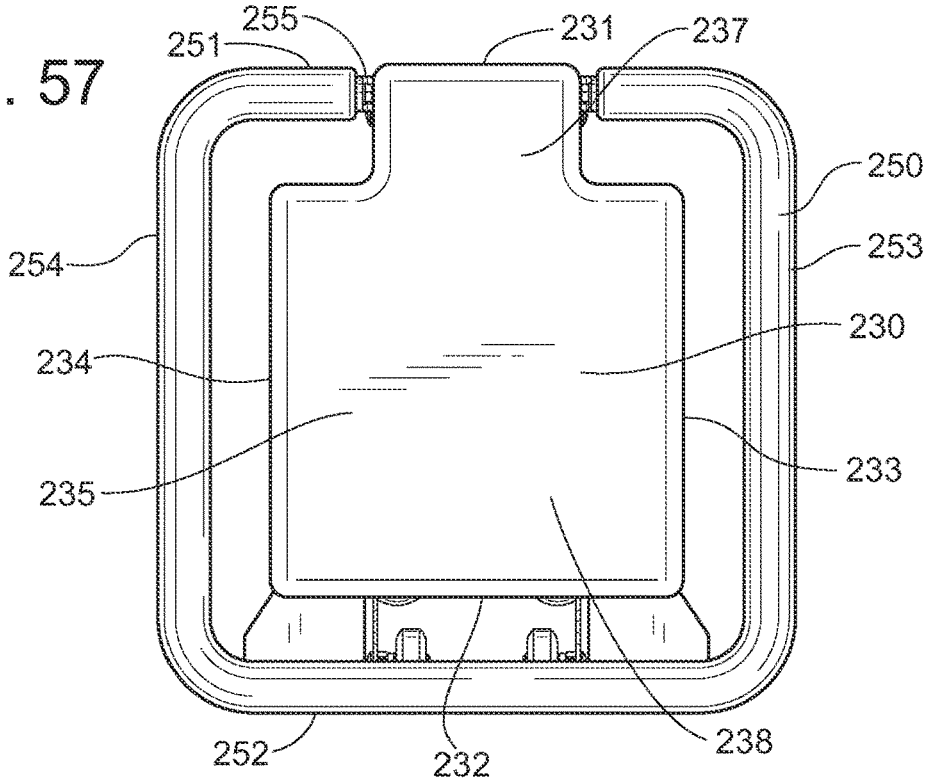
FIG. 57 is a top view of a carriage of an exercise machine in accordance with an example embodiment.
Figure 58:
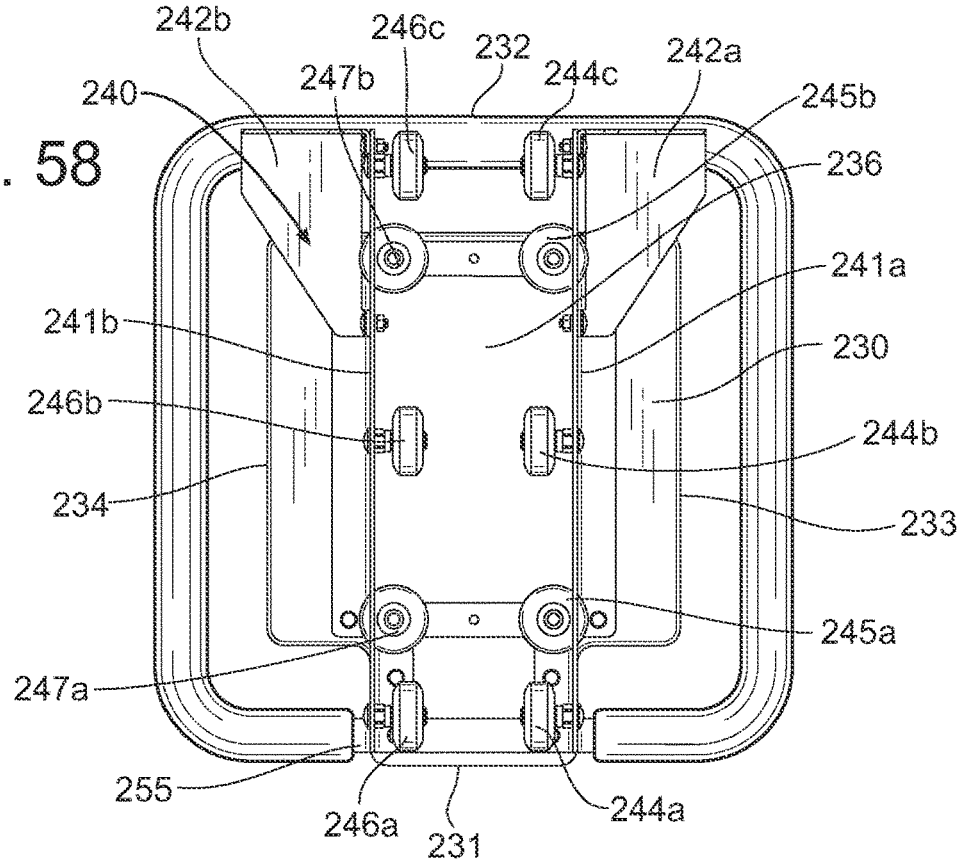
FIG. 58 is a bottom view of a carriage of an exercise machine in accordance with an example embodiment.

The carriage wheel assembly 240 is best shown in FIGS. 56 and 58. With reference to those figures, it can be seen that the carriage wheel assembly 240 may be removably or fixedly connected to the underside (lower end 216) of the carriage 230. In the exemplary embodiment shown in FIG. 56, the carriage wheel assembly 240 is illustrated at comprising a pair of wheel supports 241*a*, 241*b*. The wheel supports 241*a*, 241*b* may function to support the wheels 244*a*, 244*b*, 244*c*, 245*a*, 245*b*, 246*a*, 246*b*, 246*c*, 247*a*, 247*b* of the carriage 230, with the wheels 244*a*, 244*b*, 244*c*, 245*a*, 245*b*, 246*a*, 246*b*, 246*c*, 247*a*, 247*b* being freely rotatable with respect to the wheel supports 241*a*, 241*b*.

Figure 61:
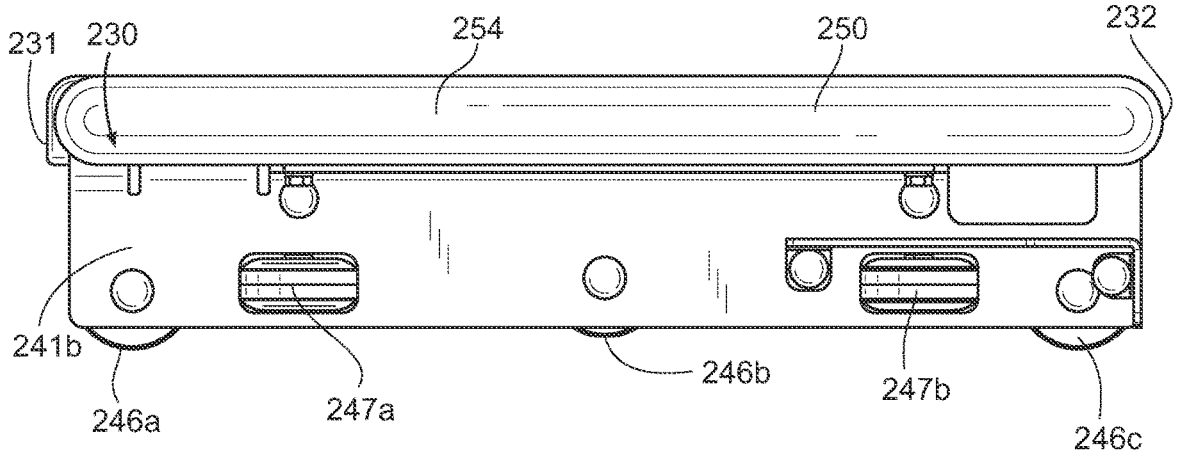
FIG. 61 is a side view of a carriage of an exercise machine in accordance with an example embodiment.

As best shown in FIGS. 56, 58, and 61, the wheel supports 241*a*, 241*b* may each comprise a bracket-like structure such as a plate member which is connected to the lower end 236 of the carriage 230. In the exemplary embodiment shown in the figures, a first wheel support 241*a* is connected near the first side 233 of the lower end 236 of the carriage and a second wheel support 241*b* is connected near the second side 234 of the lower end 236 of the carriage 230. The wheel supports 241*a*, 241*b* may be parallel with respect to each other as shown in the figures, with each of the wheels 244*a*, 244*b*, 244*c*, 245*a*, 245*b*, 246*a*, 246*b*, 246*c*, 247*a*, 247*b* being rotatably connected to one of the wheel supports 241*a*, 241*b* as shown in FIG. 56.

Continuing to reference FIG. 56, it can be seen that each of the wheel supports 241*a*, 241*b* includes a bias receiver member 242*a*, 242*b*. More specifically, the first wheel support 241*a* includes a first bias receiver member 242*a* and the second wheel support 241*b* includes a second bias receiver member 242*b*. Each of the bias receiver members 242*a*, 242*b* are configured to selectively and removably secure a bias member 283*a*, 283*b*, 284*a*, 284*b* to the carriage 230 such that, when one or more of the bias members 283*a*, 283*b*, 284*a*, 284*b* is connected to the carriage 230, a level of resistance will be applied against movement of the carriage 230 in a direction opposite to the bias members 283*a*, 283*b*, 284*a*, 284*b*.

In the exemplary embodiment shown in the figures, the bias receiver members 242*a*, 242*b* may each comprise a wing-like structure which fans out from the outer edge of its respective wheel support 241*a*, 241*b*. FIG. 58 best illustrates such an embodiment, showing that the first bias receiver member 242*a* is connected to and fans out from the first wheel support 241*a* and the second bias receiver member 242*b* is connected to and fans out from the second wheel support 241*b*. The bias receiver members 242*a*, 242*b* may be fixedly or removably connected to the wheel supports 241*a*, 241*b*, such as through use of fasteners as shown in the figures, or may be integrally formed with the wheel supports 241*a*, 241*b* in some embodiments.

As shown throughout the figures, the bias receiver members 242*a*, 242*b* are configured to selectively and removably receive and engage with one or more bias members 283*a*, 283*b*, 284*a*, 284*b* so as to selectively apply variable resistance levels against movement of the carriage 230 for the performance of various exercises. The bias receiver members 242*a*, 242*b* thus may include bias receivers 243*a*, 243*b* each being comprised of a slot, key-hole, or other type of opening in which the nubs 290*a*, 290*b*, 292*a*, 292*b* of the bias members 283*a*, 283*b*, 284*a*, 284*b* may be selectively engaged.

In the exemplary embodiment shown in FIG. 56, the first wheel support 241*a* comprises a pair of first bias receivers 243*a* and the second wheel support 241*b* comprises a pair of second bias receivers 243*b*. While the figures illustrate that each of the wheel supports 241*a*, 241*b* includes a pair of bias receivers 243*a*, 243*b*, it should be appreciated that more or less bias receivers 243*a*, 243*b* may be utilized on each wheel support 241*a*, 241*b*. The bias receiver members 242*a*, 242*b* are generally positioned adjacent to the second end 232 of the carriage 230 on its lower end 236 as shown in the figures, though they may be positioned in various other locations in different embodiments.

Figure 50:
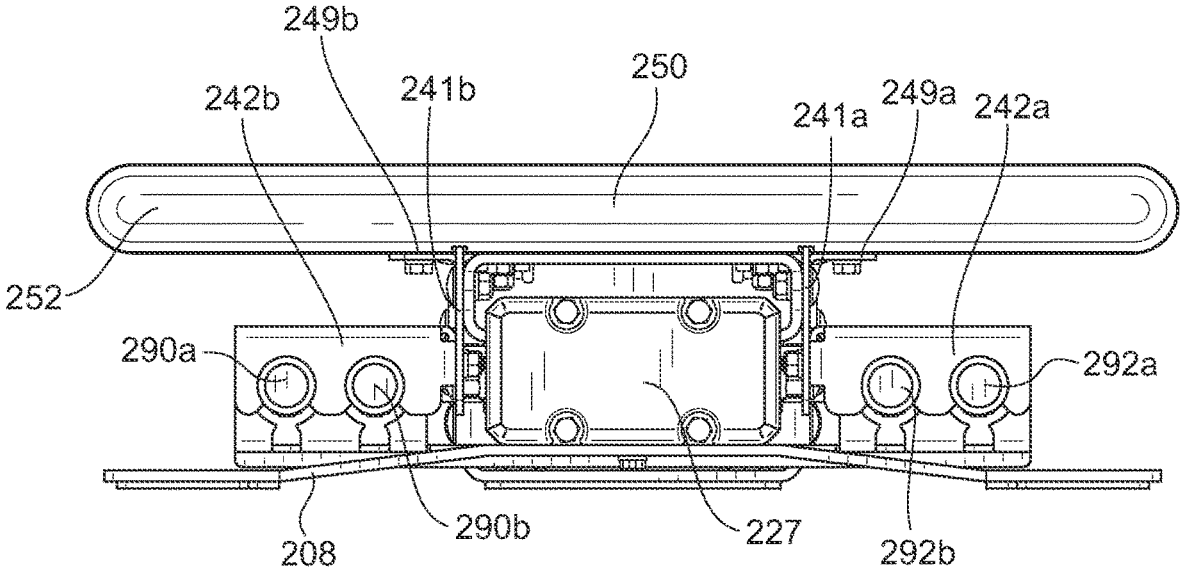
FIG. 50 is a first end view of an exercise machine in accordance with an example embodiment.
Figure 51:
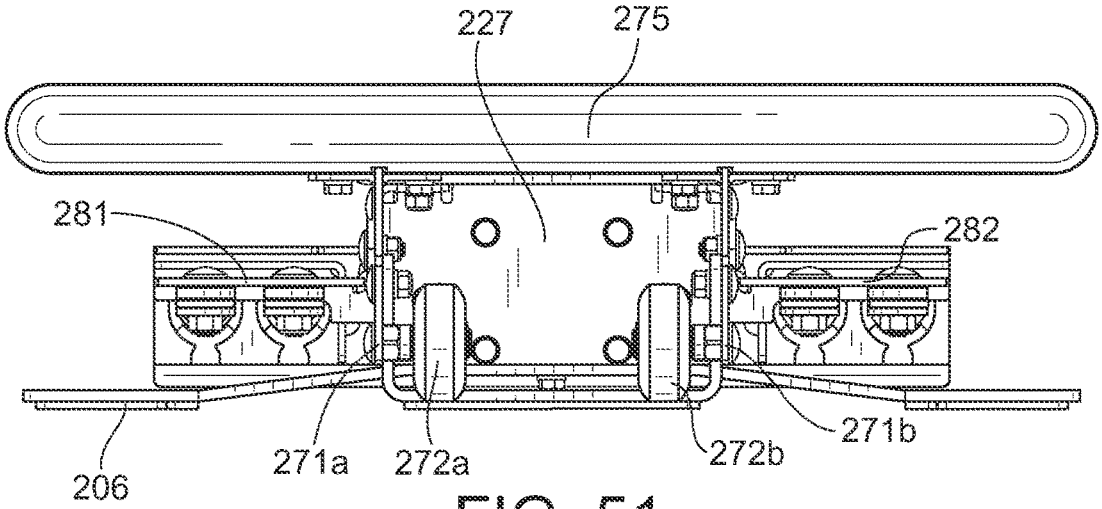
FIG. 51 is a second end view of an exercise machine in accordance with an example embodiment.

As shown in FIGS. 50 and 51, the carriage wheel assembly 240 may be connected to the carriage 230. The figures illustrate fasteners being utilized to secure the carriage wheel assembly 240 being connected to the underside (lower end 236) of the carriage 230. However, other configurations may be utilized such as, for example, integral forming or welding.

Figure 55:
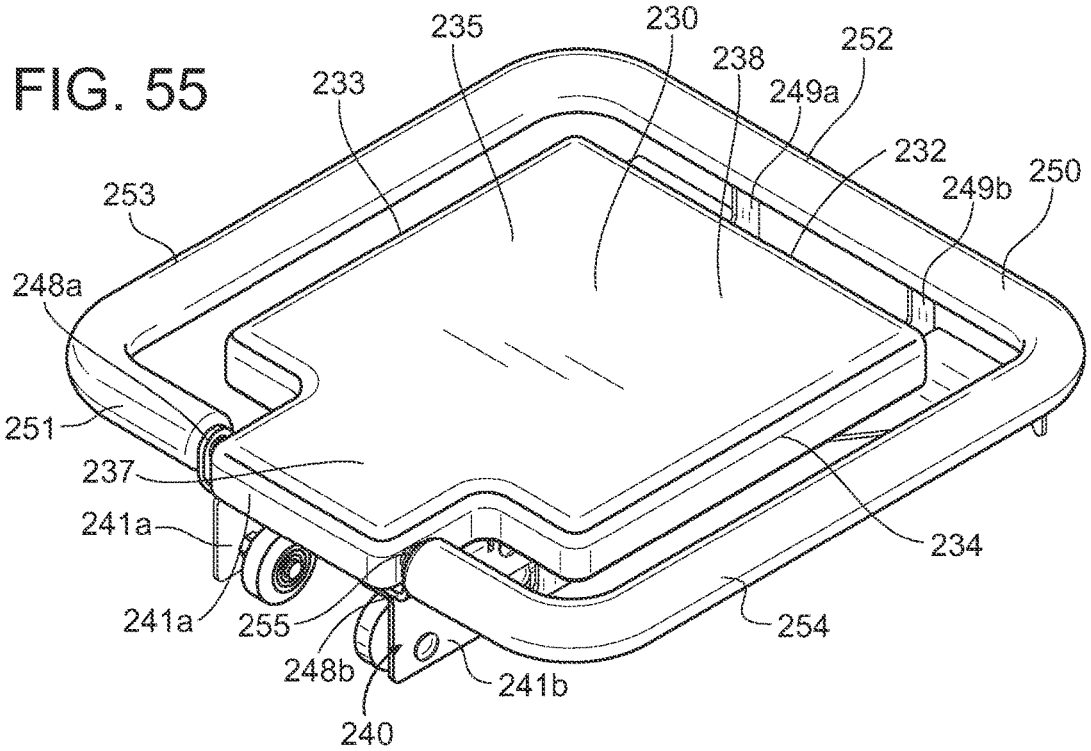
FIG. 55 is an upper perspective view of a carriage of an exercise machine in accordance with an example embodiment.

In the exemplary embodiment shown in FIGS. 55 and 56, it can be seen that the carriage wheel assembly 240 may include first connector brackets 248*a*, 248*b* which connect the carriage wheel assembly 240 at or near the first end 231 of the carriage 230 and second connector brackets 249*a*, 249*b* which connect the carriage wheel assembly 240 at or near the second end 232 of the carriage 230.

The carriage wheel assembly 240 may thus include a first connector bracket 248*a* connected between the first wheel support 241*a* and the carriage 230 and a second connector bracket 248*b* connected between the second wheel support 241*b* and the carriage 230. In some embodiments, the outer carriage handle 250 or the linkage 255 of the outer carriage handle 250 may extend through the first connector brackets 248*a*, 248*b*.

Similarly, the carriage wheel assembly 240 may include a first connector bracket 249*a* connected between the first bias receiver member 242*a* and the outer carriage handle 240 and a second connector bracket 249*b* connected between the second bias receiver member 242*b* and the outer carriage handle 240 such as shown in FIG. 55. The second connector brackets 249*a*, 249*b* may comprise stanchions or the like which are connected between the carriage wheel assembly 240, such as its bias receiver members 242*a*, 242*b*, and the outer carriage handle 240 (such as the underside of its second end 252) or the carriage 230 itself.

As shown in FIGS. 56 and 58, the carriage wheel assembly 240 is configured to support a plurality of wheels 244*a*, 244*b*, 244*c*, 245*a*, 245*b*, 246*a*, 246*b*, 246*c*, 247*a*, 247*b* which each engage with the track 210 to allow the carriage 230 to move along the track 210. The configuration of the wheels 244*a*, 244*b*, 244*c*, 245*a*, 245*b*, 246*a*, 246*b*, 246*c*, 247*a*, 247*b* ensures that the carriage 230 is secured to the track 210 in a manner which prevents any "play" such as lateral movements, shaking or jostling between the carriage 230 and the track 210 when the carriage 230 is in motion. Such unexpected movements may present a risk of injury to the exerciser, or may impact the effectiveness of the exercises being performed. Thus, it is desirable to prevent any such unexpected movements of the carriage 230 such as jostling or the like through use of wheels 244*a*, 244*b*, 244*c*, 245*a*, 245*b*, 246*a*, 246*b*, 246*c*, 247*a*, 247*b* which engage with the track 210 in a manner so as to minimize such unexpected movements.

In the exemplary embodiment shown in FIG. 56, the first wheel support 241*a* is shown as comprising a plurality of first vertical wheels 244*a*, 244*b*, 244*c* and a plurality of first horizontal wheels 245*a*, 245*b* which are rotatably connected to the first wheel support 241*a*. The first vertical wheels 244*a*, 244*b*, 244*c* and the first horizontal wheels 245*a*, 245*b* are adapted to engage within the first side groove 224 of the track 210 as discussed in more detail herein.

The first vertical wheels 244*a*, 244*b*, 244*c* are oriented vertically in an orientation which is parallel to the wheel support 241*a*. In the exemplary embodiment shown in FIG. 56, the first wheel support 241*a* includes a first vertical wheel 244*a* rotatably connected to the first wheel support 241*a* near the first end 231 of the carriage 230, a third vertical wheel 244*c* rotatably connected to the first wheel support 241*a* near the second end 232 of the carriage 230, and a second vertical wheel 244*b* rotatably connected to the first wheel support 241*a* between the first and third vertical wheels 244*a*, 244*c*. It should be appreciated that more or less first vertical wheels 244*a*, 244*b*, 244*c* may be utilized in different embodiments.

The first horizontal wheels 245*a*, 245*b* are oriented horizontally in an orientation which is perpendicular to the wheel support 241*a*. In the exemplary embodiment shown in FIG. 56, the first wheel support 241*a* includes a first horizontal wheel 245*a* rotatably connected to the first wheel support 241*a* near the first vertical wheel 244*a* and a second horizontal wheel 245*b* rotatably connected to the first wheel support 241*a* near the third vertical wheel 244*c*. As shown, the first horizontal wheel 245*a* may be positioned inwardly from the first vertical wheel 244*a* and the second horizontal wheel 245*b* may be positioned inwardly from the third vertical wheel 244*c*.

In the exemplary embodiment shown in FIG. 56, the second wheel support 241*b* is shown as comprising a plurality of second vertical wheels 246*a*, 246*b*, 246*c* and a plurality of second horizontal wheels 247*a*, 247*b* which are rotatably connected to the second wheel support 241*b*. The second vertical wheels 246*a*, 246*b*, 246*c* and the second horizontal wheels 247*a*, 247*b* are adapted to engage within the second side groove 225 of the track 210 as discussed in more detail herein.

The second vertical wheels 246*a*, 246*b*, 246*c* are oriented vertically in an orientation which is parallel to the wheel support 241*b*. In the exemplary embodiment shown in FIG. 56, the second wheel support 241*b* includes a first vertical wheel 246*a* rotatably connected to the second wheel support 241*b* near the first end 231 of the carriage 230, a third vertical wheel 246*c* rotatably connected to the second wheel support 241*b* near the second end 232 of the carriage 230, and a second vertical wheel 246*b* rotatably connected to the second wheel support 241*b* between the first and third vertical wheels 246*a*, 246*c*. It should be appreciated that more or less second vertical wheels 246*a*, 246*b*, 246*c* may be utilized in different embodiments.

The second horizontal wheels 247*a*, 247*b* are oriented horizontally in an orientation which is perpendicular to the wheel support 241*b*. In the exemplary embodiment shown in FIG. 56, the second wheel support 241*b* includes a first horizontal wheel 247*a* rotatably connected to the second wheel support 241*b* near the first vertical wheel 246*a* and a second horizontal wheel 247*b* rotatably connected to the second wheel support 241*b* near the third vertical wheel 246*c*. As shown, the first horizontal wheel 247*a* may be positioned inwardly from the first vertical wheel 246*a* and the second horizontal wheel 247*b* may be positioned inwardly from the third vertical wheel 246*c*.

The use of both vertical wheels 244*a*, 244*b*, 244*c*, 246*a*, 246*b*, 246*c* and horizontal wheels 245*a*, 245*b*, 247*a*, 247*b* aids in maintaining stability of the carriage 230 as it is moved along the track 210. More specifically, the wheels 244*a*, 244*b*, 244*c*, 245*a*, 245*b*, 246*a*, 246*b*, 246*c*, 247*a*, 247*b* engage with the track 210 in a manner which prevents or minimizes any "give" including lateral movements such as jostling or shaking, with the vertical wheels 244*a*, 244*b*, 244*c*, 246*a*, 246*b*, 246*c* engaging with the track 210 to minimize "up-and-down" jostling or movement by the carriage 230 and the horizontal wheels 245*a*, 245*b*, 247*a*, 247*b* engaging with the track 210 to minimize "side-to-side" jostling or movement by the carriage 230. Such a feature both minimizes risk of injury due to undesired motion of the carriage 230 and improves efficiency when performing exercises upon the exercise machine 200.

Referring first to the vertical wheels 244*a*, 244*b*, 244*c*, 246*a*, 246*b*, 246*c*, the carriage 230 may include first vertical wheels 244*a*, 244*b*, 244*c* connected to the first wheel support 241*a* and second vertical wheels 246*a*, 246*b*, 246*c* connected to the second wheel support 241*b*. More specifically, the vertical wheels 244*a*, 244*b*, 244*c*, 246*a*, 246*b*, 246*c* may be connected to the inner edge of each of the wheel supports 241*a*, 241*b*.

When the carriage 230 is movably connected to the track 210, the vertical wheels 244*a*, 244*b*, 244*c*, 246*a*, 246*b*, 246*c* each engage within the track 210. More specifically, the vertical wheels 244*a*, 244*b*, 244*c*, 246*a*, 246*b*, 246*c* engage with and run along the grooves 224, 225 of the track 210, with the vertical wheels 244*a*, 244*b*, 244*c*, 246*a*, 246*b*, 246*c* engaging with and running along the upper end of the lower member 221 of the track 210 when so connected. The flanges shown in FIG. 53 at the distal ends of the respective lower members 221, best shown in FIG. 53 and illustrated in FIG. 54 as extending the length of the track 210, prevent the vertical wheels 244*a*, 244*b*, 244*c*, 246*a*, 246*b*, 246*c* from disengaging by sliding out of the respective side groove 224, 225.

With respect to the horizontal wheels 245*a*, 245*b*, 247*a*, 247*b*, the carriage 230 may include first horizontal wheels 245*a*, 245*b* connected to the first wheel support 241*a* and second horizontal wheels 247*a*, 247*b* connected to the second wheel support 241*b*. Each of the horizontal wheels 245*a*, 245*b*, 247*a*, 247*b* may bisect its respective wheel support 241*a*, 241*b*, with the horizontal wheel 245*a*, 245*b*, 247*a*, 247*b* extending through and being rotatable within an opening formed in the wheel support 241*a*, 241*b* such as shown in FIGS. 56 and 61.

When the carriage 230 is movably connected to the track 210, the horizontal wheels 245*a*, 245*b*, 247*a*, 247*b* each engage with the track 210. More specifically, the horizontal wheels 245*a*, 245*b*, 247*a*, 247*b* engage with and run along the grooves 224, 225 of the track 210, with the horizontal wheels 245*a*, 245*b*, 247*a*, 247*b* engaging with and running along the outer end of the first side member 222 or second side member 223 of the track 210 when so connected. The upper and lower members 220, 221 of the track 210 prevent the horizontal wheels 245*a*, 245*b*, 247*a*, 247*b* from disengaging by sliding out of the top or bottom of the respective side grooves 224, 225.

As shown in FIGS. 55-58, the carriage 230 may include one or more handles. In the exemplary embodiment shown in FIGS. 55-58, it can be seen that the carriage 230 includes an outer carriage handle 250 which substantially encircles the carriage 230. In the exemplary embodiment shown in FIGS. 57 and 58, it can be seen that the outer carriage handle 250 extends around the carriage 230 and is distally spaced with respect to the carriage 230 such that an exerciser may wrap his or her hand around the outer carriage handle 250.

The shape, size, and configuration of the outer carriage handle 250 may vary. The outer carriage handle 250 may include a number of gripping surfaces for the exerciser, including a first end 251, a second end 252, a first side 253, and a second side 254. The first end 251 of the outer carriage handle 250 may include a linkage 255 such as a rod, bolt, fastener, or the like which engages with the first portion 237 of the carriage 230 to secure the first end 251 of the carriage handle 250 to the carriage 230.

The second end 252 of the outer carriage handle 250 may extend along and parallel with the second end 232 of the carriage 230 so as to define a space between the second end 252 of the outer carriage handle 250 and the second end 232 of the carriage 230. One or more second connector brackets 249*a*, 249*b* may be utilized to secure the second end 252 of the outer carriage handle 250 to the carriage 230 or carriage wheel assembly 240.

The first side 253 of the outer carriage handle 250 may extend along and parallel with the first side 233 of the carriage 230 so as to define a space between the first side 253 of the outer carriage handle 250 and the first side 233 of the carriage 230. The second side of the outer carriage handle 250 may extend along and parallel with the second side 234 of the carriage 230 so as to define a space between the second side 254 of the outer carriage handle 250 and the second side 234 of the carriage 230.

As best shown in FIGS. 45-49, 59, and 60, the exercise machine 200 may include an end platform 260 which is fixedly or removably connected at or near the first end 211 of the track 210 or the first end 202 of the frame 201. The end platform 260 may be utilized for various purposes, such as to rest the head, hands, legs, feet, or other portions of the exerciser when performing various exercises. For example, the exerciser could put on foot on the end platform 260 and a second foot on the carriage 230 to perform an exercise.

Figure 59:
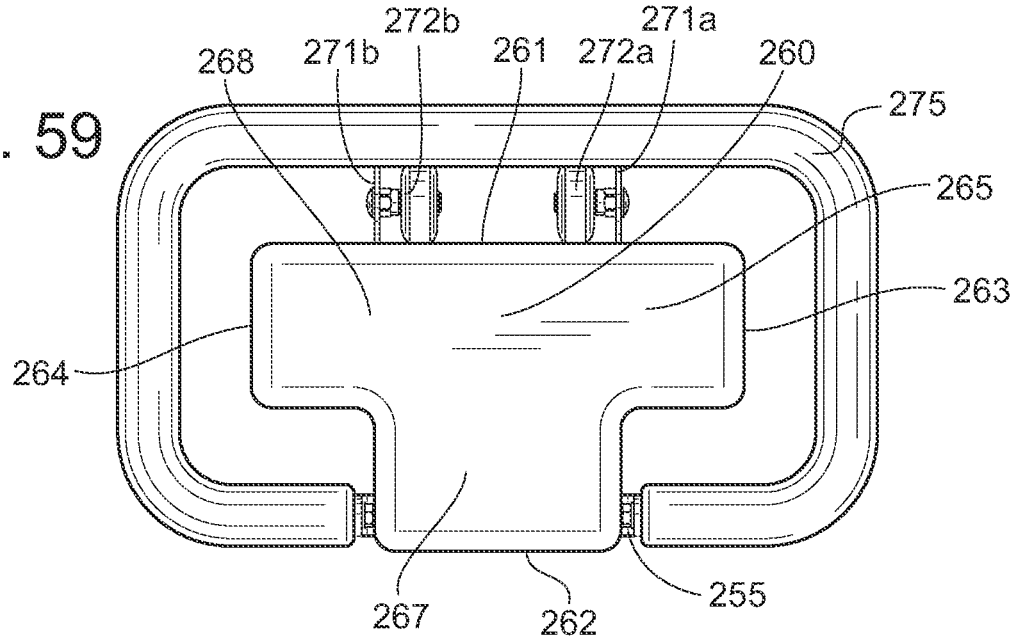
FIG. 59 is a top view of an end platform of an exercise machine in accordance with an example embodiment.

The end platform 260 may comprise a wide range of shapes, sizes, and configurations. The end platform 260 generally includes a front end 261, a rear end 262, a first side 263, a second side 264, an upper end 265, and a lower end 266. The end platform 260 may include a first portion 267 at its first end 261 and a second portion 268 at its second end 262, with the first portion 267 being narrower than the second portion 268. The end platform 260 may include a platform handle 275 which substantially encircles the end platform 260 such as shown in FIGS. 59 and 60.

Figure 60:
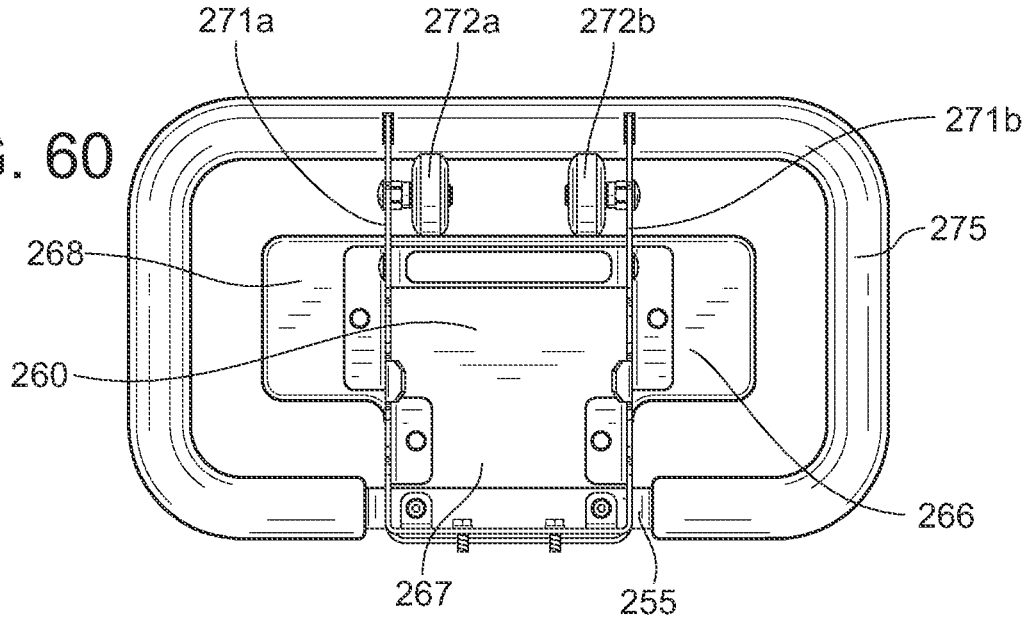
FIG. 60 is a bottom view of an end platform of an exercise machine in accordance with an example embodiment.

The end platform 260 may include a platform wheel assembly 270 such as best shown in FIG. 60. The platform wheel assembly 270 may include a pair of wheel supports 271*a*, 272*b*, with the first wheel support 271*a* extending from the first end 261 to the second end 262 of the end platform 260 and the second wheel support 271*b* extending from the first end 261 to the second end 262 of the end platform 260 in parallel relationship with the first wheel support 271*a*. The wheel supports 271*a*, 271*b* may be connected to a platform handle 275 if provided.

Each of the wheel supports 271*a*, 271*b* may comprise a bracket structure to which one or more platform wheels 272*a*, 272*b* may be rotatably connected. In the exemplary embodiment shown in FIG. 60, the first wheel support 271*a* includes a single first platform wheel 272*a* and the second wheel support 271*b* includes a single second platform wheel 272*b*. It should be appreciated that the first and second wheel supports 271*a*, 271*b* may include additional wheels 272*a*, 272*b* in some embodiments.

The platform wheels 272*a*, 272*b* may be utilized to transport the exercise machine 200. The platform wheels 272*a*, 272*b* are positioned at the first end 202 of the exercise machine 200 such that, when the second end 203 of the exercise machine 200 is lifted, such as by grasping and lifting the second end support 208, the first end 202 of the exercise machine 200 will engage with the ground surface via the platform wheels 272*a*, 272*b*. Thus, by tilting the exercise machine 200, the platform wheels 272*a*, 27*b* engage with the ground surface to allow the exercise machine 200 to be transported to another location, at which the second end 203 of the exercise machine 200 may be lowered which disengages the platform wheels 272*a*, 272*b* from the ground surface.

As shown throughout the figures, the exercise machine 200 may include bias members 283*a*, 283*b*, 284*a*, 284*b* which may be selectively and removably connected to the carriage 230 so as to exert resistance force against movement of the carriage 230 in a certain direction. The number of bias members 283*a*, 283*b*, 284*a*, 284*b* used should not be construed as limiting in scope, as additional bias members 283*a*, 283*b*, 284*a*, 284*b* may be utilized in different embodiments. Various types of bias members 283*a*, 283*b*, 284*a*, 284*b* may be utilized, such as but not limited to springs, cords, and the like.

Figure 62:
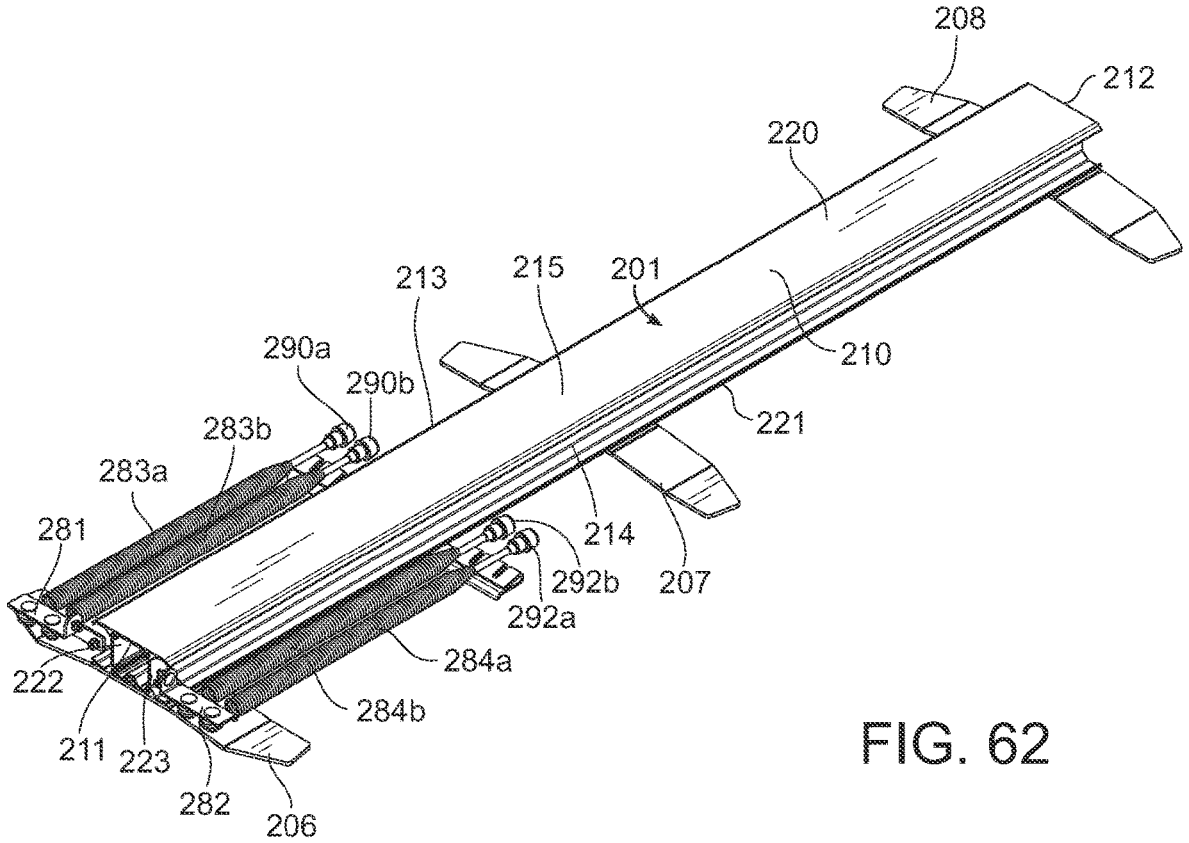
FIG. 62 is an upper perspective view of a frame and a bias member support of an exercise machine in accordance with an example embodiment.
Figure 63:
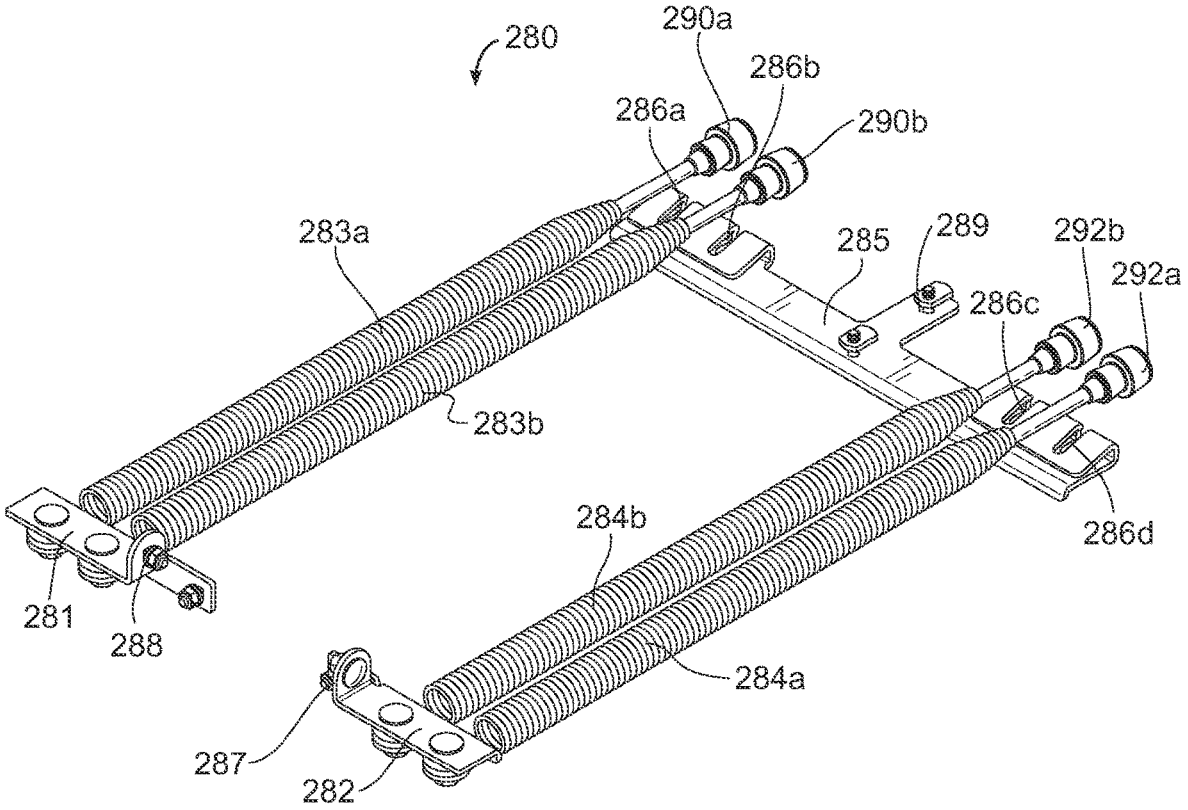
FIG. 63 is a perspective view of a bias member support of an exercise machine in accordance with an example embodiment.

FIGS. 62 and 63 best illustrate a bias member support 280 which is connected to the exercise machine 200 to serve as a hub for the bias members 283*a*, 283*b*, 284*a*, 284*b*. The first end of each of the bias members 283*a*, 283*b*, 284*a*, 284*b* is fixedly connected to one of a pair of anchors 281, 282 of the bias member support 280. The second end of each of the bias members 283*a*, 283*b*, 284*a*, 284*b* may be selectively and removably connected between a bias member retainer 285 of the bias member support 280 when not connected to the carriage 230 and bias receiver members 242*a*, 242*b* of the carriage when connected to the carriage 230.

As shown in FIGS. 62 and 63, the bias member support 280 may comprise a first anchor 281 and a second anchor 282. The first anchor 281 may be connected to the first side of the exercise machine 200, such as to the frame 201, base 204, or track 210, by a first connector bracket 287 and the use of fasteners. Similarly, the second anchor 282 may be connected to the second side of the exercise machine 200, such as to the frame, 201, base 204, or track 210, by a second connector bracket 288 and the use of fasteners. In other embodiments, the anchors 281, 282 may be integrally formed with the exercise machine 200, or may be welded.

As best shown in FIG. 63, the first end of a plurality of first bias members 283*a*, 283*b* may be fixedly connected to the first anchor 281 of the bias member support 280 and the first end of a plurality of second bias members 284*a*, 284*b* may be fixedly connected to the second anchor 282 of the bias member support 280. In the exemplary embodiment shown in the figures, a pair of first bias members 283*a*, 283*b* is shown connected at one end to the first anchor 281 and a pair of second bias members 284*a*, 284*b* is shown connected at one end to the second anchor 282.

It should be appreciated that more bias members 283*a*, 283*b*, 284*a*, 284*b* may be utilized. The exemplary embodiment shown in the figures, with four total bias members 283*a*, 283*b*, 284*a*, 284*b* is merely for illustrative purposes, as it is expected that embodiments of the exercise machine 200 may include more bias members 283*a*, 283*b*, 284*a*, 284*b* than shown in the exemplary figures. Further, in some embodiments, less bias members 283*a*, 283*b*, 284*a*, 284*b* may be utilized, such as by use of only a single first bias member 283*a* and a single second bias member 284*a*.

Continuing to reference FIG. 63, it can be seen that the bias member support 280 includes a bias member retainer 285 for removably and selectively supporting the distal ends of each of the bias members 283*a*, 283*b*, 284*a*, 284*b* when they are not connected to the carriage 230. FIG. 63 illustrates four such bias members 283*a*, 283*b*, 284*a*, 284*b* being connected at their distal ends to the bias member retainer 285 of the carriage wheel assembly 240.

As shown, the bias member retainer 285 may comprise an elongated member which extends transverse (or perpendicular) with respect to the bias members 283*a*, 283*b*, 284*a*, 284*b*. The bias member retainer 285 may include a third connector bracket 289 such as shown in FIG. 63 to connect the bias member support 280 to the exercise machine 200. The third connector bracket 289 may be connected, such as by welding or fasteners, to the lower end 216 of the track 210 such as shown in FIG. 62.

The bias member retainer 285 includes a plurality of retainer slots 286*a*, 286*b*, 286*c*, 286*d* in which the distal end of each of the bias members 283*a*, 283*b*, 284*a*, 284*b* may be removably secured. When the bias members 283*a*, 283*b*, 284*a*, 284*b* are so secured to the bias member retainer 285, they do not impart any force against the carriage 230. In the exemplary embodiment shown in the figures, the distal end of the first bias member 283*a* may be removably secured within the first retainer slot 286*a*, the distal end of the second bias member 283*b* may be removably secured within the second retainer slot 286*b*, the distal end of the third bias member 284*a* may be removably secured within the third retainer slot 286*c*, and the distal end of the fourth bias member 284*b* may be removably secured within the fourth retainer slot 286*d*.

As shown in the figures, each of the bias members 283*a*, 283*b*, 284*a*, 284*b* may comprise a nub 290*a*, 290*b*, 292*a*, 292*b* which retains the respective bias members 283*a*, 283*b*, 284*a*, 284*b* in their respective retainer slots 286*a*, 286*b*, 286*c*, 286*d*. In the exemplary embodiment shown in FIG. 63, the first bias member 283*a* includes a first nub 290*a*, the second bias member 283*b* includes a second nub 290*b*, the third bias member 284*a* includes a third nub 292*a*, and the fourth bias member 284*b* includes a fourth nub 292*b*. In use, the nubs 290*a*, 290*b*, 292*a*, 292*b* may be grasped by the user to selectively engage with the carriage 230 to selectively connect one or more of the bias members 283*a*, 283*b*, 284*a*, 284*b* to the carriage 230 so as to impart a resistance force against movement of the carriage 230.

Unless otherwise defined, all technical and scientific terms used herein have the same meaning as commonly understood by one of ordinary skill in the art to which this invention belongs. Although methods and materials similar to or equivalent to those described herein can be used in the practice or testing of the compact exercise machine, suitable methods and materials are described above. All publications, patent applications, patents, and other references mentioned herein are incorporated by reference in their entirety to the extent allowed by applicable law and regulations. The compact exercise machine may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a base including a first end, and a second end, wherein the base has a longitudinal axis, wherein the base includes a track;

a carriage movably connected to the base and adapted to be moveable along a portion of the longitudinal axis of the base;

a bias member connected between the base and the carriage, wherein the bias member provides a biasing force to the carriage; and a lifting member rotatably connected to the base at or near the first end of the base by an axle, wherein the lifting member is adapted to rotate about the axle, wherein the lifting member is adjustable between a first position and a second position, wherein the first end of the base is in a lowered position when the lifting member is in the first position, wherein the first end of the base is in a raised position when the lifting member is in the second position;

wherein the lifting member is adapted to engage with a ground surface to lift the first end of the base when the lifting member is in the second position;

wherein the lifting member comprises a first arm and a second arm;

wherein the first arm and the second arm each include a first segment and a second segment;

wherein the second segment of the first arm extends at an angle from the first segment of the first arm;

wherein the second segment of the second arm extends at an angle from the first segment of the second arm;

wherein the first segment of the first arm and the first segment of the second arm each include a first distal portion;

wherein the second segment of the first arm and the second segment of the second arm each include a second distal portion opposite of the first distal portion;

wherein the second segment extends at an upward angle when the lifting member is in the first position;

wherein the second segment extends at a downward angle when the lifting member is in the second position;

wherein the first distal portion of the first segment and the second distal portion of the second segment engage the ground surface when the lifting member is in the second position thereby lifting the first end of the base into the raised position above the ground surface.

2. The exercise machine of claim 1, wherein the lifting member is adapted to be adjusted in a first direction to lift the first end of the base and wherein the lifting member is adapted to be adjusted in a second direction to lower the first end of the base, wherein the first direction is opposite to the second direction.

3. The exercise machine of claim 2, wherein the first direction is away from the base and wherein the second direction is towards the base.

4. The exercise machine of claim 1, wherein the base is level when the lifting member is in the first position.

5. The exercise machine of claim 4, wherein the base is inclined when the lifting member is in the second position.

6. The exercise machine of claim 1, wherein the axle extends through the first arm and the second arm.

7. The exercise machine of claim 6, wherein the axle is positioned between the first segment and the second segment of the first arm and the second arm.

8. The exercise machine of claim 1, wherein the lifting member comprises a gripping handle extending between the second distal portion of the first arm and the second arm.

9. The exercise machine of claim 1, wherein the first arm comprises a first gripping handle and wherein the second arm comprises a second gripping handle, wherein the first gripping handle is not connected to the second gripping handle.

10. The exercise machine of claim 1, wherein the first arm extends upwardly from a first side of the base and wherein the second arm extends upwardly from a second side of the base.

11. The exercise machine of claim 1, wherein the axle is perpendicular with respect to the first arm and the second arm.

12. The exercise machine of claim 1, wherein the first segment of the first arm and the first segment of the second arm are each parallel with the ground surface when the lifting member is in the first position.

13. The exercise machine of claim 1, wherein the first segment of the first arm and the first segment of the second arm are each diagonally-oriented when the lifting member is in the second position.

14. The exercise machine of claim 1, comprising an end platform connected to the first end or the second end of the base.

15. A method of adjusting the exercise machine of claim 1, comprising the steps of:

grasping the lifting member by a user;

adjusting the lifting member into the second position to raise the first end of the base; and adjusting the lifting member into the first position to lower the first end of the base.

16. The exercise machine of claim 1, comprising:

a first handle connected to the base at or near the second end of the base, wherein the first handle extends upwardly from a first side of the base; and a second handle connected to the base at or near the second end of the base, wherein the second handle extends upwardly from a second side of the base;

wherein a distance between the first handle and the second handle is just greater than a width of the carriage such that the carriage is configured to pass freely between the first handle and the second handle.

17. The exercise machine of claim 1, including a cross member connected between the first distal portion of the first arm and the first distal portion of the second arm.

18. The exercise machine of claim 1, wherein the first segment is shorter than the second segment.

19. An exercise machine, comprising:

a base including a first end, and a second end, wherein the base has a longitudinal axis, wherein the base includes a track;

a carriage movably connected to the base and adapted to be moveable along a portion of the longitudinal axis of the base;

a bias member connected between the base and the carriage, wherein the bias member provides a biasing force to the carriage; and a lifting member rotatably connected to the base at or near the first end of the base by an axle, wherein the lifting member is adapted to rotate about the axle, wherein the lifting member is adjustable between a first position and a second position, wherein the first end of the base is in a lowered position when the lifting member is in the first position, wherein the first end of the base is in a raised position when the lifting member is in the second position;

wherein the lifting member is adapted to be adjusted in a first direction to lift the first end of the base and wherein the lifting member is adapted to be adjusted in a second direction to lower the first end of the base, wherein the first direction is opposite to the second direction;

wherein the base is level when the lifting member is in the first position, and wherein the base is inclined when the lifting member is in the second position;

wherein the lifting member is adapted to engage with a ground surface to lift the first end of the base when the lifting member is in the second position;

wherein the lifting member comprises a first arm and a second arm;

wherein the first arm and the second arm each include a first segment and a second segment;

wherein the second segment of the first arm extends at an angle from the first segment of the first arm;

wherein the second segment of the second arm extends at an angle from the first segment of the second arm;

wherein the first segment of the first arm and the first segment of the second arm each include a first distal portion;

wherein the second segment of the first arm and the second segment of the second arm each include a second distal portion opposite of the first distal portion;

wherein the second segment extends at an upward angle when the lifting member is in the first position;

wherein the second segment extends at a downward angle when the lifting member is in the second position;

wherein the first distal portion of the first segment and the second distal portion of the second segment engage the ground surface when the lifting member is in the second position thereby lifting the first end of the base into the raised position above the ground surface.

20. An exercise machine, comprising:

a base including a first end, and a second end, wherein the base has a longitudinal axis, wherein the base includes a track;

an end platform connected to the first end or the second end of the base;

a carriage movably connected to the base and adapted to be moveable along a portion of the longitudinal axis of the base;

a bias member connected between the base and the carriage, wherein the bias member provides a biasing force to the carriage; and a lifting member rotatably connected to the base at or near the first end of the base by an axle, wherein the lifting member is adapted to rotate about the axle, wherein the lifting member is adjustable between a first position and a second position, wherein the first end of the base is in a lowered position when the lifting member is in the first position, wherein the first end of the base is in a raised position when the lifting member is in the second position;

wherein the lifting member is adapted to be adjusted in a first direction to lift the first end of the base and wherein the lifting member is adapted to be adjusted in a second direction to lower the first end of the base, wherein the first direction is opposite to the second direction;

wherein the base is level when the lifting member is in the first position, and wherein the base is inclined when the lifting member is in the second position;

wherein the lifting member is adapted to engage with a ground surface to lift the first end of the base when the lifting member is in the second position;

wherein the lifting member comprises a first arm and a second arm;

wherein the first arm and the second arm each include a first segment and a second segment;

wherein the second segment of the first arm extends at an angle from the first segment of the first arm;

wherein the second segment of the second arm extends at an angle from the first segment of the second arm;

wherein the first segment of the first arm and the first segment of the second arm each include a first distal portion;

wherein the second segment of the first arm and the second segment of the second arm each include a second distal portion opposite of the first distal portion;

wherein the second segment extends at an upward angle when the lifting member is in the first position;

wherein the second segment extends at a downward angle when the lifting member is in the second position;

wherein the first distal portion of the first segment and the second distal portion of the second segment engage the ground surface when the lifting member is in the second position thereby lifting the first end of the base into the raised position above the ground surface;

wherein the lifting member comprises a gripping handle extending between the second distal portion of the first arm and the second arm;

wherein the first arm extends upwardly from a first side of the base and wherein the second arm extends upwardly from a second side of the base;

wherein the axle is perpendicular with respect to the first arm and the second arm.

* * * * *